US009873927B2

(12) United States Patent
Oishi et al.

(10) Patent No.: US 9,873,927 B2
(45) Date of Patent: Jan. 23, 2018

(54) COPPER ALLOY

(71) Applicant: Mitsubishi Shindoh Co, Ltd., Tokyo (JP)

(72) Inventors: Keiichiro Oishi, Osaka (JP); Yosuke Nakasato, Kitamoto (JP); Katsuhiko Hata, Osaka (JP); Shinji Tanaka, Osaka (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 15/079,679

(22) Filed: Mar. 24, 2016

(65) Prior Publication Data

US 2016/0201180 A1 Jul. 14, 2016

Related U.S. Application Data

(62) Division of application No. PCT/JP2014/075735, filed on Sep. 26, 2014.

(30) Foreign Application Priority Data

Sep. 26, 2013 (JP) ..... 2013-199475
Feb. 28, 2014 (JP) ..... 2014-039679

(51) Int. Cl.

| | |
|---|---|
| ***C21D 8/02*** | (2006.01) |
| ***C22C 9/04*** | (2006.01) |
| ***B22D 21/00*** | (2006.01) |
| ***C21D 9/46*** | (2006.01) |
| ***C22F 1/08*** | (2006.01) |

(52) U.S. Cl.

CPC ..... *C22C 9/04* (2013.01); *B22D 21/005* (2013.01); *C21D 8/02* (2013.01); *C21D 8/0226* (2013.01); *C21D 8/0236* (2013.01); *C21D 8/0263* (2013.01); *C21D 8/0273* (2013.01); *C21D 9/46* (2013.01); *C22F 1/08* (2013.01)

(58) Field of Classification Search

CPC ..... C21D 8/02; C21D 8/0226; C21D 8/0236; C21D 8/0263

USPC ..... 148/501, 681, 682

See application file for complete search history.

(56) References Cited

U.S. PATENT DOCUMENTS

| | | | |
|---|---|---|---|
| 6,471,792 | B1 | 10/2002 | Breedis et al. |
| 9,017,491 | B2 | 4/2015 | Oishi et al. |
| 2014/0112822 | A1 | 4/2014 | Tanaka et al. |
| 2014/0234156 | A1 | 8/2014 | Uchida |
| 2016/0201180 | A1 | 7/2016 | Oishi et al. |
| 2016/0222489 | A1 | 8/2016 | Oishi et al. |

FOREIGN PATENT DOCUMENTS

| | | | |
|---|---|---|---|
| CA | 2 687 452 | A1 | 5/2011 |
| CA | 2 842 488 | A1 | 2/2013 |
| CA | 2 844 247 | A1 | 3/2013 |
| JP | 5-311294 | A | 11/1993 |
| JP | 06-228684 | A | 8/1994 |
| JP | 10-265874 | A | 10/1998 |
| JP | 11-239603 | A | 9/1999 |
| JP | 2002-530523 | A | 9/2002 |
| JP | 2004-143574 | A | 5/2004 |
| JP | 2006-283060 | A | 10/2006 |
| JP | 2007-056365 | A | 3/2007 |
| JP | 2007-211317 | A | 8/2007 |
| JP | 2007-332466 | A | 12/2007 |
| JP | 5245015 | B1 | 7/2013 |
| KR | 10-2016-0040313 | | 4/2016 |
| TW | 200722536 | A | 6/2007 |
| TW | 201229259 | A | 7/2012 |
| WO | 2013/042678 | A1 | 3/2013 |
| WO | 2013/115363 | A1 | 8/2013 |

OTHER PUBLICATIONS

International Search Report in related application PCT/JP2014/075612, completed Dec. 17, 2014 and dated Jan. 6, 2015.
Taiwanese search report in related application 103133607 dated Jul. 7, 2015.
Japanese office action in related application 2015-539378 dated Oct. 27, 2015.
Restriction/Election issued in co-pending related U.S. Appl. No. 15/024,500, dated Jun. 30, 2016.
Office Action issued in related Korean application 10-2016-7005904 dated Jul. 18, 2016.
Office Action issued in related Canadian application 2,922,455 dated Jul. 11, 2016.
Office Action issued in related U.S. Appl. No. 15/024,500, dated Sep. 8, 2016.
Office action issued in co-pending Canadian application 2,923,462 dated Apr. 26, 2016.
A.P. Miodownik. "Cu-Zn (Copper-Zinc)." Phase Diagrams of Binary Copper Alloys. P.R. Subramanian, D. J. Chakrabarti, D. E. Laughlin, Ed. ASM International, 1994, p. 487-496
Office Action issued in co-pending U.S. Appl. No. 15/066,093, dated Feb. 22, 2017.

*Primary Examiner* — Brian Walck
(74) *Attorney, Agent, or Firm* — Griffin and Szipl PC

(57) ABSTRACT

A copper alloy according to the present invention includes 17 mass % to 34 mass % of Zn, 0.02 mass % to 2.0 mass % of Sn, 1.5 mass % to 5 mass % of Ni, and a balance consisting of Cu and unavoidable impurities, in which relationships of $12 \leq f1 = [Zn] + 5 \times [Sn] - 2 \times [Ni] \leq 30$, $10 \leq [Zn] - 0.3 \times [Sn] - 2 \times [Ni] \leq 28$, $10 \leq f3 = \{f1 \times (32 - f1) \times [Ni]\}^{1/2} \leq 33$, $1.2 \leq 0.7 \times [Ni] + [Sn] \leq 4$, and $1.4 \leq [Ni]/[Sn] \leq 90$ are satisfied, conductivity is 13% IACS to 25% IACS, a ratio of an α phase is 99.5% or more by area ratio or an area ratio of a γ phase (γ) % and an area ratio of a β phase (β) % in an α phase matrix satisfy a relationship of $0 \leq 2 \times (\gamma) + (\beta) \leq 0.7$.

14 Claims, No Drawings

COPPER ALLOY

This is a Divisional Application in the United States of International Patent Application No. PCT/JP2014/075735 filed Sep. 26, 2014, which claims priority on Japanese Patent Application No. 2013-199475, filed Sep. 26, 2013 and 2014-039679, filed on Feb. 28, 2014. The entire disclosures of the above patent applications are hereby incorporated by reference.

TECHNICAL FIELD

The present invention relates to a copper alloy (Cu—Zn alloy, that is, brass) which has a brass-yellow color, and has stress corrosion cracking resistance, color fastness, antimicrobial properties, excellent stress relaxation characteristics, strength, and bending workability. Particularly, the present invention relates to a copper alloy used for applications such as terminals and connectors for automobiles, electronic and electrical apparatuses, medical appliances, public use such as handrails, door handles, and water supply and drain sanitary facilities, and construction-related use.

Priority is claimed on Japanese Patent Application No. 2013-199475, filed Sep. 26, 2013, and Japanese Patent Application No. 2014-039679, filed Feb. 28, 2014, the contents of which are incorporated herein by reference.

BACKGROUND ART

In the related art, brass (Cu—Zn alloy) having Cu and Zn as main components has been used for constituent materials for connectors, terminals, relays, springs, sockets, switches, and the like which are used in decoration members such as handrails, door handles, lighting equipment, elevator panels, and the like, construction members, metal fittings and metal goods, or electronic and electrical components, automobile components, communication apparatuses, electronic and electrical apparatuses, and the like. However, under high temperature and high humidity conditions, the color of the brass is changed due to surface oxidation for a short period of time even in a room. As a result, the brass-yellow color is impaired, which causes a problem in appearance. When a transparent clear coating or Ni or Sn plating is carried out to avoid a color change, the antimicrobial performance and the conductivity of the copper alloy are not exhibited in some cases.

In recent years, along with a reduction in size and weight and high performance of apparatuses, connectors, terminals and the like have been required to have extremely strict characteristic improvements and cost performance. For example, a thin sheet is used for a spring contact portion of a connector. However, it is required for a high strength copper alloy which constitutes the thin sheet to have high strength, a high degree of balance between elongation and strength, and resistance to severe use environments, that is, excellent color fastness, stress corrosion cracking resistance, and stress relaxation characteristics so as to realize a small thickness. Further, it has been required to obtain high productivity, particularly, to obtain excellent economical efficiency by keeping the amount of copper used which is a noble metal to a minimum.

Examples of the above-described use environment of the copper alloy include an indoor environment (including the inside of a car) at a high temperature or a high humidity, an environment in which a large number of unspecified people touch the alloy, and an environment including a small amount of a nitrogen compound such as ammonia and amine, and the like. The copper alloy is required to have color fastness and stress corrosion cracking resistance to endure these environments.

In handrails, door handles, unplated connectors, terminals and door handles, and the like, there arise not only problems in appearance and stress corrosion cracking, but also problems of deterioration in antimicrobial properties and conductivity due to oxidation of the surface of brass.

Further, connectors, terminals and the like are used in a cabin of an automobile and a portion close to an engine room under the blazing sun and in this case, the temperature in the use environment reaches about 100° C. High material strength is required in the case in which the thickness of the material has to be reduced. When a copper alloy is used for terminals and connectors, high material strength is required to obtain high contact pressure. However, in the applications for springs, terminals and connectors, the high material strength can be used within a range of stress of the elastic limit at room temperature. However, as the temperature rises in the use environment, for example, when the temperature rises to 90° C. to 150° C. as described above, a copper alloy is permanently deformed. Particularly, in the case of brass, a degree of permanent deformation is great and a predetermined contact pressure cannot be obtained. In order to utilize high strength, a small degree of permanent deformation at a high temperature is demanded and it is preferable that the properties called stress relaxation characteristics are excellent as the measure of the degree of permanent deformation at a high temperature.

However, the plating layer on the surface of a plated product is peeled off by long term use. In addition, when a large amount of products such as connectors or terminals are produced at low costs, in a process of producing a sheet which becomes a material thereof, the surface of the sheet is plated with Sn, Ni and the like in advance and the sheet material is punched and used. In this case, the punched surface is not plated with Sn, Ni and the like and thus color change or stress corrosion cracking easily occurs. Further, when Sn, Ni and the like are included in the plating according to the kind of the plating, it is difficult to recycle the copper alloy.

Here, examples of a high strength copper alloy include phosphor bronze (Cu-6 mass % to 8 mass % Sn—P), and nickel silver (Cu—Zn-10 mass % to 18 mass % Ni). As a general copper alloy which has excellent cost performance and high conductivity and high strength, generally, brass is well-known.

In Patent Document 1, as an alloy which satisfies the requirements for high strength, a Cu—Zn—Sn alloy is disclosed.

On the other hand, constituent members such as side rails, headboards, footboards, handrails, door handles, door knobs, door levers, and medical appliances used in medical institutions, public facilities, facilities and equipment corresponding to these medical institutions and public facilities, and research facilities for strict hygiene management (for example, food, cosmetics, pharmaceutical products and the like), and water supply and drain sanitary facilities and apparatuses such as a drainage tank used in vehicles and the like are formed by joining pipes, sheets, strips, rods, castings, and members formed to have various shapes by forging.

Here, in the case of welding a copper alloy including Zn, since Zn easily evaporates during the welding, a technique is required for welding. In addition, the welding leaves a bead trace in appearance and in order to solve a problem in appearance, a process of polishing a bead trace is added.

Depending on the shape, it may be difficult to remove the bead trace completely. Then, there arises a problem in appearance and it takes much time to remove the bead trace. Thus, this case is not preferable. Further, there is a concern of antimicrobial properties (bactericidal properties) being deteriorated.

In order to obtain sufficient antimicrobial properties (bactericidal properties), instead of joining copper alloy members, a method of attaching a thin copper foil or a composite material obtained by bonding a copper foil and a resin or paper to constituent members such as handrails, door handles, door knobs, and door levers has been attempted (for example, refer to Patent Document 2).

RELATED ART DOCUMENT

Patent Document

[Patent Document 1] JP-A-2007-056365
[Patent Document 2] JP-A-11-239603

SUMMARY OF THE INVENTION

Problem that the Invention is to Solve

However, the above-described general high strength copper alloys such as phosphor bronze, nickel silver and brass have the following problems and cannot respond to the above-described requirements.

Since phosphor bronze and nickel silver have poor hot workability and are difficult to be produced by hot rolling, phosphor bronze and nickel silver are generally produced by horizontal continuous casting. Therefore, the productivity is poor, the energy cost is high, and the yield is also poor. In addition, since a large amount of copper, which is a noble metal, is contained in phosphor bronze and nickel silver or large amounts of expensive Sn and Ni are contained in phosphor bronze and nickel silver, there is a problem in economic efficiency, and both have poor conductivity. Since the specific gravities of these alloys are as high as about 8.8, there arises a problem of weight reduction. Nickel silver containing 10 mass % or more of Ni and phosphor bronze containing 8 mass % or more of Sn have high strength. However, nickel silver has a conductivity of 10% IACS or less and phosphor bronze has a conductivity of 13% IACS or less. Both have low conductivity and this low conductivity causes a problem in use.

Brass containing 20 mass % to 35 mass % of Zn is inexpensive. However, the color is easily changed, stress corrosion cracking easily occurs, and brass is easily affected by heat. That is, brass has a fatal defect of poor stress relaxation characteristics and is not satisfactory in terms of strength and balance between strength and bending. Brass is not suitable for a constituent member of a product for realizing a reduction in size and high performance as described above. Particularly, phosphor bronze and brass have a problem in color fastness and are used by being plated with Sn, Ni or the like in many cases.

Specifically, in a Cu—Zn alloy, as a Zn content increases, the stress corrosion cracking resistance deteriorates. When the Zn content is more than 15 mass %, a problem arises. When the content is more than 20 mass % and is further more than 25 mass %, the stress corrosion cracking resistance deteriorates. When the content is 30 mass %, the sensitivity for stress corrosion cracking is excessively increased and a serious problem arises. The stress relaxation characteristics are further improved when the amount of Zn added is 3 mass % to 15 mass %. However, when the Zn content is more than 20 mass %, particularly, is more than 25 mass %, the stress relaxation characteristics rapidly deteriorate. For example, when the content is 30 mass %, the stress relaxation characteristics are very poor. As the Zn content increases, the strength is improved but the ductility and bending workability deteriorate. Further, the balance between strength and ductility deteriorates. In addition, the color fastness is poor irrespective of the Zn content and when the use environment is poor, the color of the alloy changes to brown or red.

Accordingly, these high strength copper alloys cannot possibly be satisfactory as component constituent materials for various apparatuses that tend to have high reliability with respect to the use environment, excellent cost performance, and realize reduction in size and weight and high performance, and development of a new high strength copper alloy has been strongly demanded.

In addition, the Cu—Zn—Sn alloy described in Patent Document 1 does not have sufficient characteristics including strength.

Further, as described in Patent Document 2, in the case of attaching a copper foil to the surface of the constituent member, due to a small thickness of the copper foil, there is a concern of physical breakage or breakage occurring according to the use environment. In addition, there is a concern of peeling off of the copper coil from the constituent member due to deterioration of an adhesive over time. The copper foil also has a problem in color fastness and cannot always maintain antimicrobial properties (bactericidal properties) and color fastness. Furthermore, a problem of lowering of the strength of the joint portion of the constituent member cannot be solved by these methods.

The present invention has been made to solve the above-described problems in the related art, and an object thereof is to provide a copper alloy which has excellent cost performance, a small density, conductivity higher than the conductivity of phosphor bronze and nickel silver, high strength, balance between strength and elongation and bending workability, excellent stress relaxation characteristics, stress corrosion cracking resistance, color fastness and antimicrobial properties, and is adaptable to various use environments.

Means for Solving the Problem

The present inventors have conducted various studies and experiments from different angles to solve the above problems and have obtained the following findings.

First, appropriate amounts of Ni and Sn are added to a Cu—Zn alloy including a high concentration of Zn of 34 mass % or less. In order to optimize an interaction between Ni having a bivalent atomic valence (or valence electron number) and Sn having a tetravalent atomic valence, the total content of Ni and Sn and a ratio of the contents of Ni and Sn are adjusted that is, $0.7\times[Ni]+[Sn]$ and $[Ni]/[Sn]$ are adjusted to be within appropriate ranges. Further, the contents of Zn, Ni and Sn are adjusted in consideration of an interaction among Zn, Ni and Sn such that three relational expressions of $f1=[Zn]+5\times[Sn]-2\times[Ni]$, $f2=[Zn]-0.3\times[Sn]-2\times[Ni]$, and $f3=\{f1\times(32-f1)\times[Ni]\}^{1/2}$ have appropriate values.

A metallographic structure that is basically composed of an α single phase, in which at least, the ratio of an α phase in the constituent phase of the metallographic structure is 99.5% or more by area ratio (in a seam welded pipe, a welded pipe, brazing or the like, even when a base metal is locally melted or heated to a high temperature, at three sites of a joint portion or a melt zone, a heat affected zone, and a base metal, the average ratio of the α phase in the constituent phase of the metallographic structure is 99.5% or more by area ratio), or a metallographic structure, in which an area ratio of a γ phase (γ) % and an area ratio of a β phase (β) % of an α phase matrix satisfy a relationship of $0 \leq 2 \times (\gamma)+(\beta) \leq 0.7$, and the γ phase having an area ratio of 0% to 0.3% and the β phase having an area ratio of 0% to 0.5% are dispersed in the α phase matrix is provided.

Thus, a copper alloy which has excellent cost performance, a small specific gravity, excellent color fastness, high strength, excellent balance among strength, elongation and bending workability and conductivity, excellent stress relaxation characteristics, excellent stress corrosion cracking resistance, and excellent antimicrobial properties, and is adaptable to various use environments has been found and the present invention has been completed.

Particularly, in the case of applications such as terminals and connectors, in consideration of use in a high temperature environment, the metallographic structure was set to have an α single phase. In addition, P having a pentavalent atomic valence was incorporated and the ratio of the P content and the Ni content was adjusted to be within an appropriate range. Thus, further excellent stress relaxation characteristics could be obtained.

According to a first aspect of the present invention, there is provided a copper alloy including: 17 mass % to 34 mass % of Zn; 0.02 mass % to 2.0 mass % of Sn; 1.5 mass % to 5 mass % of Ni; and a balance consisting of Cu and unavoidable impurities, in which a Zn content [Zn] (mass %), a Sn content [Sn] (mass %), and a Ni content [Ni] (mass %) satisfy relationships of $$12 \leq f1=[Zn]+5\times[Sn]-2\times[Ni] \leq 30,$$

$$10 \leq f2=[Zn]-0.3\times[Sn]-2\times[Ni] \leq 28, \text{ and}$$

$$10 \leq f3=\{f1\times(32-f1)\times[Ni]\}^{1/2} \leq 33,$$

the Sn content [Sn] (mass %) and the Ni content [Ni] (mass %) satisfy relationships of $$1.2 \leq 0.7\times[Ni]+[Sn] \leq 4, \text{ and}$$

$$1.4 \leq [Ni]/[Sn] \leq 90,$$

conductivity is 13% IACS or more and 25% IACS or less, and in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2\times(\gamma)+(\beta) \leq 0.7$, and the γ phase having an area ratio of 0% to 0.3% and the β phase having an area ratio of 0% to 0.5% are dispersed in the α phase matrix.

According to a second aspect of the present invention, there is provided a copper alloy including: 18 mass % to 33 mass % of Zn; 0.2 mass % to 1.5 mass % of Sn; 1.5 mass % to 4 mass % of Ni; and a balance consisting of Cu and unavoidable impurities, in which a Zn content [Zn] (mass %), a Sn content [Sn] (mass %), and a Ni content [Ni] (mass %) satisfy relationships of $$15 \leq f1=[Zn]+5\times[Sn]-2\times[Ni] \leq 30,$$

$$12 \leq f2=[Zn]-0.3\times[Sn]-2\times[Ni] \leq 28, \text{ and}$$

$$10 \leq f3=\{f1\times(32-f1)\times[Ni]\}^{1/2} \leq 30,$$

the Sn content [Sn] (mass %) and the Ni content [Ni] (mass %) satisfy relationships of $$1.4 \leq 0.7\times[Ni]+[Sn] \leq 3.6, \text{ and}$$

$$1.6 \leq [Ni]/[Sn] \leq 12,$$

conductivity is 14% IACS or more and 25% IACS or less, and a metallographic structure is composed of an α single phase.

According to a third aspect of the present invention, there is provided a copper alloy including: 17 mass % to 34 mass % of Zn; 0.02 mass % to 2.0 mass % of Sn; 1.5 mass % to 5 mass % of Ni; at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb; and a balance consisting of Cu and unavoidable impurities, in which a Zn content [Zn] (mass %), a Sn content [Sn] (mass %), and a Ni content [Ni] (mass %) satisfy relationships of $$12 \leq f1=[Zn]+5\times[Sn]-2\times[Ni] \leq 30,$$

$$10 \leq f2=[Zn]-0.3\times[Sn]-2\times[Ni] \leq 28, \text{ and}$$

$$10 \leq f3=\{f1\times(32-f1)\times[Ni]\}^{1/2} \leq 33,$$

the Sn content [Sn] (mass %) and the Ni content [Ni] (mass %) satisfy relationships of $$1.2 \leq 0.7\times[Ni]+[Sn] \leq 4, \text{ and}$$

$$1.4 \leq [Ni]/[Sn] \leq 90,$$

conductivity is 13% IACS or more and 25% IACS or less, and in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2\times(\gamma)+(\beta) \leq 0.7$, and the γ phase having an area ratio of 0% to 0.3% and the β phase having an area ratio of 0% to 0.5% are dispersed in the α phase matrix.

According to a fourth aspect of the present invention, there is provided a copper alloy including: 18 mass % to 33 mass % of Zn; 0.2 mass % to 1.5 mass % of Sn; 1.5 mass % to 4 mass % of Ni; 0.003 mass % to 0.08 mass % of P; and a balance consisting of Cu and unavoidable impurities, in which a Zn content [Zn] (mass %), a Sn content [Sn] (mass %), and a Ni content [Ni] (mass %) satisfy relationships of $$15 \leq f1=[Zn]+5\times[Sn]-2\times[Ni] \leq 30,$$

$$12 \leq f2=[Zn]-0.3\times[Sn]-2\times[Ni] \leq 28, \text{ and}$$

$$10 \leq f3=\{f1\times(32-f1)\times[Ni]\}^{1/2} \leq 30,$$

the Sn content [Sn] (mass %) and the Ni content [Ni] (mass %) satisfy relationships of $$1.4 \leq 0.7\times[Ni]+[Sn] \leq 3.6, \text{ and}$$

$$1.6 \leq [Ni]/[Sn] \leq 12,$$

the Ni content [Ni] (mass %) and the P content [P] (mass %) satisfy a relationship of $$25 \leq [Ni]/[P] \leq 750,$$

conductivity is 14% IACS or more and 25% IACS or less, and a metallographic structure is composed of an α single phase.

According to a fifth aspect of the present invention, there is provided a copper alloy including: 17 mass % to 34 mass % of Zn; 0.02 mass % to 2.0 mass % of Sn; 1.5 mass % to 5 mass % of Ni; 0.0005 mass % or more and 0.2 mass % or less in total of at least one or more selected from Fe, Co, Mg, Mn, Ti, Zr, Cr, Si and rare earth metal elements, each contained in an amount of 0.0005 mass % or more and 0.05 mass % or less; and a balance consisting of Cu and unavoidable impurities, in which a Zn content [Zn] (mass %), a Sn content [Sn] (mass %), and a Ni content [Ni] (mass %) satisfy relationships of $$12 \leq f1 = [Zn] + 5 \times [Sn] - 2 \times [Ni] \leq 30,$$

$$10 \leq f2 = [Zn] - 0.3 \times [Sn] - 2 \times [Ni] \leq 28, \text{ and}$$

$$10 \leq f3 = \{f1 \times (32 - f1) \times [Ni]\}^{1/2} \leq 33,$$

the Sn content [Sn] (mass %) and the Ni content [Ni] (mass %) satisfy relationships of $$1.2 \leq 0.7 \times [Ni] + [Sn] \leq 4, \text{ and}$$

$$1.4 \leq [Ni]/[Sn] \leq 90,$$

conductivity is 13% IACS or more and 25% IACS or less, and in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2 \times (\gamma) + (\beta) \leq 0.7$, and the γ phase having an area ratio of 0% to 0.3% and the β phase having an area ratio of 0% to 0.5% are dispersed in the α phase matrix.

According to a sixth aspect of the present invention, there is provided a copper alloy including: 17 mass % to 34 mass % of Zn; 0.02 mass % to 2.0 mass % of Sn; 1.5 mass % to 5 mass % of Ni; at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb; 0.0005 mass % or more and 0.2 mass % or less in total of at least one or more selected from Fe, Co, Mg, Mn, Ti, Zr, Cr, Si and rare earth metal elements, each contained in an amount of 0.0005 mass % or more and 0.05 mass % or less; and a balance consisting of Cu and unavoidable impurities, in which a Zn content [Zn] (mass %), a Sn content [Sn] (mass %), and a Ni content [Ni] (mass %) satisfy relationships of $$12 \leq f1 = [Zn] + 5 \times [Sn] - 2 \times [Ni] \leq 30,$$

$$10 \leq f2 = [Zn] - 0.3 \times [Sn] - 2 \times [Ni] \leq 28, \text{ and}$$

$$10 \leq f3 = \{f1 \times (32 - f1) \times [Ni]\}^{1/2} \leq 33,$$

the Sn content [Sn] (mass %) and the Ni content [Ni] (mass %) satisfy relationships of $$1.2 \leq 0.7 \times [Ni] + [Sn] \leq 4, \text{ and}$$

$$1.4 \leq [Ni]/[Sn] \leq 90,$$

conductivity is 13% IACS or more and 25% IACS or less, and in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2 \times (\gamma) + (\beta) \leq 0.7$, and the γ phase having an area ratio of 0% to 0.3% and the β phase having an area ratio of 0% to 0.5% are dispersed in the α phase matrix.

According to a seventh aspect of the present invention, there is provided a copper alloy including: 18 mass % to 33 mass % of Zn; 0.2 mass % to 1.5 mass % of Sn; 1.5 mass % to 4 mass % of Ni; 0.003 mass % to 0.08 mass % of P; 0.0005 mass % or more and 0.2 mass % or less in total of at least one or more selected from Fe, Co, Mg, Mn, Ti, Zr, Cr, Si and rare earth elements, each contained in an amount of 0.0005 mass % or more and 0.05 mass % or less; and a balance consisting of Cu and unavoidable impurities, in which a Zn content [Zn] (mass %), a Sn content [Sn] (mass %), and a Ni content [Ni] (mass %) satisfy relationships of $$15 \leq f1 = [Zn] + 5 \times [Sn] - 2 \times [Ni] \leq 30,$$

$$12 \leq f2 = [Zn] - 0.3 \times [Sn] - 2 \times [Ni] \leq 28, \text{ and}$$

$$10 \leq f3 = \{f1 \times (32 - f1) \times [Ni]\}^{1/2} \leq 30,$$

the Sn content [Sn] (mass %) and the Ni content [Ni] (mass %) satisfy relationships of $$1.4 \leq 0.7 \times [Ni] + [Sn] \leq 3.6, \text{ and}$$

$$1.6 \leq [Ni]/[Sn] \leq 12,$$

the Ni content [Ni] (mass %) and the P content [P] (mass %) satisfy a relationship of $$25 \leq [Ni]/[P] \leq 750,$$

conductivity is 14% IACS or more and 25% IACS or less, and a metallographic structure is composed of an α single phase.

According to an eighth aspect of the present invention, there is provided the copper alloy according to any one of the first to seventh aspects which is applicable to medical appliances, handrails, door handles, water supply and drain sanitary facilities, apparatuses and containers, and drainage tanks.

According to a ninth aspect of the present invention, there is provided the copper alloy according to any one of the first to seventh aspects which is used for electronic and electrical components and automobile components such as connectors, terminals, relays, and switches. It is particularly preferable that the copper alloys according to the second, fourth and seventh aspects are applicable to electronic and electrical components such as connectors, terminals, relays, and switches, and automobile components.

According to a tenth aspect of the present invention, there is provided a copper alloy sheet including the copper alloy according to any one of the first to ninth aspects, in which the copper alloy sheet is produced by a production process sequentially including a hot rolling process, a cold rolling process, a recrystallization heat treatment process, and a finish cold rolling process, a cold working rate in the cold rolling process is 40% or more, the recrystallization heat treatment process includes a heating step of heating the cold-rolled copper alloy material to a predetermined temperature using a continuous heat treatment furnace, a holding step of holding the copper alloy material at a predetermined temperature for a predetermined period of time after the heating step, and a cooling step of cooling the copper alloy material to a predetermined temperature after the holding step, and in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq T\max \leq 790,$$

$$0.04 \leq tm \leq 1.0, \text{ and}$$

$$500 \leq It1 = (T\max - 30 \times tm^{-1/2}) \leq 680.$$

Depending on the sheet thickness of the copper alloy sheet, a pair of a cold rolling process and an annealing process including batch annealing may be carried out one time or plural times between the hot rolling process and the cold rolling process.

According to an eleventh aspect of the present invention, there is provided the copper alloy sheet according to the tenth aspect in which the production process includes a recovery heat treatment process which is carried out after the finish cold rolling process, the recovery heat treatment process includes a heating step of heating the finish cold-rolled copper alloy material to a predetermined temperature, a holding step of holding the copper alloy material at a predetermined temperature for a predetermined period of time after the heating step, and a cooling step of cooling the copper alloy material to a predetermined temperature after the holding step, and when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq \mathrm{Tmax2} \leq 580,$$

$$0.02 \leq \mathrm{tm2} \leq 100, \text{ and}$$

$$120 \leq It2 = (T\mathrm{max2} - 25 \times tm2^{-1/2}) \leq 390.$$

According to a twelfth aspect of the present invention, there is provided a method of producing a copper alloy sheet which is composed of the copper alloy according to any one of the first to ninth aspects including: a casting process; a pair of a cold rolling process and an annealing process; a cold rolling process; a recrystallization heat treatment process; a finish cold rolling process; and a recovery heat treatment process, in which a process of hot-rolling a copper alloy or a rolled material is not included, either or both of a combination of the cold rolling process and the recrystallization heat treatment process and a combination of the finish cold rolling process and the recovery heat treatment process are carried out, a cold working rate in the cold rolling process is 40% or more, the recrystallization heat treatment process includes a heating step of heating the cold-rolled copper alloy material to a predetermined temperature using a continuous heat treatment furnace, a holding step of holding the copper alloy material at a predetermined temperature for a predetermined period of time after the heating step, and a cooling step of cooling the copper alloy material to a predetermined temperature after the holding step, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq \mathrm{Tmax} \leq 790,$$

$$0.04 \leq \mathrm{tm} \leq 1.0, \text{ and}$$

$$500 \leq It1 = (T\mathrm{max} - 30 \times tm^{-1/2}) \leq 680,$$

the recovery heat treatment process includes a heating step of heating the finish cold-rolled copper alloy material to a predetermined temperature, a holding step of holding the copper alloy material at a predetermined temperature for a predetermined period of time after the heating step, and a cooling step of cooling the copper alloy material to a predetermined temperature after the holding step, and when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq \mathrm{Tmax2} \leq 580,$$

$$0.02 \leq \mathrm{tm2} \leq 100, \text{ and}$$

$$120 It2 = (T\mathrm{max2} - 25 \times tm2^{-1/2}) \leq 390.$$

Advantage of the Invention

According to the present invention, it is possible to provide a copper alloy which has excellent cost performance, a small density, conductivity higher than the conductivity of phosphor bronze and nickel silver, high strength, balance between strength and elongation and bending workability, excellent stress relaxation characteristics, stress corrosion cracking resistance, color fastness, and antimicrobial properties, and is adaptable to various use environments.

BEST MODE FOR CARRYING OUT THE INVENTION

Hereinafter, copper alloys according to embodiments of the present invention will be described. The copper alloys according to the embodiments are used for terminals and connectors for automobiles, electronic and electric apparatuses. Further, the copper alloy is applicable to medical appliances, public use such as handrails, door handles, and water supply and drain sanitary facilities, apparatuses and containers, public-based use, and construction-related use, and is used as a member including a joint portion of a seam welded pipe, a welded pipe, or the like.

Here, in the specification, a chemical symbol in parenthesis, such as [Zn], is considered to indicate the content (mass %) of the corresponding element.

In the embodiment, plural composition relational expressions will be defined by using the above method of indicating the content as shown below. Further, since the contents of the respective unavoidable impurities of effective additive elements such as Co and Fe, and unavoidable impurities have little influence on the characteristics of a copper alloy sheet, these contents are also not considered in respective calculation expressions, which will be described later. For example, less than 0.005 mass % of Cr is considered as an unavoidable impurity.

Composition relational expression $f1 = [\mathrm{Zn}] + 5 \times [\mathrm{Sn}] - 2 \times [\mathrm{Ni}]$ Composition relational expression $f2 = [\mathrm{Zn}] - 0.3 \times [\mathrm{Sn}] - 2 \times [\mathrm{ni}]$ Composition relational expression $f3 = \{f1 \times (32 - f1) \times [\mathrm{Ni}]\}^{1/2}$ Composition relational expression $f4 = 0.7 \times [\mathrm{Ni}] + [\mathrm{Sn}]$ Composition relational expression $f5 = [\mathrm{Ni}]/[\mathrm{Sn}]$ Composition relational expression $f6 = [\mathrm{Ni}]/[\mathrm{P}]$ A copper alloy according to a first embodiment of the present invention includes 17 mass % to 34 mass % of Zn, 0.02 mass % to 2.0 mass % of Sn, 1.5 mass % to 5 mass % of Ni, and a balance consisting of Cu and unavoidable impurities, a composition relational expression f1 is within a range of 12≤f1≤30, a composition relational expression f2 is within a range of 10≤f2≤28, a composition relational expression f3 is within a range of 10≤f3≤33, a composition relational expression f4 is within a range of 1.2≤f4≤4, and a composition relational expression f5 is within a range of 1.4≤f5≤90.

A copper alloy according to a second embodiment of the present invention includes 18 mass % to 33 mass % of Zn, 0.2 mass % to 1.5 mass % of Sn, 1.5 mass % to 4 mass % of Ni, and a balance consisting of Cu and unavoidable impurities, a composition relational expression f1 is within a range of 15≤f1≤30, a composition relational expression f2 is within a range of 12≤f2≤28, a composition relational expression f3 is within a range of 10≤f3≤30, a composition relational expression f4 is within a range of 1.4≤f4≤3.6, and a composition relational expression f5 is within a range of 1.6≤f5≤12.

A copper alloy according to a third embodiment of the present invention includes 17 mass % to 34 mass % of Zn, 0.02 mass % to 2.0 mass % of Sn, 1.5 mass % to 5 mass % of Ni, at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb, and a balance consisting of Cu and unavoidable impurities, a composition relational expression f1 is within a range of 12≤f1≤30, a composition relational expression f2 is within a range of 10≤f2≤28, a composition relational expression f3 is within a range of 10≤f3≤33, a composition relational expression f4 is within a range of 1.2≤f4≤4, and a composition relational expression f5 is within a range of 1.4≤f5≤90.

A copper alloy according to a fourth embodiment of the present invention includes 18 mass % to 33 mass % of Zn, 0.2 mass % to 1.5 mass % of Sn, 1.5 mass % to 4 mass % of Ni, 0.003 mass % to 0.08 mass % of P, a balance consisting of Cu and unavoidable impurities, a composition relational expression f1 is within a range of 15≤f1≤30, a composition relational expression f2 is within a range of 12≤f2≤28, a composition relational expression f3 is within a range of 10≤f3≤30, a composition relational expression f4 is within a range of 1.4≤f4≤3.6, a composition relational expression f5 is within a range of 1.6≤f5≤12, and a composition relational expression f6 is within a range of 25≤f6≤750.

A copper alloy according to a fifth embodiment of the present invention includes 17 mass % to 34 mass % of Zn, 0.02 mass % to 2.0 mass % of Sn, 1.5 mass % to 5 mass % of Ni, 0.0005 mass % or more and 0.2 mass % or less in total of at least one or more selected from Fe, Co, Mg, Mn, Ti, Zr, Cr, Si and rare earth elements, each contained in an amount of 0.0005 mass % or more and 0.05 mass % or less, and a balance consisting of Cu and unavoidable impurities, a composition relational expression f1 is within a range of 12≤f1≤30, a composition relational expression f2 is within a range of 10≤f2≤28, a composition relational expression f3 is within a range of 10≤f3≤33, a composition relational expression f4 is within a range of 1.2≤f4≤4, and a composition relational expression f5 is within a range of 1.4≤f5≤90.

A copper alloy according to a sixth embodiment of the present invention includes 17 mass % to 34 mass % of Zn, 0.02 mass % to 2.0 mass % of Sn, 1.5 mass % to 5 mass % of Ni, at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb, 0.0005 mass % or more and 0.2 mass % or less in total of at least one or more selected from Fe, Co, Mg, Mn, Ti, Zr, Cr, Si and rare earth elements, each contained in an amount of 0.0005 mass % or more and 0.05 mass % or less, and a balance consisting of Cu and unavoidable impurities, a composition relational expression f1 is within a range of 12≤f1≤30, a composition relational expression f2 is within a range of 10≤f2≤28, a composition relational expression f3 is within a range of 10≤f3≤33, a composition relational expression f4 is within a range of 1.2≤f4≤4, and a composition relational expression f5 is within a range of 1.4≤f5≤90.

A copper alloy according to a seventh embodiment of the present invention includes 18 mass % to 33 mass % of Zn, 0.2 mass % to 1.5 mass % of Sn, 1.5 mass % to 4 mass % of Ni, 0.003 mass % to 0.08 mass % of P, 0.0005 mass % or more and 0.2 mass % or less in total of at least one or more selected from Fe, Co, Mg, Mn, Ti, Zr, Cr, Si and rare earth elements, each contained in an amount of 0.0005 mass % or more and 0.05 mass % or less, and a balance consisting of Cu and unavoidable impurities, a composition relational expression f1 is within a range of 15≤f1≤30, a composition relational expression f2 is within a range of 12≤f2≤28, a composition relational expression f3 is within a range of 10≤f3≤30, a composition relational expression f4 is within a range of 1.4≤f4≤3.6, a composition relational expression f5 is within a range of 1.6≤f5≤12, and a composition relational expression f6 is within a range of 25≤f6≤750.

The copper alloys according to the above-described first, third, fifth and sixth embodiments of the present invention have a metallographic structure in which the ratio of an α phase in the constituent phase of the metallographic structure is 99.5% or more by area ratio or an area ratio of a γ phase (γ) % and an area ratio of a β phase (β) % in an α phase matrix satisfy a relationship of $0 \leq 2\times(\gamma)+(\beta) \leq 0.7$, and the γ phase having an area ratio of 0% to 0.3% and the β phase having an area ratio of 0% to 0.5% are dispersed in the α phase matrix.

In addition, the copper alloys according to the second, fourth and seventh embodiments of the present invention have a metallographic structure composed of an α single phase.

In the copper alloys according to the above-described first, third, fifth and sixth embodiments of the present invention, the conductivity is set to be within a range of 13% IACS or more and 25% IACS or less and in copper alloys according to the second, fourth and seventh embodiments of the present invention, the conductivity is set to be within a range of 14% IACS or more and 25% IACS or less.

Hereinafter, the reasons why the component composition, the composition relational expressions f1, f2, f3, f4, f5 and f6, the metallographic structure, and the conductivity are defined as described above will be described.

(Zn)

Zn is a main element of the alloy together with Cu and to solve the problems of the present invention, at least 17 mass % or more of Zn is required. Zn is inexpensive compared to Cu, Ni and Sn. In order to further reduce costs, the density of the alloy of the present invention is decreased by about 3% or more compared to pure copper and the density of the alloy of the present invention is decreased by about 2% or more compared to representative phosphor bronze or nickel silver. In addition, in order to improve strength such as tensile strength, proof stress, yield stress, spring properties, and fatigue strength, improve color fastness at a high temperature and high humidity, and obtain fine grains, it is required that the Zn content be 17 mass % or more. In order to make these effects more significant, the Zn content is preferably 18 mass % or more or 20 mass % or more, and more preferably 23 mass % or more. When the copper alloy contains a high concentration of Zn, the cost of the raw material is reduced and the density is lowered. Thus, a copper alloy having further excellent cost performance is obtained.

On the other hand, in the case in which the Zn content is more than 34 mass %, even when Ni and Sn are contained in the copper alloy within the composition range of the specification, which will be described later, first, it is difficult to obtain satisfactory stress relaxation characteristics and stress corrosion cracking resistance due to deterioration in ductility and bending workability, conductivity deteriorates and the effect of improving strength is also saturated. The Zn content is more preferably 33 mass % or less and still more preferably 30 mass % or less.

In the related art, it is hard to find a copper alloy containing 17 mass % or more, 18 mass % or more, or 23 mass % or more of Zn and having excellent stress relaxation characteristics and color fastness, and satisfactory strength, stress corrosion cracking resistance, and conductivity.

(Ni)

The alloy of the present invention contains Ni to improve color fastness, antimicrobial properties at a high temperature and high humidity, stress corrosion cracking resistance, stress relaxation characteristics, heat resistance, and ductility and bending workability, balance among strength, ductility and bending workability. Particularly, when the Zn content is as high as 18 mass % or more, 20 mass % or more, or 23 mass % or more, the above-described characteristics more effectively work. In order to exhibit these effects, it is required that the copper alloy contain 1.5 mass % or more of Ni, preferably contain 1.6 mass % or more of Ni, and satisfy the composition relational expressions of f1 to f6. On the other hand, when the content of Ni is more than 5 mass %, an increase in costs is incurred and the color of the alloy changes from brass yellow to a pale color. The stress relaxation characteristics begin to be saturated and antimicrobial properties are saturated. Also, conductivity is lowered. Thus, the Ni content is set to 5 mass % or less and preferably 4 mass % or less. Particularly, in applications such as terminals, connectors and the like, from the viewpoint of conductivity, the Ni content is more preferably 3 mass % or less.

(Sn)

Sn is co-added to the alloy with Ni to improve the strength of the alloy of the present invention so as to improve color fastness, stress corrosion cracking resistance, stress relaxation characteristics, balance between strength and ductility and bending workability. Then, the grains are refined at the time of recrystallization. In order to exhibit these effects, it is required that the Sn content be at least 0.02 mass % or more and particularly in order to improve color fastness and stress relaxation characteristics, it is required that the Sn content be 0.2 mass % or more and it is also required for the copper alloy to satisfy the composition relational expressions of f1 to f5. In order to make these effects more significant, the Sn content is preferably 0.25 mass % or more and more preferably 0.3 mass % or more. On the other hand, even when the Sn content is 2 mass % or more, the effect of stress corrosion cracking resistance and stress relaxation characteristics is not saturated and rather is deteriorated, which causes an increase in costs and a decrease in conductivity. Hot workability, and cold ductility and bending workability are deteriorated. When the concentration of Zn is 23 mass % or more and particularly, is as high as 26 mass % or more, the β phase and the γ phase are likely to remain substantially. The Sn content is preferably 1.5 mass % or less, more preferably 1.2 mass % or less, and still more preferably 1.0 mass % or less.

(P)

P combines with Ni to particularly improve stress relaxation characteristics and further lower the sensitivity for stress corrosion cracking and is effective for improving color fastness. P can reduce the size of the grains. The copper alloys according to the fourth and seventh embodiments contain P.

Here, in order to exhibit the above-described effect, a P content of 0.003 mass % or more is required. On the other hand, even when the P content is more than 0.09 mass %, the above-described effect is saturated and a large amount of precipitates mainly composed of P and Ni are formed and the particle size of the precipitates is also increased. Thus, bending workability is lowered. The P content is preferably 0.08 mass % or less and more preferably 0.06 mass % or less. The ratio between Ni and P which will be described later (composition relational expression f6) is important.

(At Least One or More Selected from P, Al, Sb, As, and Pb)

P, Al, Sb, As, and Pb improve the color fastness, stress corrosion cracking resistance, and punchability of the alloy. The copper alloys according to the third and sixth embodiments contain these elements.

In order to exhibit the above-described effect, P: 0.003 mass % or more, Al: 0.005 mass % or more, Sb: 0.01 mass % or more, As: 0.01 mass % or more, and Pb: 0.0005 mass % or more are preferable. On the other hand, even when the contents of P, Al, Sb, As, and Pb respectively exceeds P: 0.09 mass %, Al: 0.5 mass %, Sb: 0.09 mass %, As: 0.09 mass %, and Pb: 0.03 mass %, the effect is saturated and bending workability is deteriorated.

(At Least One or More Selected from Fe, Co, Mg, Mn, Ti, Zr, Cr, Si and Rare Earth Elements)

Elements of Fe, Co, Mg, Mn, Ti, Zr, Cr, Si and rare earth elements have the effect of improving various characteristics. Particularly, Fe, Co, Mg, Mn, Ti, and Zr form compounds with P or Ni and the growth of recrystallized grains is suppressed at the time of annealing. Thus, the effect of grain refinement is significant. The copper alloys according to the fifth and sixth embodiments contain these elements.

In order to exhibit the above-described effects, it is required that any element of Fe, Co, Mg, Mn, Ti, Zr, Cr, Si and rare earth elements be each contained in an amount of 0.0005 mass % or more. On the other hand, when the content of the element is also more than 0.05 mass %, the effects are not saturated and bending workability is impaired. The content of the element is preferably 0.03 mass % or less. Further, when the total content of these elements is more than 0.2 mass %, the effects are not saturated and bending workability is impaired. The total content of these elements is preferably 0.15 mass % or less and more preferably 0.1 mass % or less.

In addition, when an alloy contains P, Fe and Co, the effect of grain refinement is a particularly significant. Even when the amount of Fe or Co is very small, Fe or Co easily forms a compound with P. As a result, a compound of Ni and P containing Fe or Co is formed and the particle size of the compound is refined. In the refined compound, the size of the recrystallized grains at the time of annealing is made finer to improve strength. However, when the effect is excessive, bending workability and stress relaxation characteristics are impaired. Most suitably, the content of Fe or Co is 0.001 mass % or more and 0.03 mass % or less or 0.02 mass % or less.

(Unavoidable Impurities)

In the copper alloy, elements such as oxygen, hydrogen, water vapor, carbon, and sulfur are unavoidably included in a raw material including a returned material and the production process mainly including melting in the atmosphere, although the amounts thereof are very small. Thus, the alloy naturally includes these unavoidable impurities.

Here, in the copper alloy according to the embodiment, elements other than the defined constituent elements may be considered as unavoidable impurities. The content of the unavoidable impurities is preferably 0.1 mass % or less. In addition, elements other than Zn, Ni and Sn among the defined elements in the copper alloy according to the embodiment may be contained in the copper alloy within a range of less than the lower limit defined as the amount of impurities in the above.

(Composition Relational Expression f1)

The composition relational expression f1=[Zn]+5×[Sn]−2×[Ni]=30 shows a boundary value for determining whether the metallographic structure of the alloy of the present invention is substantially composed of only an α phase. Further, in production of a seam welded pipe, a welded pipe, or the like, or at brazing, even when the base metal is locally melted or heated to a high temperature, the composition relational expression shows a boundary value for obtaining a metallographic structure in which at three sites of a joint portion or a melt zone, a heat affected zone, and the base metal, the average ratio of an α phase in the constituent phase is 99.5% or more by area ratio, or the area ratio of a γ phase (γ) % and the area ratio of a β phase (β) % in an α phase matrix satisfy a relationship of $0 \leq 2\times(\gamma)+(\beta) \leq 0.7$ and the γ phase having an area ratio of 0% to 0.3% and the β phase having an area ratio of 0% to 0.5% are dispersed in the α phase matrix.

The upper limit of the composition relational expression f1 is also a boundary value for obtaining satisfactory stress relaxation characteristics, color fastness, antimicrobial properties, ductility, bending workability and stress corrosion cracking resistance. When the content of the main element Zn is 34 mass % or less or 33 mass % or less, the relational expression has to be satisfied. For example, when Sn which is a low melting metal is contained in the Cu—Zn alloy in an amount of 0.2 mass % or 0.3 mass % or more, Sn is precipitated at a final solidified portion and at a grain boundary at the time of casting. As a result, the concentration of Sn is increased and γ and β phases are formed. When the value of the above expression is more than 30, it is difficult to make the γ phase and the β phase present in a non-equilibrium state disappear through casting, hot working, annealing and a heat treatment. In the same manner, when a seam welded pipe, a welded pipe, or the like is produced, the material is locally melted or heated to a high temperature in joining by brazing and the like and thus Sn and the like are precipitated again.

In the composition relational expression f1, within the composition range of the present invention, as the coefficient of Sn, "+5" is given. This coefficient "5" is larger than the coefficient of Zn which is a main element of "1". On the other hand, within the composition range of the present invention, Ni has properties of reducing Sn precipitation and suppressing the formation of the γ and β phases and has a coefficient of "−2". When the value of the composition relational expression f1=[Zn]+5×[Sn]−2×[Ni] is 30 or less, the γ phase and the β phase are not present or the amounts thereof are very small even in the machining state of a product such as a seam welded pipe or the like. Thus, ductility and bending workability are satisfactory and stress relaxation characteristics and color fastness are improved. Accordingly, bending workability of sites including the joint portion is improved. The value of the composition relational expression f1=[Zn]+5×[Sn]−2×[Ni] is more preferably 29.5 or less, and still more preferably 29 or less. On the other hand, when the value of the composition relational expression f1=[Zn]+5×[Sn]−2×[Ni] is less than 12, strength is lowered and color fastness is also deteriorated. Thus, the value is 12 or more, preferably 15 or more, and more preferably 20 or more. The fact that the value of the composition relational expression f1 is large refers to a copper alloy in a state immediately before β and γ phases are precipitated.

(Composition Relational Expression f2)

The composition relational expression f2=[Zn]−0.3×[Sn]−2×[Ni]=28 shows a boundary value for obtaining satisfactory stress corrosion cracking resistance, ductility and bending workability. As described above, a fatal defect of the Cu—Zn alloy is high sensitivity for stress corrosion cracking. In the case of the Cu—Zn alloy, sensitivity for stress corrosion cracking is dependent on the Zn content. When the Zn content is more than 25 mass % or 26 mass %, the sensitivity for stress corrosion cracking is particularly increased. The composition relational expression f2=[Zn]−0.3×[Sn]−2×[Ni]=28 corresponds to a Zn content of the Cu—Zn alloy of 25 mass % or 26 mass %. Within the composition range of the specification in which Ni and Sn are co-added, as shown in the above expression, the coefficient of Ni is "−2" and incorporation of Ni makes it possible to particularly lower the sensitivity for stress corrosion cracking resistance. The value of the composition relational expression f2=[Zn]−0.3×[Sn]−2×[Ni] is preferably 27 or less and more preferably 26 or less. In the case of requiring high reliability in a severe stress corrosion cracking environment, the value is or less. On the other hand, when the value of the composition relational expression f2 is less than 10, strength is lowered. Thus, the value is 10 or more, preferably 12 or more, and more preferably 15 or more.

(Composition Relational Expression f3)

In the composition relational expression $f3=\{f1\times(32-f1)\times[Ni]\}^{1/2}$, when the value of f1 is 30 or less, and the value of the composition relational expression f3 is 10 or more by co-addition of Ni and Sn, irrespective of containing a high concentration of Zn, excellent stress relaxation characteristics are exhibited. The value of the composition relational expression f3 is preferably 12 or more and more preferably 14 or more. Particularly, when the value of the composition relational expression f1 is in a range of up to 20, stress relaxation characteristics are significantly improved. On the other hand, even when the value of the composition relational expression f3 is more than 33, the effect is saturated and there is an influence on cost performance and conductivity. The value of the composition relational expression f3 is preferably 30 or less, more preferably 28 or less, or 25 or less. When the conditions of these preferable ranges, $1.4 \leq f4=0.7\times[Ni]+[Sn] \leq 3.6$, $1.6 \leq f5=[Ni]/[Sn] \leq 12$, incorporation of P, and $25 \leq f6=[Ni]/[P] \leq 750$, which will be described later, are satisfied, further excellent stress relaxation characteristics are exhibited in terminals and connectors which are used in a severe high temperature environment.

(Composition Relational Expression f4)

Within the composition range of the specification, in order to improve the color fastness of the alloy, satisfy both color fastness and antimicrobial properties, and improve stress relaxation characteristics, it is required that the value of the composition relational expression f4=0.7×[Ni]+[Sn] be 1.2 or more. The value of the composition relational expression f4=0.7×[Ni]+[Sn] is preferably 1.4 or more, more preferably 1.6 or more, and to particularly improve color fastness, 1.8 or more is still more preferable. On the other hand, when the value of the composition relational expression f4 is more than 4, the costs of the alloy increase and conductivity is also deteriorated. While the color fastness is improved, there is a concern of lowering of antimicrobial properties. Thus, the value is preferably 4 or less, more preferably 3.6 or less, and still more preferably 3 or less. That is, the range of the composition relational expression f4 for obtaining particularly excellent color fastness, stress relaxation characteristics and conductivity is 1.4≤f4=0.7×[Ni]+[Sn]≤3.6.

(Composition Relational Expression f5)

In the stress relaxation characteristics of the Cu—Zn alloy in which Ni and Sn within the composition range of the specification are co-added and Zn is contained in a high concentration, the composition relational expression f5=[Ni]/[Sn] is important. When the alloy contains 1.5 mass % or more of Ni and at least two divalent Ni atoms or more are present with respect to one tetravalent Sn atom which is present in the matrix, that is, when the value of the mass ratio of [Ni]/[Sn] is 1 or more, stress relaxation characteristics begin to be improved. Particularly, it has been found that when three divalent Ni atoms or more are already present with respect to one Sn atom, that is, the value of the mass ratio of [Ni]/[Sn] is 1.5 or more, stress relaxation characteristics are further improved and color fastness is also improved. The effect of stress relaxation characteristics becomes significant in the alloy of the present invention that is subjected to a recovery treatment after finish rolling. Further, in the concentration ranges of Ni and Sn defined in the specification, when the value of [Ni]/[Sn] is less than about 1.4, bending workability is impaired and stress corrosion cracking resistance is also deteriorated. Accordingly, in the present invention, the value of [Ni]/[Sn] is 1.4 or more, preferably 1.6 or more, and most preferably 1.8 or more. On the other hand, when the upper limit of the composition relational expression f5=[Ni]/[Sn] is 90 or less, satisfactory stress relaxation characteristics and color fastness are exhibited. The upper limit is preferably 30 or less, more preferably 12 or less, and most preferably 10 or less. When 1.6≤f5=[Ni]/[Sn]≤12, in terminals and connectors used in a severe high temperature environment such as an engine room of an automobile or the like, particularly excellent stress relaxation characteristics can be exhibited.

(Composition Relational Expression f6)

Further, stress relaxation characteristics are affected by Ni in a solid solution state, P, and in a compound of Ni and P. When the value of the composition relational expression f6=[Ni]/[P] is less than 25, the ratio of a compound of Ni and P to Ni in a solid solution state is increased. Thus, stress relaxation characteristics are deteriorated and bending workability is also deteriorated. That is, when the value of the composition relational expression f6=[Ni]/[P] is 25 or more and preferably 30 or more, stress relaxation characteristics and bending workability are improved. On the other hand, when the value of the composition relational expression f6=[Ni]/[P] is more than 750, the amount of the compound formed with Ni and P and the amount of P solid-soluted are reduced. Thus, stress relaxation characteristics are deteriorated. In addition, the compound of P and Ni has an action of refining the grains. However, the action is reduced and the strength of the alloy is lowered. The value of the composition relational expression f6=[Ni]/[P] is preferably 500 or less and more preferably 300 or less.

(Metallographic Structure)

When the β phase and the γ phase are present, ductility and bending workability are impaired. Particularly, stress relaxation characteristics and color fastness, particularly, antimicrobial properties and stress corrosion cracking resistance in a severe environment are deteriorated. Thus, a metallographic structure composed of an α single phase is most preferable and at least, the ratio of the α phase is 99.5% or more and more preferably 99.8% or more by area ratio. However, a metallographic structure in which at three sites of a joint portion, a heat affected zone, and a base metal in a seam welded pipe or a welded pipe, the average ratio of an α phase in the constituent phase of the metallographic structure is 99.5% or more by area ratio, or the area ratio of a γ phase (γ) % and the area ratio of a β phase (β) % of an α phase matrix satisfy a relationship of 0≤2×(γ)+(β)≤0.7 and the γ phase having an area ratio of 0% to 0.3% and the β phase having an area ratio of 0% to 0.5% are dispersed in the α phase matrix is allowable. In the present invention, when the metallographic structure is observed using a metallurgical microscope at a magnification of 300 times (a micrograph having a size of 89 mm×127 mm), a β phase and a γ phase which significantly affect the characteristics and are large enough to be apparently recognized as a β phase and a γ phase are set as targets. That is, in the present invention, the metallographic structure substantially composed of an α single phase means that when the metallographic structure is observed using a metallurgical microscope at a magnification of 300 times excluding non-metallic inclusions including oxides, and intermetallic compounds such as precipitates and crystallized products, the ratio of the α phase in the metallographic structure is 100%. Similarly, when the metallographic structure is observed using a metallurgical microscope at a magnification of 300 times, at three sites of the joint portion, the heat affected zone, and the base metal, the average ratios of the β phase and the γ phase that are apparently recognized as a β phase and a γ phase may satisfy a relationship between the area ratio of the γ phase (γ) % and the area ratio of the β phase (β) % of the α phase matrix of 0≤2×(γ)+(β)≤0.7 and a relationship that the area ratio of the γ phase is 0% to 0.3% and the area ratio of the β phase is 0% to 0.5% in the α phase matrix. Considering the effect of the copper alloy that can be obtained, a more preferable metallographic structure has a state in which the ratio of an α phase is 99.7% or more by area ratio, or the area ratio of a γ phase (γ) % and the area ratio of a β phase (β) % of an α phase matrix satisfy a relationship of 0≤2×(γ)+(β)≤0.4 and a relationship that the area ratio of the γ phase is 0% to 0.2% and the area ratio of the β phase is 0% to 0.3% in the α phase matrix. However, there is no limitation thereto.

(Average Grain Size)

In the copper alloy according to the embodiment, the grain size is not particularly defined. However, it is preferable that the average grain size is defined as follows according to the purposes.

In the copper alloy according to the embodiment, a grain having a size of at least about 1 μm can be obtained although the grain size differs depending on the process. However, when the average grain size is less than 2 μm, stress relaxation characteristics are deteriorated. Although strength is increased, ductility and bending workability are deteriorated. Therefore, the average grain size may be 2 μm or greater and preferably 3 μm or greater. On the other hand, when in applications such as terminals, connectors and the like, the average grain size is preferably 10 μm or less or 8 μm or less to obtain a higher strength. Additionally, in a seam welded pipe, a welded pipe, or the like used for handrails and door handles, from the viewpoint of formability and bending workability from a sheet material to a pipe, the average grain size may be 3 μm or greater and preferably 5 μm or greater. From the viewpoint of strength, the average grain size may be 25 μm or less and is preferably 20 μm or less.

(Precipitate)

In the copper alloy according to the embodiment, precipitates are not particularly defined. However, in the copper alloy containing Ni and P, it is preferable to define the size and number of precipitates for the following reasons.

According to the present invention, when circular or elliptical precipitates mainly containing Ni and P are present, the growth of recrystallized grains is suppressed. Thus, fine grains can be obtained and stress relaxation characteristics can be improved. In the recrystallization formed at the time of annealing, crystals to which a significant strain is applied by working are replaced as new crystals to which almost no strain is applied. However, in the recrystallization, the worked grains are not instantaneously replaced with recrystallized grains and a long period of time or a higher temperature is required. That is, a long period of time and a higher temperature are required from when the recrystallization starts to when the recrystallization ends. Until the recrystallization ends completely, the initially formed recrystallized grains grow and become large. However, the growth can be suppressed by the precipitates.

In the embodiment, when the average particle size of the precipitates is 3 nm to 180 nm, the effect is exhibited. When the average particle size of the precipitates is less than 3 nm, the growth of recrystallized grains is suppressed. However, the amount of the precipitates is increased and bending workability is hindered. On the other hand, when the average grain size of the precipitates is greater than 180 nm, the number of precipitates is decreased. Thus, the action of suppressing the growth of the precipitates is impaired and the effect for stress relaxation characteristics is reduced.

(Conductivity)

The upper limit of the conductivity is not particularly required to be greater than 25% IACS, or 24% IACS in the member that is the target of the specification. A copper alloy in which stress relaxation characteristics, stress corrosion cracking resistance, color fastness and strength, which are defects of brass of the related art, are improved is most advantageous in the specification. In addition, in door handles, which are formed with a seam welded pipe or a welded pipe, as one of the applications of the specification, or members which are subjected to brazing and spot welding considering the application, when the thermal conductivity is excessively good, that is, when the conductivity is 25% IACS or more, local heating or the like is difficult and a joining defect occurs or strength is lowered due to excessive heating. On the other hand, in applications such as terminals, connectors, and the like, stress relaxation characteristics are emphasized rather than conductivity. Thus, the conductivity of the alloy is set to be at least higher than the conductivity of phosphor bronze used for a terminal or a connector and is set to be 13% IACS or more and preferably 14% IACS or more.

(Strength)

In the embodiment, particularly, regarding applications such as connectors and terminals, on the premise that ductility and bending workability are satisfactory, in samples obtained by collecting test pieces in a direction which forms 0 degree with respect to a rolling direction and in a direction which forms 90 degrees with respect to the rolling direction, as strength at room temperature, the tensile strength is at least 500 N/mm$^2$ or more, preferably 550 N/mm$^2$ or more, more preferably 575 N/mm$^2$ or more, and still more preferably 600 N/mm$^2$ or more. The proof stress is at least 450 N/mm$^2$ or more, preferably 500 N/mm$^2$ or more, more preferably 525 N/mm$^2$ or more, and still more preferably 550 N/mm$^2$ or more. Thus, a reduction in thickness can be achieved. Further, as preferable strength at room temperature, the tensile strength is 800 N/mm$^2$ or less and the proof stress is 750 N/mm$^2$ or less.

Particularly, in applications such as terminals and connectors, it is preferable that both tensile strength showing fracture strength and proof stress showing deformation strength at the initial stage are high. That is, it is preferable that the ratio between proof stress and tensile strength is large and a difference between the strength in a direction orthogonal (perpendicular) to the rolling direction of the sheet and the strength in a direction parallel with the rolling direction of the sheet is small. Here, when the tensile strength of a test piece is collected in a direction parallel with the rolling direction is $TS_P$, the proof stress is $YS_P$, the tensile strength of a test piece collected in a direction orthogonal to the rolling direction is $TS_O$ and the proof stress is $YS_O$, the above-described relationships are expressed by the following expressions.

(1) The ratio between proof stress and tensile strength (parallel with the rolling direction and orthogonal to the rolling direction) is 0.9 or more and 1 or less, $$0.9 \leq YS_P/TS_P \leq 1.0, \text{ and}$$

$$0.9 \leq YS_O/TS_O \leq 1.0,$$

and preferably, $$0.92 \leq YS_P/TS_P \leq 1.0, \text{ and}$$

$$0.92 \leq YS_O/TS_O \leq 1.0.$$

(2) The ratio between the tensile strength of a test piece collected in a direction parallel with the rolling direction and the tensile strength of a test piece collected in a direction orthogonal to the rolling direction is 0.9 or more and 1.1 or less, $$0.9 \leq TS_P/TS_O \leq 1.1, \text{ and preferably } 0.92 \leq TS_P/TS_O \leq 1.07.$$

(3) The ratio of the proof stress of a test piece collected in a direction parallel with the rolling direction and the proof stress of a test piece collected in a direction orthogonal to the rolling direction is 0.9 or more and 1.1 or less, $$0.9 \leq YS_P/YS_O \leq 1.1, \text{ and preferably } 0.92 \leq YS_P/YS_O \leq 1.07.$$

In order to satisfy the above relationships, the final cold working rate and an average grain size are important. When the final cold working rate is less than 5%, high strength cannot be obtained and the ratio between proof stress and tensile strength is small. Preferably, the cold working rate is 10% or more. On the other hand, when the working rate is more than 50%, bending workability and ductility are deteriorated. The cold working rate is preferably 35% or less. By a recovery heat treatment which will be described later, the ratio between proof stress and tensile strength can be increased and the difference between proof stress in a direction parallel with the rolling direction and proof stress in a direction perpendicular to the rolling direction can be decreased.

When joining by local high heat or the like is carried out, for example, regarding the strength of a seam welded pipe, the tensile strength is 425 N/mm$^2$ or more and preferably 475 N/mm$^2$ or more, and the proof stress is 275 N/mm$^2$ or more and preferably 325 N/mm$^2$ or more. As long as the above-described strength is provided, in application such as handrails or the like, a reduction in thickness can be achieved.

(Stress Relaxation Characteristics)

The copper alloy is used for terminals, connectors, and relays in an environment of about 100° C. or 100° C. or higher, for example, in a cabin or in an environment close to an engine room of a car under the blazing sun. One main function that is required for terminals and connectors is having high contact pressure. At room temperature, the maximum contact pressure is the stress of the elastic limit when a tensile test is carried out on the material, or 80% of the proof stress. However, when the material is used for a long period of time in an environment of 100° C. or higher, the material is permanently deformed. Thus, the material cannot be used at the stress of elastic limit or the stress corresponding to 80% of the proof stress, and the contact pressure. A stress relaxation test is a test in which in a state in which 80% of proof stress is applied to the material, the material is held at 120° C. or 150° C. for 1,000 hours and then the degree of stress relaxation is investigated. That is, the maximum effective contact pressure when the material is used in an environment of about 100° C. or 100° C. or higher is expressed by proof stress×80%×(100%−stress relaxation rate (%)), and it is desired that not only is the proof stress at room temperature simply high but also the value of the expression is high. In the specification, in spite of a slightly low conductivity, particularly, excellent stress relaxation characteristics which a brass copper alloy of the related art does not have are emphasized. Thus, when the value of proof stress×80%×(100%−stress relaxation rate (%)) in the test at 150° C. for 1,000 hours is 275 N/mm$^2$ or more, the copper alloy can be used at a high temperature state. When the value is 300 N/mm$^2$ or more, the copper alloy is suitably used in a high temperature state, and when the value is 325 N/mm$^2$ or more, the copper alloy is most suitably used. For example, in the case of 70 mass % Cu-30 mass % Zn which is a representative alloy of brass copper having a proof stress of 500 N/mm$^2$, the value of proof stress×80%×(100%−stress relaxation rate (%)) is about 70 N/mm$^2$ at 150° C. and in the case of phosphor bronze of 92 mass % Cu-8 mass % Sn having a proof stress of 550 N/mm$^2$, the value is about 190 N/mm$^2$. With current alloys used, satisfactory values cannot be obtained.

When the strength of the material is set to the above-described target strength and a stress relaxation rate in the test under the severe conditions of 150° C. and 1,000 hours is 20% or less, the copper alloy has excellent stress relaxation characteristics at a very high level among copper alloys. When the stress relaxation rate is more than 20% and 25% or less, stress relaxation characteristics are excellent and when the stress relaxation rate is more than 25% and 35% or less, stress relaxation characteristics are satisfactory. When the stress relaxation rate is more than 35% and 50% or less, there is a problem in use and when the stress relaxation rate is more than 50%, it is difficult to substantially use the copper alloy in a severe thermal environment. On the other hand, in a test under slightly mild conditions of 120° C. and 1,000 hours, higher performance is required. When the stress relaxation rate is 10% or less, the level of stress relaxation characteristics is high. When the stress relaxation rate is more than 10% and 15% or less, stress relaxation characteristics are satisfactory and when the stress relaxation rate is more than 15% and 30% or less, there is a problem in use. When the stress relaxation rate is more than 30%, there is little superiority as a material.

Next, a method of producing copper alloys according to first to seventh embodiments of the present invention will be described.

First, an ingot having the above-described component composition is prepared and hot working is carried out on this ingot. In order to put each element into a solid solution state and further reduce precipitation of Sn, or from the viewpoint of hot ductility, a temperature at which hot rolling, which is representative hot working, starts is 760° C. or higher and 890° C. or lower. It is desirable that the hot rolling working rate is at least 50% or more to destroy the coarse cast structure of the ingot and reduce precipitation of an element such as Sn. In the case in which P is contained in the copper alloy, in order to put P and Ni into a further solid solution state, the temperature when the final rolling ends or a temperature in a range from 650° C. to 350° C. is preferably cooled at an average cooling rate of 1° C./second or more so that a precipitate of P and Ni, that is, a compound of Ni and P is not coarsened.

Then, the thickness is reduced by cold rolling and the process proceeds to recrystallization heat treatment, that is, an annealing process. Although the cold rolling reduction differs depending on the thickness of a final product it is at least 40% or more, preferably 55% or more, and more preferably 97% or less. In order to destroy the hot rolling structure, the cold rolling reduction is desirably 55% or more and before the material strain is deteriorated by strong working at room temperature, the rolling is ended. The grain size differs depending on the final target grain size but, in the annealing process, the grain size is preferably 3 μm to 40 μm. Specifically, regarding conditions of temperature and time, in the case of batch type annealing, the annealing under the conditions of heating from 450° C. to 650° C. and holding for 1 hour to 10 hours is carried out. Alternatively, an annealing method called continuous annealing that is carried out at a high temperature for a short period of time is used in many cases. However, in the case of the continuous annealing, the maximum reaching temperature of the material is 540° C. to 790° C. and preferably 560° C. to 790° C. In a high temperature state of "maximum reaching temperature-50° C.", the copper alloy is held for 0.04 minutes to 1.0 minute and preferably for 0.06 minutes to 1.0 minute. The continuous annealing method is also used in the recovery heat treatment which will be described later. The annealing process and the cold rolling process, that is, a pair of a cold rolling process and an annealing process may be omitted depending on the thickness of a final product, the strain state of the rolled material, or the like.

Next, cold rolling is carried out before finishing. The cold rolling reduction differs depending on the thickness of a final product but the cold rolling reduction is desirably 40% to 96%. In the following final recrystallization heat treatment, that is, final annealing, in order to obtain finer and uniform grains, it is required that the working rate be 40% or more. The working rate is 96% or less in terms of the strain of the material and preferably 90% or less.

The final annealing is distinguished from the above-described annealing process and is a heat treatment to obtain a target grain size. In applications such as terminals, connectors and the like, the target average grain size is 2 μm to 10 μm. However, when the strength is emphasized, the average grain size is preferably 2 μm to 6 μm. When the stress relaxation characteristics are emphasized, the average grain size is preferably 3 μm to 10 μm. The annealing conditions differ depending on the rolling reduction before finishing, the thickness of the material, and the target grain size, but in the case of batch type annealing, as preferable annealing conditions, the temperature is 350° C. to 570° C. and the holding time is 1 hour to 10 hours. In high temperature short time annealing, the maximum reaching temperature is 540° C. to 790° C. and the holding time at a temperature of the maximum reaching temperature-50° C. is 0.04 minutes to 1.0 minute. When the temperature is in a range from 350° C. to 600° C. or the maximum reaching temperature is lower than 600° C., cooling is carried out in a temperature range to the maximum reaching temperature at an average cooling rate of 2° C./second or higher and preferably at an average cooling rate of 5° C./second or higher. In applications such as handrails, medical appliances, sanitary apparatuses, construction, or the like, in addition to strength, workability and material strain are important. The target average grain size is 3 μm to 25 μm. The annealing conditions differ depending on the rolling reduction before finishing, the thickness of the material, and the target grain size, but in the case of batch-type annealing, as the annealing conditions, the temperature is 400° C. to 630° C., and the holding time is 1 hour to 10 hours. In high temperature short time annealing, the maximum reaching temperature is 540° C. to 790° C. and the holding time at a temperature of the maximum reaching temperature-50° C. is 0.04 minutes to 1.0 minute. Preferably, the temperature is 560° C. to 790° C. and the holding time at a temperature of the maximum reaching temperature-50° C. is 0.06 minutes to 1.0 minute. When the temperature is in a range from 350° C. to 600° C. or the maximum reaching temperature is lower than 600° C., cooling is carried out in a temperature range to the maximum reaching temperature at an average cooling rate of 2° C./second or higher and preferably at an average cooling rate of 5° C./second or higher.

When the average grain size is greater than 5 μm or when stress relaxation characteristics is improved by incorporation of P, high temperature short time annealing is more preferable than batch-type annealing. In the case in which the copper alloy contains the amounts of Ni and Sn defined in the specification and batch-type annealing is carried out, when the grain size is set to be greater than 5 μm, a mixed grain state in which large recrystallized grains and small recrystallized grains are mixed easily occurs. Particularly, when the copper alloy contains P, as the temperature increases, the compound of Ni and P begins to be solid-soluted and the compound partially disappears. Thus, some of the recrystallized grains abnormally grow and a mixed grain state in which the recrystallized grains are mixed with fine recrystallized grains easily occurs. On the other hand, since the temperature increases in a short period of time in the high temperature short time annealing, recrystallization nuclei are uniformly generated and the time for the abnormal growth of recrystallized grains is not provided. Therefore, a mixed grain state can be avoided. Even when the compound of Ni and P is present, due to a rapid increase in temperature, Ni and P are almost uniformly solid-soluted, that is, the compound almost uniformly disappears and thus the effect of suppressing the growth of grains is uniformly impaired. Therefore, a mixed grain state does not occur and the copper alloy is composed of recrystallized grains having an almost uniform grain size. In addition, when the copper alloy contains P, with batch-type annealing, slow cooling is carried out. Thus, the compound of Ni and P is excessively precipitated and the balance between Ni and P to be solid-soluted is deteriorated. Therefore, stress relaxation characteristics are slightly deteriorated. With high temperature short time annealing, cooling is carried out in the temperature range of 350° C. to 600° C. at an average cooling rate of 2° C./second or higher and thus the compound of Ni and P is not excessively precipitated.

Specifically, the high temperature short time annealing includes a heating step of heating a copper alloy material to a predetermined temperature, a holding step of holding the copper alloy material at a predetermined temperature for a predetermined period of time after the heating step, and a cooling step of cooling the copper alloy material to a predetermined temperature after the holding step. When the maximum reaching temperature of the copper alloy material is denoted by Tmax (° C.), and a heating and holding time in a temperature range from a temperature 50° C. lower than the maximum reaching temperature of the copper alloy material to the maximum reaching temperature is denoted by tm (min), $540 \leq Tmax \leq 790$, and $0.04 \leq tm \leq 1.0$, $500 \leq It1 = (Tmax - 30 \times tm^{-1/2}) \leq 700$.

Particularly, in applications such as terminals, connectors, and the like, it is preferable that $540 \leq Tmax \leq 790$, $0.04 \leq tm \leq 1.0$, and $500 \leq It1 = (Tmax - 30 \times tm^{-1/2}) \leq 680$. When the maximum reaching temperature is more than 790° C., or when It1 is more than 680, particularly 700, the size of the grains is increased, a large amount of precipitates of Ni and P is solid-soluted, and the amount of precipitates is excessively small. On the other hand, since few precipitates are coarsened, the β phase or the γ phase is precipitated during a heat treatment. Therefore, stress relaxation characteristics are deteriorated, strength is lowered, and bending workability is deteriorated. In addition, there is a concern of anisotropy of mechanical properties such as tensile strength in a direction parallel with the rolling direction and a direction perpendicular to the rolling direction, proof stress, and elongation being generated. Preferably, Tmax is 780° C. or lower and It1 is 670 or less. On the other hand, when Tmax is lower than 540° or It1 is less than 500, the grains are not recrystallized and even when the grains are recrystallized, ultrafine grains are obtained. The size thereof is less than 2 μm and bending workability and stress relaxation characteristics are deteriorated. Preferably, Tmax is 550° C. or higher and It1 is 520 or more. However, in a high temperature short time continuous heat treatment method, due to the structure of the apparatus, heating and cooling steps are different and the conditions are slightly deviated. However, within the above range, there is no problem.

After the final annealing, finish rolling is carried out. Although the finish rolling reduction differs depending on the grain size, the target strength and bending workability, due to good balance between bending workability and strength, which is a target of the specification, in applications such as terminals, connectors and the like, the finish rolling reduction is desirably 5% to 50%. At a finish rolling reduction of less than 5%, even when the grain size is as fine as 2 μm to 3 μm, it is difficult to obtain high strength, particularly, high proof stress. Thus, the rolling reduction is preferably 10% or more. On the other hand, as the rolling reduction increases, strength is increased by work hardening. However, ductility and bending workability are deteriorated. When the size of the grains is large, at a rolling reduction more than 50%, ductility and bending workability are deteriorated. The rolling reduction is preferably 40% or less and more preferably 35% or less.

After the final finish rolling, in order to improve the strain state, correction using a tension leveler is carried out. Further, in applications such as terminals, connectors, and the like, a recovery heat treatment without being accompanied with recrystallization in which the maximum reaching temperature of the rolled material is 150° C. to 580° C. and a holding time at a temperature of maximum reaching temperature-50° C. is 0.02 minutes to 100 minutes is carried out. Through this low temperature heat treatment, stress relaxation characteristics, an elastic limit, conductivity, mechanical properties, ductility, and a spring deflection limit are improved. After the finish rolling, when the copper alloy is formed into a sheet material or a product and then molten Sn plating to which thermal conditions corresponding to the above-described conditions are applied, or a reflow Sn plating process is carried out, the recovery heat treatment can be omitted.

Specifically, the recovery heat treatment process is carried out by a high temperature short time continuous heat treatment. The recovery heat treatment includes a heating step of heating a copper alloy material to a predetermined temperature, a holding step of holding the copper alloy material at a predetermined temperature for a predetermined period of time after the heating step, and a cooling step of cooling the copper alloy material to a predetermined temperature after the holding step. When the maximum reaching temperature of the copper alloy material is denoted by Tmax2 (° C.), and a heating and holding time at a temperature range from a temperature 50° C. lower than the maximum reaching temperature of the copper alloy to the maximum reaching temperature is denoted by tm2 (min), $150 \leq Tmax2 \leq 580$, $0.02 \leq tm2 \leq 100$, and $120 \leq It2 = (Tmax2 - 25 \times tm2^{-1/2}) \leq 390$. When Tmax2 is more than 580° C. or It2 is more than 390, softening proceeds and partial recrystallization is generated in some cases, which causes lowering of strength. Preferably, Tmax2 is 550° C. or lower or It2 is 380 or less. When Tmax2 is lower than 150° C. or It2 is less than 120, the degree of improvement of stress relaxation characteristics is small. Most preferably, Tmax2 is 250° C. or higher or It2 is 240 or more. However, in the high temperature short time continuous heat treatment method, due to the structure of the apparatus, heating and cooling steps are different and the conditions are slightly deviated. However, within the above range, there is no problem.

The copper alloy according to the embodiment can be obtained by repeatedly carrying out cold rolling and annealing on an ingot without hot rolling and carrying out a recovery heat treatment. Specifically, through continuous casting, a thin sheet-like casting having a thickness of 10 mm to 25 mm is prepared and as necessary, homogenization annealing at 650° C. to 850° C. for 1 hour to 24 hours is carried out. Then, a pair of cold rolling and annealing is carried out one time or plural times to destroy the metallographic structure of the casting and obtain a recrystallized grain structure. Thereafter, the same rolling before finishing, final annealing, final finish rolling, and the above-described recovery heat treatment are carried out so that a sheet material having almost the same properties as those of a material prepared in hot rolling can be obtained. In the specification, working that is carried out at a temperature lower than the recrystallization temperature of the copper alloy material to be worked is defined as cold working, working that is carried out at a temperature higher than the recrystallization temperature is defined as hot working, and forming working using rolls in these processes is each defined as cold rolling and hot rolling. In addition, recrystallization is defined as a change from one crystal structure to another crystal structure or formation of a new crystal structure in which no strain is present from a structure in which strain generated by working is present.

Particularly, in applications such as terminals, connectors, relays and the like, after the final finish rolling, by substantially holding the temperature of the rolled material at 150° C. to 580° C. for 0.02 minutes to 100 minutes, stress relaxation characteristics are improved. After the finish rolling, when the copper alloy material is formed into a sheet-like material or a product and then a Sn plating process to which thermal conditions corresponding to the above-described conditions are applied is to be carried out, a recovery heat treatment can be omitted. In a Sn plating process such as molten Sn plating or reflow Sn plating, the copper alloy material is formed into a rolled material or a terminal or a connector in some cases at about 150° C. to 300° C. for a short period of time and then heated. Even when the Sn plating process is carried out after the recovery heat treatment, there is little influence on the characteristics of the alloy after the recovery heat treatment. On the other hand, the heating process of the Sn plating process is a process that is carried out instead of the recovery heat treatment process.

The recovery heat treatment is a heat treatment for improving the elastic limit, stress relaxation characteristics, spring deflection limit, and elongation of the material by a recovery heat treatment at low temperature or for a short time without being accompanied with recrystallization, and for recovering conductivity lowered due to cold rolling.

On the other hand, in the case of a general Cu—Zn alloy containing 17 mass % or more of Zn, when a rolled material subjected to cold working at a working rate of 10% or more is annealed at a low temperature, the material is hardened due to low temperature annealing hardening and becomes brittle. When a recovery heat treatment is carried out under the condition of a holding time of 10 minutes, the material is hardened at 150° C. to 200° C. and the material is rapidly hardened or partially recrystallized at about 250° C. and recrystallized at about 300° C. The strength of the rolled material is lowered to a proof stress which is about 50% to 65% of the original proof stress of the rolled material. In this manner, in a narrow temperature range, mechanical properties are changed.

Due to the effects of Ni, Sn and the like contained in the copper alloy according to the embodiment, after the final finish rolling, when the alloy is held, for example, at about 200° C. for 10 minutes, the strength is slightly increased due to low temperature annealing hardening. However, when the alloy is held at about 300° C. for 10 minutes, the strength has already returned to the original strength of the rolled material and ductility is improved. Here, when the degree of low temperature annealing hardening is large, similar to the Cu—Zn alloy, the material becomes brittle. In order to avoid the above-described circumstance, the finish rolling reduction may be 50% or less, preferably 40% or less and more preferably 35% or less. In order to obtain a higher strength, the rolling reduction is at least 5% or more and preferably 10% or more. The grain size may be 2 μm or more and more preferably 3 μm or more. In order to obtain high strength and good balance between strength and ductility, the grain size is 10 μm or less and preferably 8 μm or less.

Further, in a rolled state, proof stress in a direction perpendicular to the rolling direction is low. However, by the recovery heat treatment, ductility is rather improved without deterioration and proof stress in a direction perpendicular to the rolling direction can be improved. Due to this effect, a difference between tensile strength and proof stress in a direction perpendicular to the rolling direction, which was about 10%, is reduced to less than 10% and a difference between tensile strength and proof stress in a direction parallel with the rolling direction, which was about 10%, is also reduced to less than 10%. Thus, a material having small anisotropy is obtained.

As described above, in the copper alloys according to the first to sixth embodiments of the present invention, excellent color fastness, high strength, good bending workability, excellent stress relaxation characteristics, and satisfactory stress corrosion cracking resistance are obtained. Due to these characteristics, the copper alloy is a material suitable for electronic and electrical apparatus components and automobile components such as connectors, terminals, relays, switches, springs, and sockets, decoration and construction tools and members such as handrails, door handles, elevator panel materials, water supply and drain sanitary facilities and apparatuses, and medical appliances which have excellent cost performance such as cheap metal costs and a low alloy density. In addition, since the color fastness is satisfactory, plating can be omitted in some applications such as terminals and connectors, decoration and construction members, and sanitary facilities. Further, in applications such as decoration and construction tools and members such as handrails, door handles, elevator inner wall materials, water supply and drain sanitary facilities and apparatuses, and medical appliances, the antimicrobial effect of copper can be maximized.

Further, when the average grain size is 2 μm to 10 μm, the conductivity is 14% IACS or more and 25% IACS or less, circular or elliptical precipitates are present, and the average particle size of the precipitates is 3 nm to 180 nm, further excellent strength, excellent balance between strength and bending workability, and high stress relaxation characteristics, particularly, high effective stress at 150° C. can be obtained. Therefore, a material suitable for electronic and electrical apparatus components and automobile components such as connectors, terminals, relays, switches, springs, and sockets, which are used in a severe environment, is obtained.

Hereinabove, the embodiments of the present invention have been described. However, the present invention is not limited to these embodiment and may be appropriately modified within a scope not departing from the technical idea of the invention.

EXAMPLES

Hereinafter, the results of confirmation tests that were carried out to confirm the effects of the present invention will be shown. The following examples are shown to describe the effects of the present invention and configurations, processes, and conditions described in the examples do not limit the technical scope of the present invention.

Samples were prepared by using the above-described copper alloys according to the first to sixth embodiments of the present invention and copper alloys having configurations for comparison and changing production processes. The compositions of the copper alloys are shown in Tables 1 to 4. In addition, production processes are shown in Table 5. In Tables 1 to 4, composition relational expressions f1, f2, f3, f4, f5 and f6 shown in the above-described embodiment are shown.

TABLE 1

| Alloy | Component composition (mass %) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 1 | 27.2 | 2.9 | 0.52 | — | — | — | Balance | 24.0 | 21.2 | 24 | 2.6 | 5.6 | — |
| 2 | 23.7 | 3.8 | 1.00 | — | — | — | Balance | 21.1 | 15.8 | 30 | 3.7 | 3.8 | — |
| 3 | 30.3 | 3.4 | 0.64 | 0.02 | — | — | Balance | 26.7 | 23.3 | 22 | 3.0 | 5.3 | 170 |
| 4 | 25.9 | 2.3 | 0.55 | 0.04 | — | — | Balance | 24.1 | 21.1 | 21 | 2.2 | 4.2 | 58 |
| 5 | 19.9 | 1.8 | 0.80 | 0.01 | — | — | Balance | 20.3 | 16.1 | 21 | 2.1 | 2.3 | 180 |
| 6 | 27.8 | 2.7 | 0.44 | 0.02 | As 0.03 | — | Balance | 24.6 | 22.3 | 22 | 2.3 | 6.1 | 135 |
| 7 | 28.7 | 3.4 | 0.51 | — | Sb 0.04 | — | Balance | 24.5 | 21.7 | 25 | 2.9 | 6.7 | — |
| 8 | 30.8 | 2.4 | 0.68 | 0.02 | — | — | Balance | 29.4 | 25.8 | 14 | 2.4 | 3.5 | 120 |
| 11 | 32.7 | 2.6 | 0.34 | — | — | — | Balance | 29.2 | 27.4 | 15 | 2.2 | 7.6 | — |
| 12 | 30.3 | 1.8 | 0.56 | 0.02 | — | — | Balance | 29.5 | 26.5 | 12 | 1.8 | 3.2 | 90 |
| 13 | 26.2 | 1.7 | 1.10 | 0.02 | — | — | Balance | 28.3 | 22.5 | 13 | 2.3 | 1.5 | 85 |
| 14 | 31.2 | 2.4 | 0.39 | 0.04 | — | — | Balance | 28.4 | 26.3 | 16 | 2.1 | 6.2 | 60 |
| 15 | 30.6 | 2.5 | 0.56 | — | — | — | Balance | 28.4 | 25.4 | 16 | 2.3 | 4.5 | — |
| 16 | 27.5 | 1.9 | 0.42 | 0.05 | — | — | Balance | 25.8 | 23.6 | 17 | 1.8 | 4.5 | 38 |
| 17 | 27.6 | 3.5 | 0.75 | — | — | — | Balance | 24.4 | 20.4 | 26 | 3.2 | 4.7 | — |
| 18 | 25.8 | 2.0 | 0.46 | 0.005 | — | — | Balance | 24.1 | 21.7 | 20 | 1.9 | 4.3 | 400 |
| 19 | 26.2 | 3.1 | 0.68 | — | — | — | Balance | 23.4 | 19.8 | 25 | 2.9 | 4.6 | — |
| 20 | 26.2 | 1.6 | 0.17 | 0.02 | — | — | Balance | 23.9 | 22.9 | 18 | 1.3 | 9.4 | 80 |
| 21 | 20.6 | 4.0 | 1.00 | — | — | — | Balance | 17.6 | 12.3 | 32 | 3.8 | 4.0 | — |
| 22 | 21.8 | 3.2 | 0.60 | 0.06 | — | — | Balance | 18.4 | 15.2 | 28 | 2.8 | 5.3 | 53 |

TABLE 2

| Alloy | Component composition (mass %) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 23 | 21.5 | 2.7 | 0.56 | — | — | — | Balance | 18.9 | 15.9 | 26 | 2.5 | 4.8 | — |
| 24 | 22.2 | 1.9 | 0.45 | — | — | — | Balance | 20.7 | 18.3 | 21 | 1.8 | 4.2 | — |
| 25 | 24.4 | 3.5 | 1.20 | — | — | — | Balance | 23.4 | 17.0 | 27 | 3.7 | 2.9 | — |

TABLE 2-continued

| Alloy | Component composition (mass %) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 26 | 18.5 | 3.0 | 0.95 | — | — | — | Balance | 17.3 | 12.2 | 28 | 3.1 | 3.2 | — |
| 27 | 25.8 | 2.5 | 0.71 | 0.03 | Sb 0.04 | — | Balance | 24.4 | 20.6 | 22 | 2.5 | 3.5 | 83 |
| 28 | 27.0 | 2.2 | 0.48 | 0.02 | Fe 0.0009 | — | Balance | 25.0 | 22.5 | 20 | 2.0 | 4.6 | 110 |
| 29 | 28.2 | 2.6 | 0.46 | 0.008 | Fe 0.009 | — | Balance | 25.3 | 22.9 | 21 | 2.3 | 5.7 | 325 |
| 30 | 26.5 | 2.4 | 0.56 | 0.02 | Co 0.003 | — | Balance | 24.5 | 21.5 | 21 | 2.2 | 4.3 | 120 |
| 31 | 27.5 | 3.0 | 0.55 | — | Fe 0.02 | — | Balance | 24.3 | 21.3 | 24 | 2.7 | 5.5 | — |
| 32 | 29.0 | 3.4 | 0.47 | — | Al 0.04 | — | Balance | 24.6 | 22.1 | 25 | 2.9 | 7.2 | — |
| 33 | 30.6 | 3.4 | 0.58 | 0.007 | Mg 0.02 | — | Balance | 26.7 | 23.6 | 22 | 3.0 | 5.9 | 486 |
| 34 | 27.5 | 2.5 | 0.42 | 0.02 | Mn 0.02 | — | Balance | 24.6 | 22.4 | 21 | 2.2 | 6.0 | 125 |
| 35 | 26.8 | 3.1 | 0.48 | — | Ti 0.005 | Cr 0.005 | Balance | 23.0 | 20.5 | 25 | 2.7 | 6.5 | — |
| 36 | 27.5 | 2.2 | 0.41 | 0.05 | Zr 0.008 | — | Balance | 25.2 | 23.0 | 19 | 2.0 | 5.4 | 44 |
| 37 | 29.0 | 3.3 | 0.46 | — | Si 0.03 | — | Balance | 24.7 | 22.3 | 24 | 2.8 | 7.2 | — |
| 38 | 28.7 | 3.4 | 0.70 | 0.008 | Sb 0.04 | — | Balance | 25.4 | 21.7 | 24 | 3.1 | 4.9 | 425 |
| 39 | 27.5 | 3.1 | 0.60 | — | Sb 0.02 | As 0.02 | Balance | 24.3 | 21.1 | 24 | 2.8 | 5.2 | — |
| 40 | 28.4 | 2.6 | 0.37 | 0.02 | Pb 0.007 | — | Balance | 25.1 | 23.1 | 21 | 2.2 | 7.0 | 130 |
| 41 | 24.4 | 3.9 | 1.00 | — | As 0.03 | — | Balance | 21.6 | 16.3 | 30 | 3.7 | 3.9 | — |
| 42 | 28.5 | 3.4 | 0.49 | — | Ce 0.01 | — | Balance | 24.2 | 21.6 | 25 | 2.9 | 6.9 | — |
| 43 | 24.2 | 2.3 | 0.04 | 0.03 | — | — | Balance | 19.8 | 19.6 | 24 | 1.7 | 57.5 | 77 |
| 44 | 25.4 | 1.9 | 1.00 | 0.07 | — | — | Balance | 26.6 | 21.3 | 17 | 2.3 | 1.9 | 27 |
| 45 | 26.1 | 3.0 | 0.65 | 0.005 | — | — | Balance | 23.4 | 19.9 | 25 | 2.8 | 4.6 | 600 |

TABLE 3

| Alloy | Component composition (mass %) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 101 | 30.7 | 2.3 | 0.91 | — | — | — | Balance | 30.7 | 25.8 | 10 | 2.5 | 2.5 | — |
| 102 | 29.9 | 1.6 | 0.75 | 0.02 | — | — | Balance | 30.5 | 26.5 | 9 | 1.9 | 2.1 | 80 |
| 103 | 30.1 | 1.2 | 0.42 | 0.02 | — | — | Balance | 29.8 | 27.6 | 9 | 1.3 | 2.9 | 60 |
| 104 | 27.4 | 0.86 | 0.52 | 0.02 | — | — | Balance | 28.3 | 25.5 | 10 | 1.1 | 1.7 | 43 |
| 105 | 34.5 | 3.8 | 0.56 | 0.03 | — | — | Balance | 29.7 | 26.7 | 16 | 3.2 | 6.8 | 127 |
| 106 | 34.6 | 4.3 | 0.75 | — | — | — | Balance | 29.8 | 25.8 | 17 | 3.8 | 5.7 | — |
| 107 | 22.9 | 2.5 | 2.00 | — | — | — | Balance | 27.9 | 17.3 | 17 | 3.8 | 1.3 | — |
| 108 | 29.4 | 1.6 | 0.45 | 0.12 | — | — | Balance | 28.5 | 26.1 | 13 | 1.6 | 3.6 | 13 |
| 109 | 29.1 | 1.6 | 0.97 | 0.02 | — | — | Balance | 30.8 | 25.6 | 8 | 2.1 | 1.6 | 80 |
| 110 | 31.9 | 2.3 | 0.64 | — | — | — | Balance | 30.5 | 27.1 | 10 | 2.3 | 3.6 | — |
| 111 | 26.9 | 1.5 | 0.09 | — | — | — | Balance | 24.4 | 23.9 | 17 | 1.1 | 16.7 | — |
| 112 | 31.8 | 1.6 | 0.22 | 0.04 | — | — | Balance | 29.7 | 28.5 | 10 | 1.3 | 7.3 | 40 |
| 113 | 32.5 | 3.4 | 1.00 | — | — | — | Balance | 30.7 | 25.4 | 12 | 3.4 | 3.4 | — |
| 114 | 24.2 | 1.7 | 1.40 | — | — | — | Balance | 27.8 | 20.4 | 14 | 2.6 | 1.2 | — |
| 115 | 32.0 | 1.8 | 0.30 | — | — | — | Balance | 29.9 | 28.3 | 11 | 1.6 | 6.0 | — |
| 116 | 33.2 | 2.9 | 0.71 | 0.05 | — | — | Balance | 31.0 | 27.2 | 10 | 2.7 | 4.1 | 58 |
| 117 | 31.9 | 2.2 | 0.78 | — | — | — | Balance | 31.4 | 27.3 | 6 | 2.3 | 2.8 | — |
| 118 | 28.1 | 1.7 | 1.20 | — | — | — | Balance | 30.7 | 24.3 | 8 | 2.4 | 1.4 | — |
| 119 | 16.1 | 2.0 | 0.36 | — | — | — | Balance | 13.9 | 12.0 | 22 | 1.8 | 5.6 | — |
| 120 | 27.2 | 2.3 | 0.69 | 0.03 | Fe 0.07 | — | Balance | 26.1 | 22.4 | 19 | 2.3 | 3.3 | 77 |
| 121 | 27.9 | 2.6 | 0.63 | 0.02 | Co 0.08 | — | Balance | 25.9 | 22.5 | 20 | 2.5 | 4.1 | 130 |
| 122 | 28.9 | 1.3 | 0.58 | — | — | — | Balance | 29.2 | 26.1 | 10 | 1.5 | 2.2 | — |
| 123 | 23.3 | 2.1 | 0.02 | — | — | — | Balance | 19.2 | 19.1 | 23 | 1.5 | 105.0 | — |
| 124 | 23.8 | 2.0 | 0.01 | 0.03 | — | — | Balance | 19.9 | 19.8 | 22 | 1.4 | 200.0 | 67 |
| 125 | 17.3 | 3.4 | 0.05 | — | — | — | Balance | 10.8 | 10.5 | 28 | 2.4 | 68.0 | — |
| 126 | 25.1 | 1.7 | 1.00 | 0.08 | — | — | Balance | 26.7 | 21.4 | 16 | 2.2 | 1.7 | 21 |

TABLE 4

| Alloy No. | Component composition (mass %) Zn | Ni | Sn | P | Other elements | Cu | Composition relational expression f1 | f2 | f3 | f4 | f5 | f6 |
|---|---|---|---|---|---|---|---|---|---|---|---|---|
| 201 | 28.7 | — | — | — | — | Balance | — | — | — | — | — | — |
| 202 | 25.5 | — | — | — | — | Balance | — | — | — | — | — | — |
| 203 | 20.8 | — | — | — | — | Balance | — | — | — | — | — | — |
| 204 | 17.2 | — | — | — | — | Balance | — | — | — | — | — | — |
| 205 | — | — | 7.80 | 0.08 | — | Balance | — | — | — | — | — | — |

TABLE 5

| Process No. | Hot rolling + milling thickness (mm) | Rolling thickness (mm) | Annealing Temperature (° C.) | Annealing Time (min) | Rolling thickness (mm) | Annealing Temperature (° C.) | Annealing Time (min) | Rolling thickness before finish (mm) | Final annealing Temperature (° C.) | Final annealing Time (min) |
|---|---|---|---|---|---|---|---|---|---|---|
| A1-1 | 12 | 2.5 | 580 | 240 | 0.9 | 500 | 240 | 0.36 | 425 | 240 |
| A1-2 | 12 | 2.5 | 580 | 240 | 0.9 | 500 | 240 | 0.36 | 425 | 240 |
| A1-3 | 12 | 2.5 | 580 | 240 | 0.9 | 500 | 240 | 0.36 | 425 | 240 |
| A1-4 | 12 | 2.5 | 580 | 240 | 0.9 | 500 | 240 | 0.36 | 690 | 0.14 |
| A2-1 | 12 | — | — | — | 1.0 | 510 | 240 | 0.36 | 425 | 240 |
| A2-2 | 12 | — | — | — | 1.0 | 510 | 240 | 0.36 | 670 | 0.09 |
| A2-3 | 12 | — | — | — | 1.0 | 510 | 240 | 0.36 | 670 | 0.09 |
| A2-4 | 12 | — | — | — | 1.0 | 510 | 240 | 0.36 | 670 | 0.09 |
| A2-5 | 12 | — | — | — | 1.0 | 510 | 240 | 0.40 | 690 | 0.14 |
| A2-6 | 12 | — | — | — | 1.0 | 510 | 240 | 0.40 | 690 | 0.14 |
| A2-7 | 12 | — | — | — | 1.0 | 670 | 0.24 | 0.40 | 705 | 0.18 |
| A2-8 | 12 | — | — | — | 1.0 | 670 | 0.24 | 0.40 | 770 | 0.25 |
| A2-9 | 12 | — | — | — | 1.0 | 510 | 240 | 0.40 | 580 | 240 |
| A2-10 | 12 | — | — | — | 1.0 | 670 | 0.24 | 0.36 | 620 | 0.05 |
| A3-1 | 12 | — | — | — | 1.0 | 680 | 0.3 | Seam welding pipe with φ 25.4 mm prepared after being slit having width of 86 mm | | |
| B1-1 | 6 | — | — | — | 0.9 | 510 | 240 | 0.36 | 425 | 240 |
| B1-2 | 6 | — | — | — | 0.9 | 510 | 240 | 0.36 | 670 | 0.09 |
| B1-3 | 6 | — | — | — | 0.9 | 510 | 240 | 0.36 | 670 | 0.09 |
| B2-1 | 6 | — | — | — | — | — | — | 0.36 | 425 | 240 |
| B3-1 | (Annealing) | 6 | 620 | 240 | 0.9 | 510 | 240 | 0.36 | 425 | 240 |
| B3-2 | (Annealing) | 6 | 620 | 240 | 0.9 | 510 | 240 | 0.36 | 670 | 0.09 |
| C1 | 6 | — | — | — | 0.9 | 510 | 240 | 0.36 | 425 | 240 |
| C1A | 6 | — | — | — | 0.9 | 510 | 240 | 0.36 | 670 | 0.09 |
| C2 | 6 | — | — | — | 1.0 | 430 | 240 | 0.40 | 380 | 240 |

| Process No. | It1 | Finish rolling Thickness (mm) | Finish rolling Re (%) | Recovery heat treatment Temperature (° C.) | Recovery heat treatment Time (min) | It2 |
|---|---|---|---|---|---|---|
| A1-1 | — | 0.3 | 17 | 300 | 30 | 295 |
| A1-2 | — | 0.3 | 17 | 450 | 0.05 | 338 |
| A1-3 | — | 0.3 | 17 | 300 | 0.07 | 206 |
| A1-4 | 610 | 0.3 | 17 | 450 | 0.05 | 338 |
| A2-1 | — | 0.3 | 17 | 450 | 0.05 | 338 |
| A2-2 | 570 | 0.3 | 17 | 450 | 0.05 | 338 |
| A2-3 | 570 | 0.3 | 17 | 300 | 0.07 | 206 |
| A2-4 | 570 | 0.3 | 17 | — | — | — |
| A2-5 | 610 | 0.3 | 25 | 450 | 0.05 | 338 |
| A2-6 | 610 | 0.3 | 25 | 250 | 0.15 | 185 |
| A2-7 | 634 | 0.3 | 25 | 450 | 0.05 | 338 |
| A2-8 | 710 | 0.3 | 25 | 450 | 0.05 | 338 |
| A2-9 | — | 0.3 | 25 | 450 | 0.05 | 338 |
| A2-10 | 486 | 0.3 | 17 | 450 | 0.05 | 338 |
| A3-1 | Seam welding pipe with φ 25.4 mm prepared after being slit having width of 86 mm | | | | | |
| B1-1 | — | 0.3 | 17 | 450 | 0.05 | 338 |
| B1-2 | 570 | 0.3 | 17 | 300 | 0.07 | 206 |
| B1-3 | 570 | 0.3 | 17 | 300 | 30 | 295 |
| B2-1 | — | 0.3 | 17 | 300 | 30 | 295 |
| B3-1 | — | 0.3 | 17 | 300 | 30 | 295 |
| B3-2 | 570 | 0.3 | 17 | 300 | 30 | 295 |

TABLE 5-continued

| | | | | | | |
|---|---|---|---|---|---|---|
| C1 | — | 0.3 | 17 | 300 | 30 | 295 |
| C1A | 570 | 0.3 | 17 | 300 | 30 | 295 |
| C2 | — | 0.3 | 25 | 230 | 30 | — |

In a production process A (A1-1 to A1-4, A2-1 to A2-10, and A3-1), raw materials were melted in an induction melting furnace having an internal volume of 5 tons and ingots having a cross section with a thickness of 190 mm and a width of 630 mm were produced by semi-continuous casting. The ingots each were cut to have a length of 1.5 m and then a hot rolling process (sheet thickness: 13 mm)—a cooling process—a milling process (sheet thickness: 12 mm)—a cold rolling process were carried out.

The hot rolling start temperature in the hot rolling process was set to 820° C., the material was hot-rolled to a sheet thickness of 13 mm, and then cooled by shower water cooling in the cooling process. The average cooling rate in the cooling process was set to a cooling rate in a temperature range from when the temperature of the rolled material after final hot rolling, or the temperature of the rolled material reached 650° C. when the temperature reached 350° C. and was measured in the rear end of the rolled sheet. The measured average cooling rate was 3° C./sec.

In the processes A1-1 to A1-4, a cold rolling (sheet thickness: 2.5 mm)—an annealing process (580° C., holding time: 4 hours)—cold rolling (sheet thickness: 0.9 mm)—an annealing process (500° C., holding time: 4 hours)—a rolling process before finishing (sheet thickness: 0.36 mm and a cold working rate of 60%)—a final annealing process (final recrystallization heat treatment process)—a finish cold rolling process (sheet thickness of 0.3 mm and a cold working rate of 17%)—a recovery heat treatment were carried out.

As the final annealing of the processes A1-1 to 3, batch annealing (425° C., holding time: 4 hours) was carried out. In the process A1-1, a recovery heat treatment was carried out under batch-type conditions (300° C., holding time: 30 minutes) in a laboratory. In the process A1-2, a recovery heat treatment was carried out by a continuous high temperature short time annealing method in a work line under the conditions of (450° C.-0.05 minutes) when the maximum reaching temperature of the rolled material Tmax (° C.) and a holding time tm (min) in a range from a temperature 50° C. lower than the maximum reaching temperature of the rolled material to the maximum reaching temperature are expressed as (Tmax (° C.)–tm (min or minutes)). In the recovery heat treatment of the process A1-3, a heat treatment, which will be described later, was carried out in a laboratory under the conditions of (300° C.-0.07 min). In the process A1-4, final annealing was carried out under the conditions of (690° C.-0.14 minutes) of a high temperature short time annealing method and (450° C.-0.05 minutes) of a recovery heat treatment.

In the processes A2-1 to A2-10, an annealing process was carried out one time, and cold rolling (sheet thickness: 1 mm)—an annealing process a rolling process before finishing (in the processes A2-1 to A2-4, and A2-10, sheet thickness: 0.36 mm, cold working rate: 64%, and in the processes A2-5 to A2-9, sheet thickness: 0.4 mm, cold working rate: 60%)—a final annealing process—a finish cold rolling process (in the processes A2-1 to A2-4 and A2-10, sheet thickness: 0.3 mm, cold working rate: 17%, and in the processes A2-5 to A2-9, sheet thickness: 0.3 mm, cold working rate: 25%)—a recovery heat treatment were carried out.

The annealing process of the processes A2-1 to A2-6 and A2-9 was carried out under the conditions of (510° C., holding time: 4 hours) and the processes A2-7, A2-8 and A2-10 were carried out by a high temperature short time annealing method under the conditions of (670° C.-0.24 minutes).

As the final annealing of the process A2-1, batch annealing (425° C., holding time: 4 hours) was carried out, the processes A2-2, 3 and 4 were carried out by a continuous high temperature short time annealing method (670° C.-0.09 minutes), the processes A2-5 and A2-6 were carried out under the conditions of (690° C.-0.14 minutes), the process A2-7 was carried out under the conditions of (705° C.-0.18 minutes), the process A2-8 was carried out under the conditions of (770° C.-0.25 minutes), the process A2-10 was carried out under the conditions of (620° C.-0.05 minutes), and the process A2-9 was carried out under the conditions of batch annealing of (580° C., holding time: 4 hours).

In the continuous high temperature short time annealing method which has been carried out, when the temperature is 600° C. or the maximum reaching temperature is 600° C. or lower, the average cooling rate in a temperature range from the maximum reaching temperature to 350° C. was 3° C./second to 18° C./second although the average cooling rate differed depending on conditions.

The recovery heat treatment of the processes A2-1, 2, 5, and 7 to 10 was carried out under the conditions of continuous high temperature short time annealing of (450° C.-0.05 minutes), the process A2-3 was carried out in a laboratory under the conditions of (300° C.-0.07 min), and the process A2-6 was carried out in a laboratory under the conditions of (250° C.-0.15 min). Regarding the process A2-4, the recovery heat treatment was not carried out.

The high temperature short time annealing was carried by a method of completely immersing the rolled material in 2-liter oil baths storing heat treating oils, which are classified into 3 kinds in JIS in JIS K 2242:2012, each heated to 300° C. and 250° C., for 0.07 minutes and 0.15 minutes, respectively, under the conditions of (300° C.-0.07 min) or (250° C.-0.15 min) as conditions corresponding to a molten Sn plating process, instead of the recovery heat treatment.

The process A3-1 was carried out by cold-rolling a milling material to 1 mm and carrying out a continuous high temperature short time annealing method under the conditions of (680° C.-0.3 minutes) such that the average grain size was 10 μm to 18 μm. The coil was slit to have a width of 86 mm, and for production of a welded pipe, an intermediate material (annealed material of width 86 mm×thickness 1 mm) was supplied at a feed rate of 60 m/min and was subjected to deformation processing into a circular shape by plural rolls. The cylindrical material was heated by a high-frequency induction heating coil and the both ends of the intermediate material were joined by lamination. A welded pipe having a diameter of 25.4 mm and a thickness of 1.08 mm was obtained by cutting and removing the bead portion of the joint portion by a cutting tool (cutting blade tool). Due to changes in thickness, when the welded pipe is formed, cold working of substantially several percents is carried out.

In addition, the production process B was carried out as follows using experimental facilities.

Ingots of the production process A were cut into ingots for a laboratory test which had a thickness of 30 mm, a width of 120 mm and a length of 190 mm. Then, the cut ingots were subjected to a hot rolling process (sheet thickness: 6 mm)—a cooling process (air cooling)—a pickling process a rolling process—an annealing process—a rolling process before finish (thickness: 0.36 mm)—a recrystallization heat treatment process a finish cold rolling process (sheet thickness: 0.3 mm, working rate: 17%)—a recovery heat treatment.

In the hot rolling process, each of the ingots was heated to 830° C. and the ingot was hot-rolled to a thickness of 6 mm. The cooling rate (cooling rate at the temperature of a rolled material after the hot rolling or in a temperature range from 650° C. to 350° C.) in the cooling process was mainly set to 5° C./second, and the surface of the rolled material was pickled after the cooling process.

In the processes B1-1 to B1-3, an annealing process was carried out one time, a material was cold-rolled to 0.9 mm in a rolling process, the annealing process was carried out under the conditions of (510° C., holding time: 4 hours), and the material was cold-rolled to 0.36 mm in a rolling process before finishing. Final annealing was carried out under the conditions of (425° C., holding time: 4 hours) in the process B1-1 and (670° C.-0.09 minutes) in the processes B1-2 and B1-3, and the material was finish-rolled to 0.3 mm. Then, a recovery heat treatment was carried out under the conditions of (450° C.-0.05 minutes) in the process B1-1, (300° C.-0.07 min) in the process B1-2, and (300° C., holding time: 30 minutes) in the process B1-3.

In the process B2-1, an annealing process was omitted. A sheet material having a thickness of 6 mm after pickling was cold-rolled to 0.36 mm in the rolling process before finishing (working rate: 94%), final annealing was carried out under the conditions of (425° C., holding time: 4 hours), the material was finish-rolled to 0.3 mm, and further, a recovery heat treatment was carried out under the conditions of (300° C., holding time: 30 minutes).

In the processes B3-1 and B3-2, hot rolling was not carried out and cold rolling and annealing were repeatedly carried out. The ingot having a thickness of 30 mm was subjected to homogenization annealing at 720° C. for 4 hours, cold-rolled to 6 mm, subjected to an annealing process under the conditions of (620° C., holding time: 4 hours), cold-rolled to 0.9 mm, subjected to an annealing process under the conditions of (510° C., holding time: 4 hours), and cold-rolled to 0.36 mm. Final annealing was carried out under the conditions of (425°, holding time: 4 hours) in the process of B3-1 and (670° C.-0.09 minutes) in the process of B3-2, the material was finish-cold-rolled to 0.3 mm, and then a recovery heat treatment was carried out under the conditions of (300° C., holding time: 30 minutes).

In the production process B, a process corresponding to a short-time heat treatment performed by a continuous annealing line or the like in the production process A was substituted with immersion of the rolled material in a salt bath. The maximum reaching temperature was set to a temperature of a liquid of the salt bath, the immersion time was set to the holding time, and air cooling was performed after immersion. In addition, a mixed material of BaCl, KCl, and NaCl was used as salt (solution).

Further, the process C (C1, C1A) as a laboratory test was carried out as follows. Melting and casting were carried out with an electric furnace in a laboratory to have predetermined components, whereby ingots for a test, which had a thickness of 30 mm, a width of 120 mm, and a length of 190 mm, were obtained. Then, production was carried out by the same processes as the above-described process B1-1. Each of the ingots was heated to 830° C. and hot-rolled to a thickness of 6 mm. After the hot rolling, the ingot was cooled at a cooling rate of 5° C./second at a temperature of the rolled material after the hot rolling or in a temperature range from 650° C. to 350° C. The surface of the rolled material was pickled after the cooling, and the rolled material was cold-rolled in the cold rolling process to 0.9 mm. After the cold rolling, the annealing process was carried out under conditions of 510° C. and 4 hours. In the following rolling process, the material was cold-rolled to 0.36 mm. Final annealing was carried out under the conditions of (425° C., holding time: 4 hours) in the process C1 and (670° C.-0.09 minutes) in the process C1A, the material was cold-rolled to 0.3 mm (cold working rate: 17%) in the finish cold rolling, and a recovery heat treatment was carried out under the conditions of (300° C., holding time: 30 minutes).

The process C2 is a process of a material for comparison and due to the characteristics of the material, the thickness and heat treatment conditions were changed such that the final average grain size was 10 μm or less and the tensile strength was about 500 N/mm$^2$. After pickling, the material was cold-rolled to 1 mm, an annealing process was carried out under the conditions of 430° C. and 4 hours, and the material was cold-rolled to 0.4 mm in a rolling process. Final annealing conditions were a temperature of 380° C. and a holding time of 4 hours, the material was cold-rolled to 0.3 mm by finish cold rolling, (cold working rate: 25%), and a recovery heat treatment was carried out under the conditions of (230° C., holding time: 30 minutes).

Regarding phosphor bronze, a commercially available product of C5210 containing 8 mass % of Sn and having a tensile strength of about 640 N/mm$^2$ and a thickness of 0.3 mm was prepared.

The metallographic structures of the copper alloys prepared in the above-described methods were observed, and the average grain size and the ratios of β and γ phases were measured. In addition, the average particle size of precipitates was measured by TEM. Further, to evaluate the characteristics of the copper alloys, tests for conductivity, stress relaxation characteristics, stress corrosion cracking resistance, tensile strength, proof stress, elongation, bending workability, color fastness, and antimicrobial properties were carried out for measuring the characteristics.

<Structure Observation>

The average grain size of grains was measured according to planimetry of methods for estimating the average grain size of wrought copper and copper alloys defined in JIS H 0501 by selecting an appropriate magnification according to the size of grains based on metallographic microscopic images of, for example, magnifications of 300 times, 600 times, and 150 times. Twin was not considered as a grain. The average grain size was calculated according to planimetry (JIS H 0501).

One grain is elongated by rolling, but the volume of the grain is not substantially changed by rolling. In cross-sections obtained by cutting a sheet material in directions parallel to and perpendicular to a rolling direction, an average grain size in the stage of recrystallization can be estimated from the average grain size measured according to planimetry.

The ratio of an α phase of each material was determined from images obtained by a metallurgical microscope at a magnification of 300 times (micrographs of a view field of 89 mm×127 mm). When each material was etched using a mixed solution of ammonia water and hydrogen peroxide and the structure was observed by a metallurgical microscope, the α phase was seen to be light yellow, the β phase was seen to be a yellow deeper than the color of the α phase, the γ phase was seen to be light blue, oxides and non-metallic inclusions were seen to be gray, and coarse metallic compounds were seen to be a light blue more bluish than the color of the γ phase or blue. Therefore, each phase of α, β and γ, non-metallic inclusions and the like is easily distinguished from each other. The β and γ phases in the observed metallographic structure were binarized using image processing software "Win ROOF" and the ratios of the areas of β and γ phases with respect to the total ratio of the metallographic structure were obtained as area ratios. The metallographic structure was measured from three visual fields, and the average value of the respective area ratios was calculated. Regarding a seam welded pipe, the measurement was carried out in three visual fields each at a joint portion, a heat affected zone included in a heat affected zone 1 mm apart from the boundary between the joint portion and the heat affected zone, and an arbitrary portion of a base material and a total of the average values thereof was divided by 3.

<Precipitate>

The average particle size of precipitates was obtained as follows. Transmission electronic microscopic images were obtained using a TEM at a magnification of 500,000 times and a magnification of 150,000 times (detection limits were 2.0 nm), and the contrast of a precipitate was elliptically approximated using image analysis software "Win ROOF". The geometric average value of long and short axes was obtained from each of all the precipitate particles in the field of view. The average value thereof was obtained as an average particle size. Precipitates having an average size of about less than 5 nm were measured at 750,000 times (the detection limit was 0.5 nm), and precipitates having an average size of about greater than 50 nm were measured at 50,000 times (the detection limit was 6 nm). In the case of a transmission electron microscope, since the cold-rolled material has a high dislocation density, it is difficult to accurately obtain precipitate information. In addition, the size of a precipitate is not changed by cold-rolling. Therefore, in this observation, recrystallized portions before the finish cold rolling process and after the recrystallization heat treatment process were observed. Two measurement positions were located at a depth of ¼ of the thickness of the sheet from both the front and rear surfaces of a rolled material and the measured values of the two positions were averaged.

<Conductivity>

Conductivity was measured using a conductivity measuring device (SIGMATEST D2.068, manufactured by Foerster Japan Ltd.). In this specification, "electric conduction" has the same definition as that of "conduction". In addition, thermal conduction has a strong relationship with electric conduction. Therefore, the higher the electric conductivity is, the higher the thermal conductivity is.

<Stress Relaxation Characteristics>

A stress relaxation rate was measured as follows. In a stress relaxation test of a test material, a cantilever screw jig was used. Two test pieces were collected from a direction parallel with a rolling direction and a direction perpendicular to the rolling direction and had a shape of thickness 0.3 mm×width 10 mm×length 60 mm. A load stress on the test material was set to be 80% with respect to a 0.2% proof stress test material that was exposed to an atmosphere of 150° C. and 120° C. for 1,000 hours. The stress relaxation rate was obtained from the following expression.

Stress relaxation rate=(displacement after relief/Displacement under load stress)×100(%)

The average value of test pieces which were collected from both directions parallel with and perpendicular to the rolling direction was used. In the present invention, it is desired to obtain particularly excellent stress relaxation characteristics even in a Cu—Zn alloy containing a high concentration of Zn. Therefore, when the stress relaxation rate at 150° C. is 25% or less, stress relaxation characteristics are excellent. When the stress relaxation rate is more than 25% and 35% or less, stress relaxation characteristics are satisfactory and when the rate is more than 35% and 50% or less, there is a problem in use. When the rate is more than 50%, there are difficulties in use. Particularly, when the rate is more than 70%, there is a significant problem in use in a high temperature environment and the sample is "not available".

On the other hand, in a test under slightly mild conditions of 120° C. and 1,000 hours, higher performance is required. In a case in which the stress relaxation rate was 10% or less, the level of stress relaxation characteristics was high and this case was evaluated as "A". In a case in which the stress relaxation rate was more than 10% and 15% or less, stress relaxation characteristics were satisfactory and this case was evaluated as "B". In a case in which the stress relaxation rate was more than 15% and 30% or less, there was a problem in use. In a case in which the stress relaxation rate was more than 30%, the test piece was substantially mild and there was little superiority as a material. In the specification, it is desired to obtain particularly excellent stress relaxation and thus the test piece having a stress relaxation rate of more than 15% was evaluated as "C".

On the other hand, the maximum effective contact pressure is expressed by proof stress×80%×(100%−stress relaxation rate (%)). In the alloy of the present invention, it is important that not only proof stress at room temperature be high or the stress relaxation rate be low, but also the value of the above expression be high. An alloy in which the value of proof stress×80%×(100%−stress relaxation rate (%)) is 275 $N/mm^2$ or more in the test at 150° C. can be used in a high temperature state and an alloy in which the value is 300 $N/mm^2$ or more is suitably used in a high temperature state. An alloy in which the value is 325 $N/mm^2$ or more is most suitable. In applications of yellow brass containing a large amount of Zn such as terminals and connectors, in the specification, it is desired to obtain color fastness which endures a severe high temperature and excellent stress relaxation characteristics and thus a high stress relaxation rate at 120° C. and 150° C. for 1,000 hours, or high effective stress is desired. In the specification, as proof stress and a stress relaxation rate, the average values of proof stress and stress relaxation rates of test pieces collected from two directions parallel with and perpendicular to the rolling direction are used. The proof stress and stress relaxation characteristics may not be obtained from a direction which forms 90 degrees (perpendicular) with respect to the rolling direction due to the relation with the width of a slit after being slit, that is, when the width is smaller than 60 mm. In this case, only from a direction which forms 0 degree (parallel) with respect to the rolling direction, the stress relaxation characteristics and the maximum effective contact pressure (effective stress) of a test piece are evaluated.

In test Nos. 31, 34 and 36 (Alloy No. 3) and test Nos. 50, 54 and 54A (Alloy No. 4), it was confirmed that there was no significant difference among the effective stress calculated from the results of the stress relaxation test in a direction which forms 90 degrees (perpendicular) with respect to the rolling direction and a direction which forms 0 degree (parallel) with respect to the rolling direction, the effective stress calculated from the results of the stress relaxation test only in a direction which forms 0 degree (parallel) with respect to the rolling direction, and the effective stress calculated from the results of the stress relaxation test only in a direction which forms 90 degrees (perpendicular) with respect to the rolling direction.

<Stress Corrosion Cracking 1>

Stress corrosion cracking properties were measured by adding sodium hydroxide and pure water to a test solution, that is, ammonium chloride by using a test container defined in ASTM B858-01 (107 g/500 ml) to adjust the pH to 10.1±0.1, and the air conditioning in a room was controlled to 23° C.±1° C.

First, bending plastic working and residual stress were applied to a rolled material and stress corrosion cracking properties were evaluated. Using a bending workability evaluation method, which will be described later, a test piece which was subjected to W bending at R (radius: 0.6 mm) of two times the thickness of a sheet was exposed to the stress corrosion cracking environment. After a predetermined period of exposure time, the test piece was taken out and washed with sulfuric acid. Then, whether cracking occurred or not was investigated using a stereoscopic microscope at a magnification of 10 times (visual field of 200 mm×200 mm, substantially, 20 mm×20 mm (actual size)) to evaluate stress corrosion cracking resistance. Samples collected from a direction parallel with a rolling direction were used. A test piece in which cracking had not occurred through exposure for 48 hours had excellent stress corrosion cracking resistance and was evaluated as "A". A test piece in which little cracking had occurred through exposure for 48 hours but cracking had not occurred through exposure for 24 hours had satisfactory stress corrosion cracking resistance (without any problem in practical use) and was evaluated as "B". A test piece in which cracking occurred through exposure for hours had deteriorated stress corrosion cracking resistance (with a problem in practical use) and was evaluated as "C".

Regarding a seam welded pipe, a sample which was crushed until a distance between flat sheets in a flattening test, which will be described later, became 5 times the thickness of the pipe was used.

<Stress Corrosion Cracking 2>

In addition, stress corrosion cracking properties were evaluated by another method separately from the above-described evaluation.

In the stress corrosion cracking test, in order to investigate sensitivity for stress corrosion cracking in a state in which stress was applied, a resin cantilever screw type jig was used. A rolled material was exposed to the stress corrosion cracking atmosphere in a state in which as in the stress relaxation test, bending stress which was 80% of proof stress, that is, stress of the elastic limit of the material was applied, and stress corrosion cracking resistance was evaluated from the stress relaxation rate. That is, when minute cracking occurs, and a degree of the cracking increases without returning to the original state, the stress relaxation rate increases, and thus the stress corrosion cracking resistance can be evaluated. A test piece in which the stress relaxation rate through exposure for 24 hours was 15% or less had excellent stress corrosion cracking resistance and was evaluated as "A". A test piece in which the stress relaxation rate was more than 15% and 30% or less had satisfactory stress corrosion cracking resistance and was evaluated as "B". The use of a test piece in which the stress relaxation rate was more than 30% under a severe stress corrosion cracking environment was difficult and the sample was evaluated as "C". The samples used were collected from a direction parallel with a rolling direction were used.

<Mechanical Properties and Bending Workability of Sheet Material>

The tensile strength, proof stress, and elongation of the sheet material were measured according to methods defined in JIS Z 2201 and JIS Z 2241 and a No. 5 test piece was used regarding the shape of a test piece. Test pieces were collected from two directions parallel with and perpendicular to the rolling direction. Here, the width of the materials tested in the processes B and C was 120 mm and a test piece according to the No. 5 test piece was used.

The bending workability of a sheet material was evaluated in a W bending test defined in JIS H 3110. The bending (W-bending) test was carried out as follows. A bending radius was set to be one time (bending radius=0.3 mm, 1 t) and 0.5 times (bending radius=0.15 mm, 0.5 t) the thickness of a material. Samples were bent in a direction, in a so-called bad way, which forms 90 degrees with a rolling direction and in a direction, in a so-called good way, which forms 0 degrees with the rolling direction. In the evaluation of bending workability, whether cracking occurred or not was determined by observation using a stereoscopic microscope at a magnification of 20 times (view field of 200 mm×200 mm, substantially, 10 mm×10 mm (actual size)). A test piece in which cracking had not occurred when the bending radius was 0.5 times the thickness of a material was evaluated as "A". A test piece in which cracking had not occurred when the bending radius was 1 time the thickness of a material was evaluated as "B". A test piece in which cracking had occurred when the bending radius was 1 time the thickness of a material was evaluated as "C".

<Mechanical Properties and Workability of Seam Welded Pipe>

For the mechanical properties of a seam welded pipe, a tensile test was carried out by using a No. 11 test piece of a metal material tensile test piece of JIS Z 2241 (gauge length: 50 mm, the test piece was used in a state in which the test piece was cut from the pipe material) and inserting a core bar into a grip portion.

First, the joint portion of the seam welded pipe was evaluated by carrying out a flattening test described in JIS H 3320 on a copper or copper alloy welded pipe. A sample was collected from a portion about 100 mm apart from the end of the seam welded pipe, the sample was interposed between two flat sheets and was crushed until a distance between the flat sheets became three times the thickness of the pipe. At this time, the joint portion of the seam welded pipe was arranged in a direction perpendicular to the compression direction and was subjected to flattening bending so that the joint portion became a tip end of bending. The state of the joint portion which was subjected to bending was visually observed. Next, a flaring test was carried out by a method described in JIS H 3320. In the flaring test, a conical tool with a vertical angle of 60° was pushed into one end of a sample of 50 mm cut from the welded pipe until a diameter of 1.25 times the outer diameter (that is, a diameter of 31.8 mm which was 1.25 times the diameter of the end portion of 25.4 mm by the flaring) was obtained and cracking of the welded portion was visually confirmed. Regarding the evaluation of both tests, a test piece in which defects such as cracking and minute holes were not observed was evaluated as "A" and a test piece which was not available due to defects such as cracking and holes occurred in the joint portion was evaluated as "C".

<Color Fastness Test 1: High Temperature High Humidity Environment Test>

In the color fastness to evaluate the color fastness of a material, using a thermo-hygrostat (HIFLEX FX2050, produced by Kusumoto Chemicals, Ltd.), each sample was exposed to an atmosphere at a temperature of 60° C. and a relative humidity of 95%. As a test piece, a test piece before a final recovery heat treatment is carried out, that is, a sheet material after finish rolling was used. The test time was set to 72 hours. The sample was taken out after the test, L*a*b* values of the surface color of the material before and after the exposure were measured by a spectrophotometer, and the color difference was calculated and evaluated. In copper and a copper alloy, particularly, a Cu—Zn alloy containing a high concentration of Zn, the color changes to reddish brown or red. Due to this, for the evaluation of color fastness, a sample in which a difference between a* values before and after the test, that is, a value of a change in an a* value was 1 or less, was evaluated as "A". A sample in which the difference was greater than 1 and 2 or less was evaluated as "B". A sample in which the difference was greater than 2 was evaluated as It could be determined that as the numerical value increases, the color fastness deteriorates, and visual evaluation was also matched with the results.

<Color Fastness Test 2: High Temperature Test>

On the assumption of a room, particularly, a cabin of an automobile and an engine room under the severe blazing sun, color fastness at a high temperature was evaluated. As a test piece, a sheet material before a final recovery heat treatment was carried out was used. In the atmosphere, the test piece was held in an electric furnace at 120° C. for 100 hours and L*a*b* values of the surface color before and after the test were measured by a spectrophotometer. As in the above test, for the evaluation of color fastness, a sample in which a difference between a* values before and after the test, that is, a value of a change in an a* value was 3 or less was evaluated as "A". A sample in which the difference was greater than 3 and 5 or less was evaluated as "B". A sample in which the difference was greater than 5 was evaluated as "C".

<Color Tone and Color Difference>

The surface color (color tone) of the copper alloy to be evaluated in the color fastness test was expressed using a method of measuring an object color according to JIS Z 8722-2009 (Methods of color measurement-Reflecting and transmitting objects) and the L*a*b* color system defined in JIS Z 8729-2004 (Color specification-L*a*b* color system and L*u*v* color system). Specifically, a spectrophotometer "CM-700d", produced by Konica Minolta, Inc. was used and the L*a*b* values before and after the test were measured at 3 points by a SCI (including specular reflection light) method.

<Antimicrobial Properties>

The antimicrobial properties (bactericidal properties) were evaluated by a test method referring to JIS Z 2801 (Antimicrobial products-Test for antimicrobial activity and efficacy) and a film contact method, and the test area (film area) and the contact time were changed to conduct evaluation. *Escherichia coli* (stock No. of strain: NBRC3972) was used as the bacteria for the test. A solution, which was obtained by precultivating (as the preculture method, a method described in 5.6.a of JIS Z 2801 was used) *Escherichia coli* at 35° C.±1° C. and diluting *Escherichia coli* with 1/500 NB to adjust the number of bacteria to $1.0\times10^6$ cells/mL, was used as a test bacterial suspension. In the test method, samples were obtained by cutting from the sheet material after finish rolling, the sample after the high temperature high humidity test at 60° C. and a humidity of 95%, and the sample after the high temperature test at 120° C. for 100 hours into 20 mm×20 mm. Each sample was put into a sterilized petri dish, 0.045 mL of the above-described test bacterial suspension (*Escherichia coli:* $1.0\times10^6$ cells/mL) was added dropwise thereto, and the petri dish was covered with a φ15 mm film and then covered with a lid. The test bacterial suspension was cultivated for 10 minutes (inoculation time: 10 minutes) in the petri dish in an atmosphere of 35° C.±1° C. and a relative humidity of 95%. This cultivated test bacterial suspension was washed away with 10 mL of SCDLP culture medium to obtain a wash-away bacterial suspension. The wash-away bacterial suspension was diluted 10 times with a phosphate buffered saline solution. Standard plate count agar was added to this bacterial suspension, followed by cultivation at 35° C.±1° C. for 48 hours. When the number of colonies was more than or equal to 30, the number of colonies was measured to obtain the viable bacterial count (cfu/mL). The number of colonies at the time of inoculation (the bacterial count when the test for antimicrobial properties started; cfu/mL) was set as a criterion.

First, the viable bacterial count of each sample after the finish rolling was carried out was compared to the viable bacterial count. A case in which the rate was less than 10% was evaluated as "A". A case in which the rate was 10% to less than 33% was evaluated as "B". A case in which the rate was 33% or more was evaluated as "C". For samples which were evaluated as A (that is, the viable bacterial count of the evaluation sample was less than 1/10 of the viable bacterial count at the time of inoculation), antimicrobial properties (bactericidal properties) were evaluated to be excellent, and for samples which were evaluated as B (that is, the viable bacterial count of the evaluation sample was less than 1/3 of the viable bacterial count at the time of inoculation), antimicrobial properties (bactericidal properties) were evaluated to be satisfactory. The reason why the culture time (inoculation time) at 10 minutes was short is that the immediate activity for antimicrobial properties (bactericidal properties) was evaluated.

Next, in the evaluation of antimicrobial properties (bactericidal properties), a case in which the relationship between a viable bacterial rate $C_H$ obtained from the samples after the two color fastness tests and a case in which a viable bacterial rate $C_0$ before the color fastness tests was $C_H \leq 1.10\times C_0$ was evaluated as "A", a case in which the relationship was $1.10\times C_0 < C_H \leq 1.25\times C_0$ was evaluated as "B", and a case in which the relationship was $C_H > 1.25\times C_0$ was evaluated as "C". That is, when the color of the copper alloy is changed, there is a concern of lowering of antimicrobial performance. In the alloy of the present invention, a slight color change by the severe test at a high temperature and high humidity or at a high temperature is observed and the formation of oxides and the like on the outermost surface layer of the surface is predicted. In these samples whose color is slightly changed, compared to a sample having a clean surface before the tests, the antimicrobial performance of a sample evaluated as A or at least B is not impaired.

In addition, separately from the above evaluation, antimicrobial properties were evaluated in the following method. As a test piece (container), a material for a seam welded pipe having a thickness of 1 mm was used and the sheet material was punched by a punch to have a hole of φ125 mm. The punched sheet material was formed into a cup shape having a bottom surface of φ80 mm and a height of 50 mm by metal spinning, and washed and degreased with acetone for about 5 minutes by ultrasonic washing. A total three samples of one test piece which was used after the test piece was formed and two other test pieces of a sample obtained by subjecting a high temperature high humidity test having conditions of a temperature of 60° C. and humidity of 95% to the cup-shaped test piece and a sample obtained by subjecting a high temperature test having conditions of a temperature of 120° C. for 100 hours to the cup-shaped test piece were prepared. Regarding Alloy No. 201 as a comparative material, a material which had been sampled at a stage of 1 mm and has been subjected to a heat treatment at 430° C. for 4 hours was used.

In the antimicrobial property test, *Escherichia coli* (NBRC3972) were shake-cultured in 5 mL of a normal broth culture medium for one night at 27° C. and then 1 mL of the culture medium was centrifugally separated to obtain bacterial cells. The bacterial cells were suspended in 1 mL of sterilized saline solution (0.85%) and the suspension was diluted 1,200 times with sterilized water including the normal broth culture medium to a final concentration of 1/500. 200 mL of a suspension of a viable bacterial count of *Escherichia coli* of about $8\times10^6$ cfu/mL was poured into each of the above three kinds of test containers and left at air-conditioned room temperature (about 25° C.). After 4 hours, 0.05 mL of the suspension was collected to 4.95 mL of SCDLP culture medium "DAIGO" and diluted 10 times with 4 stages. Then, the viable bacterial count in 1 mL of each suspension was measured. When the viable bacterial count before the test was compared to the viable bacterial count after 4 hours, a case in which the rate was less than 3% was evaluated as "A". A case in which the rate was 3% to less than 10% was evaluated as "B". A case in which the rate was 10% or more was evaluated as "C". For samples which were evaluated as A (that is, the viable bacterial count of the evaluation sample was less than 1/33 of the viable bacterial count at the time of inoculation), antimicrobial properties (bactericidal properties) were evaluated to be excellent, and for samples which were evaluated as B (that is, the viable bacterial count of the evaluation sample was less than 1/10 of the viable bacterial count at the time of inoculation), antimicrobial properties (bactericidal properties) were evaluated to be satisfactory. The evaluation of maintaining antimicrobial properties (bactericidal properties) based on color change was carried out using the viable bacterial rate $C_H$.

That is, when the initial sample of the finish rolled material was evaluated as "A" and the sample after the severe test was also evaluated as "A" or at least "B", sufficient antimicrobial performance and bactericidal performance were provided in actual used apparatuses and metal fittings. A material suitable for applications such as public-based use such as public facilities, hospitals, welfare facilities, and vehicles, handrails, door handles, door knobs, and door levers, which many people use in a building or the like, medical appliances, medical containers, headboards, footboards, and water supply and drain sanitary facilities and apparatuses such as a drainage tank used in vehicles and the like can be obtained.

The evaluation results of the sheet materials are shown in Tables 6 to 25. The evaluation results of the seam welded pipes are shown in Table 26. The evaluation results of antimicrobial properties are shown in Tables 27 and 28.

TABLE 6

| | | | Structure observation | | | | Stress relaxation characteristics | | | Stress corrosion cracking | |
|---|---|---|---|---|---|---|---|---|---|---|---|
| | | | Ratio | Average | Precipitate | | 150° C. × | 120° C. × | | | |
| Test No. | Production process | Alloy No. | of α phase (%) | grain size (μm) | average particle size (nm) | Conductivity (% IACS) | 1,000 hours (%) | 1,000 hours (%) | Effective stress (N/mm²) | W Bending (Evaluation) | Stress relaxation (Evaluation) |
| 1 | A1-1 | 1 | 100 | 4 | — | 17 | 25 | A | 340 | A | B |
| 2 | A1-2 | | 100 | 4 | — | 17 | 26 | B | 333 | A | B |
| 3 | A1-3 | | 100 | 4 | — | 17 | 28 | B | 327 | A | B |
| 4 | A1-4 | | 100 | 7 | — | 17 | 23 | A | 334 | A | B |
| 5 | A2-1 | | 100 | 5 | — | 17 | 25 | B | 335 | A | B |
| 6 | A2-2 | | 100 | 5 | — | 17 | 23 | A | 341 | A | B |
| 7 | A2-3 | | 100 | 5 | — | 17 | 25 | B | 336 | A | B |
| 8 | A2-4 | | 100 | 5 | — | 16 | — | — | — | A | B |
| 9 | A2-5 | | 100 | 6 | — | 17 | 23 | A | 365 | A | B |
| 9A | A2-6 | | 100 | 6 | — | 17 | 28 | B | 344 | A | B |
| 9B | A2-7 | | 100 | 9 | — | 16 | 24 | A | 341 | A | B |
| 9C | A2-8 | | 100 | 30 | — | 16 | 27 | B | 295 | B | B |
| 9D | A2-10 | | 100 | 1.5 | — | 17 | 27 | B | 367 | A | B |
| 11 | B1-1 | | 100 | 5 | — | 17 | 25 | B | 335 | A | B |
| 12 | B1-2 | | 100 | 5 | — | 17 | 27 | B | 329 | A | B |
| 13 | B1-3 | | 100 | 5 | — | 17 | 23 | A | 344 | A | B |
| 14 | B2-1 | | 100 | 5 | — | 17 | 25 | B | 343 | A | B |
| 15 | B3-1 | | 100 | 6 | — | 17 | 26 | B | 321 | A | B |
| 15A | B3-2 | | 100 | 6 | — | 17 | 26 | B | 322 | A | B |

TABLE 7

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 1 | A1-1 | 1 | 609 | 562 | 15 | 623 | 572 | 12 | A | A | A | A |
| 2 | A1-2 | | 612 | 566 | 14 | 618 | 560 | 11 | A | A | — | — |
| 3 | A1-3 | | 618 | 573 | 13 | 622 | 562 | 10 | A | A | — | — |
| 4 | A1-4 | | 579 | 539 | 22 | 590 | 546 | 16 | A | A | — | — |
| 5 | A2-1 | | 594 | 555 | 18 | 616 | 562 | 11 | A | A | A | A |
| 6 | A2-2 | | 584 | 548 | 18 | 615 | 560 | 12 | A | A | — | — |
| 7 | A2-3 | | 596 | 555 | 16 | 622 | 564 | 11 | A | A | — | — |
| 8 | A2-4 | | 590 | 549 | 18 | 609 | 526 | 12 | A | A | A | A |
| 9 | A2-5 | | 633 | 586 | 11 | 659 | 598 | 9 | A | B | — | — |
| 9A | A2-6 | | 645 | 598 | 10 | 672 | 595 | 7 | A | B | — | — |
| 9B | A2-7 | | 600 | 552 | 12 | 622 | 570 | 11 | A | B | A | A |
| 9C | A2-8 | | 538 | 476 | 13 | 576 | 533 | 12 | A | B | — | — |
| 9D | A2-10 | | 652 | 601 | 9 | 706 | 656 | 6 | B | C | — | — |
| 10 | A3-1 | | 488 | 392 | 42 | — | — | — | A | A | — | — |
| 11 | B1-1 | | 595 | 551 | 17 | 615 | 565 | 12 | A | A | A | A |
| 12 | B1-2 | | 604 | 565 | 16 | 618 | 560 | 11 | A | A | — | — |
| 13 | B1-3 | | 589 | 550 | 18 | 615 | 567 | 12 | A | A | — | — |
| 14 | B2-1 | | 603 | 562 | 16 | 628 | 580 | 11 | A | A | A | A |
| 15 | B3-1 | | 584 | 538 | 20 | 604 | 547 | 13 | A | A | A | A |
| 15A | B3-2 | | 580 | 539 | 19 | 602 | 550 | 13 | A | A | A | A |

TABLE 8

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 16 | A1-1 | 2 | 100 | 3 | — | 15 | 21 | A | 366 | A | A |
| 17 | A1-2 | | 100 | 3 | — | 15 | 22 | A | 362 | A | A |
| 18 | A1-3 | | 100 | 3 | — | 15 | 25 | B | 349 | A | A |
| 19 | A1-4 | | 100 | 6 | — | 15 | 20 | A | 352 | A | A |
| 20 | A2-1 | | 100 | 4 | — | 15 | 21 | A | 361 | A | A |
| 21 | A2-2 | | 100 | 4 | — | 15 | 20 | A | 364 | A | A |
| 22 | A2-3 | | 100 | 4 | — | 15 | 23 | A | 354 | A | A |
| 23 | A2-4 | | 100 | 4 | — | 15 | — | — | — | A | A |
| 24 | A2-5 | | 100 | 6 | — | 15 | 20 | A | 388 | A | A |
| 26 | B1-1 | | 100 | 4 | — | 15 | 21 | A | 361 | A | A |
| 27 | B1-2 | | 100 | 4 | — | 15 | 23 | A | 356 | A | A |
| 28 | B1-3 | | 100 | 4 | — | 15 | 20 | A | 360 | A | A |
| 29 | B2-1 | | 100 | 3 | — | 15 | 21 | A | 366 | A | A |
| 30 | B3-1 | | 100 | 5 | — | 15 | 22 | A | 347 | A | A |
| 30A | B3-2 | | 100 | 5 | — | 15 | 21 | A | 351 | A | A |

TABLE 9

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 16 | A1-1 | 2 | 622 | 577 | 15 | 636 | 582 | 11 | A | A | A | A |
| 17 | A1-2 | | 625 | 581 | 13 | 632 | 579 | 10 | A | A | — | — |
| 18 | A1-3 | | 632 | 585 | 12 | 638 | 578 | 10 | A | A | — | — |
| 19 | A1-4 | | 591 | 550 | 20 | 603 | 550 | 15 | A | A | — | — |
| 20 | A2-1 | | 607 | 564 | 17 | 630 | 578 | 11 | A | A | A | A |
| 21 | A2-2 | | 609 | 561 | 17 | 626 | 575 | 11 | A | A | — | — |
| 22 | A2-3 | | 615 | 574 | 16 | 632 | 574 | 10 | A | A | — | — |
| 23 | A2-4 | | 605 | 563 | 16 | 622 | 541 | 11 | A | A | A | A |
| 24 | A2-5 | | 642 | 602 | 11 | 668 | 612 | 8 | A | B | — | — |
| 25 | A3-1 | | 531 | 445 | 36 | — | — | — | A | A | — | — |
| 26 | B1-1 | | 604 | 565 | 17 | 626 | 576 | 11 | A | A | A | A |
| 27 | B1-2 | | 617 | 574 | 15 | 626 | 581 | 10 | A | A | — | — |
| 28 | B1-3 | | 592 | 554 | 17 | 624 | 572 | 12 | A | A | — | — |
| 29 | B2-1 | | 616 | 573 | 15 | 641 | 585 | 10 | A | A | A | A |
| 30 | B3-1 | | 598 | 552 | 18 | 617 | 559 | 12 | A | A | A | A |
| 30A | B3-2 | | 592 | 551 | 18 | 612 | 560 | 12 | A | A | A | A |

TABLE 10

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 31 | A1-1 | 3 | 100 | 3 | 40 | 16 | 16 | A | 395 | A | B |
| 32 | A1-2 | | 100 | 3 | 40 | 16 | 16 | A | 397 | A | B |
| 33 | A1-3 | | 100 | 3 | 40 | 15 | 18 | A | 395 | A | B |
| 34 | A1-4 | | 100 | 6 | 50 | 16 | 12 | A | 394 | A | B |
| 35 | A2-1 | | 100 | 4 | 40 | 16 | 16 | A | 392 | A | B |
| 36 | A2-2 | | 100 | 4 | 35 | 16 | 13 | A | 404 | A | B |
| 37 | A2-3 | | 100 | 4 | 35 | 15 | 15 | A | 396 | A | B |
| 38 | A2-4 | | 100 | 4 | 40 | 15 | — | — | — | A | B |
| 39 | A2-5 | | 100 | 6 | 60 | 16 | 13 | A | 429 | A | B |
| 41 | B1-1 | | 100 | 4 | 40 | 16 | 16 | A | 392 | A | B |
| 42 | B1-2 | | 100 | 4 | 30 | 15 | 15 | A | 399 | A | B |
| 43 | B1-3 | | 100 | 4 | 30 | 16 | 12 | A | 408 | A | B |
| 44 | B2-1 | | 100 | 3 | 35 | 16 | 18 | A | 388 | A | B |
| 45 | B3-1 | | 100 | 5 | 60 | 16 | 18 | A | 373 | A | B |
| 45A | B3-2 | | 100 | 5 | 55 | 16 | 13 | A | 396 | A | B |

TABLE 11

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 31 | A1-1 | 3 | 635 | 586 | 13 | 643 | 590 | 10 | A | B | A | A |
| 32 | A1-2 | | 633 | 589 | 13 | 646 | 592 | 10 | A | B | — | — |
| 33 | A1-3 | | 640 | 597 | 12 | 662 | 606 | 9 | A | B | — | — |
| 34 | A1-4 | | 603 | 556 | 20 | 615 | 562 | 16 | A | A | — | — |

TABLE 11-continued

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 35 | A2-1 | | 624 | 580 | 16 | 638 | 586 | 11 | A | B | A | A |
| 36 | A2-2 | | 617 | 577 | 17 | 635 | 583 | 12 | A | A | — | — |
| 37 | A2-3 | | 621 | 579 | 15 | 640 | 586 | 9 | A | B | — | — |
| 38 | A2-4 | | 616 | 580 | 16 | 634 | 552 | 11 | A | B | A | A |
| 39 | A2-5 | | 651 | 611 | 11 | 686 | 622 | 9 | A | B | — | — |
| 41 | B1-1 | | 617 | 578 | 16 | 637 | 588 | 11 | A | B | A | A |
| 42 | B1-2 | | 627 | 581 | 15 | 648 | 593 | 10 | A | B | — | — |
| 43 | B1-3 | | 613 | 575 | 16 | 638 | 585 | 12 | A | A | — | — |
| 44 | B2-1 | | 628 | 587 | 14 | 655 | 597 | 10 | A | B | A | A |
| 45 | B3-1 | | 613 | 566 | 18 | 630 | 570 | 12 | A | A | A | A |
| 45A | B3-2 | | 609 | 563 | 18 | 625 | 574 | 12 | A | A | A | A |

TABLE 12

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 46 | A1-1 | 4 | 100 | 3 | 40 | 19 | 19 | A | 367 | A | A |
| 47 | A1-2 | | 100 | 3 | 40 | 19 | 19 | A | 367 | A | A |
| 48 | A1-3 | | 100 | 3 | 40 | 19 | 22 | A | 358 | A | A |
| 49 | A1-4 | | 100 | 6 | 50 | 19 | 15 | A | 364 | A | A |
| 50 | A2-1 | | 100 | 4 | 40 | 19 | 19 | A | 362 | A | A |
| 51 | A2-2 | | 100 | 4 | 30 | 19 | 16 | A | 375 | A | A |
| 52 | A2-3 | | 100 | 4 | 30 | 19 | 18 | A | 371 | A | A |
| 53 | A2-4 | | 100 | 4 | 30 | 18 | — | — | — | A | A |
| 54 | A2-5 | | 100 | 6 | 50 | 19 | 14 | A | 408 | A | A |
| 54A | A2-6 | | 100 | 6 | 50 | 18 | 19 | A | 392 | A | A |
| 54B | A2-7 | | 100 | 8 | 70 | 18 | 16 | A | 378 | A | A |
| 55C | A2-8 | | 100 | 30 | 200 | 18 | 26 | B | 297 | A | A |
| 55D | A2-9 | | 100 | 12 | 220 | 20 | 28 | B | 306 | A | B |
| 56E | A2-10 | | 100 | 1.5 | 6 | 19 | 20 | A | 404 | A | A |
| 56 | B1-1 | | 100 | 4 | 40 | 19 | 19 | A | 364 | A | A |
| 57 | B1-2 | | 100 | 4 | 30 | 18 | 19 | A | 366 | A | A |
| 58 | B1-3 | | 100 | 4 | 30 | 18 | 15 | A | 378 | A | A |
| 59 | B2-1 | | 100 | 3 | 30 | 19 | 20 | A | 366 | A | A |
| 60 | B3-1 | | 100 | 5 | 60 | 19 | 20 | A | 348 | A | A |
| 60A | B3-2 | | 100 | 5 | — | 19 | 16 | A | 370 | A | A |

TABLE 13

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 46 | A1-1 | 4 | 608 | 564 | 15 | 620 | 570 | 11 | A | A | A | A |
| 47 | A1-2 | | 611 | 566 | 14 | 621 | 568 | 10 | A | A | — | — |
| 48 | A1-3 | | 620 | 573 | 13 | 634 | 576 | 9 | A | A | — | — |
| 49 | A1-4 | | 577 | 536 | 20 | 588 | 536 | 16 | A | A | — | — |
| 50 | A2-1 | | 594 | 552 | 17 | 613 | 565 | 11 | A | A | A | A |

TABLE 13-continued

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 51 | A2-2 | | 592 | 555 | 18 | 610 | 561 | 12 | A | A | — | — |
| 52 | A2-3 | | 603 | 568 | 17 | 622 | 563 | 10 | A | A | — | — |
| 53 | A2-4 | | 590 | 548 | 17 | 609 | 528 | 11 | A | A | A | A |
| 54 | A2-5 | | 630 | 586 | 11 | 662 | 601 | 9 | A | A | — | — |
| 54A | A2-6 | | 643 | 598 | 9 | 675 | 611 | 7 | A | B | — | — |
| 54B | A2-7 | | 595 | 552 | 12 | 618 | 572 | 10 | A | A | A | A |
| 55 | A3-1 | | 470 | 372 | 41 | — | — | — | A | A | — | — |
| 55C | A2-8 | | 533 | 472 | 13 | 574 | 530 | 11 | A | B | — | — |
| 55D | A2-9 | | 563 | 500 | 12 | 622 | 562 | 8 | A | B | — | — |
| 56E | A2-10 | | 658 | 601 | 9 | 717 | 660 | 6 | B | C | — | — |
| 56 | B1-1 | | 594 | 558 | 18 | 616 | 564 | 11 | A | A | A | A |
| 57 | B1-2 | | 601 | 562 | 17 | 620 | 569 | 10 | A | A | — | — |
| 58 | B1-3 | | 587 | 548 | 18 | 612 | 563 | 12 | A | A | — | — |
| 59 | B2-1 | | 604 | 566 | 15 | 633 | 577 | 10 | A | A | A | A |
| 60 | B3-1 | | 585 | 538 | 19 | 607 | 550 | 13 | A | A | A | A |
| 60A | B3-2 | | 590 | 543 | 18 | 608 | 558 | 12 | A | A | — | — |

TABLE 14

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 61 | A2-1 | 5 | 100 | 4 | 50 | 21 | 20 | A | 351 | A | A |
| 62 | A2-2 | | 100 | 4 | — | 21 | 15 | A | 370 | A | A |
| 63 | A2-3 | | 100 | 4 | — | 21 | 19 | A | 362 | A | A |
| 64 | A2-4 | | 100 | 4 | — | 20 | — | — | — | A | A |
| 65 | A2-5 | | 100 | 6 | — | 21 | 14 | A | 402 | A | A |
| 67 | B1-1 | | 100 | 4 | 50 | 21 | 20 | A | 351 | A | A |
| 68 | B1-2 | | 100 | 4 | — | 21 | 19 | A | 360 | A | A |
| 69 | B1-3 | | 100 | 4 | — | 21 | 14 | A | 375 | A | A |
| 70 | B2-1 | | 100 | 4 | 40 | 21 | 22 | A | 348 | A | A |
| 71 | B3-1 | | 100 | 5 | 60 | 21 | 20 | A | 342 | A | A |
| 71A | B3-2 | | 100 | 5 | — | 21 | 16 | A | 360 | A | A |
| 72 | A2-1 | 6 | 100 | 3 | 35 | 18 | 17 | A | 379 | A | A |
| 72A | A2-2 | | 100 | 3 | — | — | 14 | A | 392 | A | A |
| 74 | B1-1 | | 100 | 4 | 35 | 18 | 15 | A | 377 | A | B |
| 75 | A2-1 | 7 | 100 | 4 | — | 16 | 21 | A | 358 | A | A |
| 77 | B1-1 | | 100 | 4 | — | 17 | 23 | A | 345 | A | A |
| 78 | A2-1 | 8 | 100 | 3 | 35 | 18 | 28 | B | 333 | A | B |
| 78A | A2-2 | | 99.9 | 4 | — | — | 30 | B | 321 | B | B |
| 80 | B1-1 | | 100 | 4 | 40 | 18 | 27 | B | 327 | A | B |

TABLE 15

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 61 | A2-1 | 5 | 580 | 546 | 17 | 601 | 550 | 11 | A | A | A | B |
| 62 | A2-2 | | 579 | 540 | 18 | 596 | 548 | 12 | A | A | — | — |
| 63 | A2-3 | | 592 | 561 | 16 | 606 | 556 | 10 | A | A | — | — |
| 64 | A2-4 | | 580 | 540 | 17 | 595 | 518 | 11 | A | A | A | B |
| 65 | A2-5 | | 618 | 576 | 12 | 654 | 593 | 9 | A | A | — | — |

TABLE 15-continued

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 67 | B1-1 | | 580 | 542 | 18 | 603 | 555 | 11 | A | A | A | B |
| 68 | B1-2 | | 590 | 547 | 17 | 613 | 565 | 9 | A | A | — | — |
| 69 | B1-3 | | 576 | 538 | 18 | 599 | 553 | 12 | A | A | — | — |
| 70 | B2-1 | | 590 | 552 | 16 | 614 | 563 | 10 | A | A | A | B |
| 71 | B3-1 | | 572 | 531 | 19 | 593 | 538 | 12 | A | A | A | B |
| 71A | B3-2 | | 570 | 530 | 19 | 588 | 540 | 12 | A | A | — | — |
| 72 | A2-1 | 6 | 610 | 568 | 16 | 626 | 574 | 11 | A | A | A | A |
| 72A | A2-2 | | 606 | 563 | 16 | 622 | 576 | 11 | A | A | A | A |
| 74 | B1-1 | | 595 | 552 | 19 | 611 | 558 | 13 | A | A | A | A |
| 75 | A2-1 | 7 | 604 | 564 | 15 | 622 | 569 | 12 | A | A | A | A |
| 77 | B1-1 | | 592 | 553 | 18 | 615 | 566 | 13 | A | A | A | A |
| 78 | A2-1 | 8 | 618 | 576 | 15 | 640 | 580 | 10 | A | B | A | A |
| 78A | A2-2 | | 614 | 572 | 15 | 635 | 576 | 9 | A | B | — | — |
| 80 | B1-1 | | 599 | 556 | 16 | 623 | 563 | 10 | A | B | A | A |

TABLE 16

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 101 | C1 | 11 | 100 | 5 | — | 17 | 30 | B | 319 | B | B |
| 102 | C1 | 12 | 100 | 4 | — | 19 | 26 | B | 340 | B | B |
| 103 | C1 | 13 | 100 | 4 | — | 18 | 27 | B | 339 | A | B |
| 104 | C1 | 14 | 100 | 4 | 30 | 18 | 20 | A | 364 | B | B |
| 105 | C1 | 15 | 100 | 5 | — | 17 | 28 | B | 321 | B | B |
| 106 | C1 | 16 | 100 | 3 | 25 | 20 | 21 | A | 355 | A | B |
| 106A | C1A | 16 | 100 | 3 | 30 | 19 | 17 | A | 372 | A | B |
| 107 | C1 | 17 | 100 | 4 | — | 15 | 22 | A | 353 | A | B |
| 108 | C1 | 18 | 100 | 4 | — | 20 | 22 | A | 342 | A | A |
| 109 | C1 | 19 | 100 | 4 | — | 17 | 23 | A | 345 | A | A |
| 110 | C1 | 20 | 100 | 4 | — | 22 | 29 | B | 309 | A | B |
| 111 | C1 | 21 | 100 | 4 | — | 14 | 19 | A | 362 | A | A |
| 112 | C1 | 22 | 100 | 3 | — | 18 | 15 | A | 379 | A | A |
| 113 | C1 | 23 | 100 | 5 | — | 19 | 24 | A | 328 | A | A |
| 114 | C1 | 24 | 100 | 5 | — | 22 | 28 | B | 308 | A | A |
| 115 | C1 | 25 | 100 | 4 | — | 14 | 23 | A | 349 | A | A |
| 116 | C1 | 26 | 100 | 5 | — | 18 | 22 | A | 341 | A | A |
| 117 | C1 | 27 | 100 | 4 | — | 18 | 17 | A | 366 | A | A |
| 117A | C1A | 27 | 100 | 4 | — | 17 | 13 | A | 385 | A | A |

TABLE 17

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 101 | C1 | 11 | 602 | 563 | 16 | 636 | 578 | 10 | A | B | A | A |
| 102 | C1 | 12 | 612 | 569 | 16 | 643 | 580 | 10 | A | B | B | B |
| 103 | C1 | 13 | 623 | 577 | 15 | 643 | 583 | 10 | A | B | A | B |
| 104 | C1 | 14 | 607 | 565 | 16 | 631 | 574 | 11 | A | A | A | A |
| 105 | C1 | 15 | 598 | 550 | 17 | 621 | 563 | 12 | A | A | A | A |
| 106 | C1 | 16 | 604 | 558 | 16 | 624 | 565 | 10 | A | A | B | B |

TABLE 17-continued

| | | | Direction parallel with rolling direction | | | Direction orthogonal to rolling direction | | | | | Color fastness | |
|---|---|---|---|---|---|---|---|---|---|---|---|---|
| | | | | | | | | | Bending workability | | High temperature high | High |
| Test No. | Production process | Alloy No. | Tensile strength $TS_p$ ($N/mm^2$) | Proof stress $YS_p$ ($N/mm^2$) | Elongation (%) | Tensile strength $TS_o$ ($N/mm^2$) | Proof stress $YS_o$ ($N/mm^2$) | Elongation (%) | Good Way (Evaluation) | Bad Way (Evaluation) | humidity test (Evaluation) | temperature test (Evaluation) |
| 106A | C1A | 16 | 600 | 555 | 17 | 622 | 565 | 11 | A | A | A | B |
| 107 | C1 | 17 | 605 | 560 | 17 | 629 | 571 | 11 | A | A | A | A |
| 108 | C1 | 18 | 588 | 543 | 17 | 610 | 554 | 12 | A | A | A | B |
| 109 | C1 | 19 | 600 | 557 | 17 | 623 | 564 | 11 | A | A | A | A |
| 110 | C1 | 20 | 582 | 550 | 18 | 592 | 537 | 12 | A | A | B | B |
| 111 | C1 | 21 | 600 | 554 | 17 | 618 | 563 | 11 | A | A | A | A |
| 112 | C1 | 22 | 600 | 552 | 16 | 620 | 564 | 11 | A | B | A | A |
| 113 | C1 | 23 | 583 | 534 | 18 | 600 | 545 | 12 | A | A | A | A |
| 114 | C1 | 24 | 568 | 526 | 18 | 586 | 544 | 12 | A | A | B | B |
| 115 | C1 | 25 | 605 | 563 | 16 | 626 | 571 | 10 | A | A | A | A |
| 116 | C1 | 26 | 580 | 541 | 17 | 604 | 551 | 12 | A | A | A | B |
| 117 | C1 | 27 | 589 | 540 | 18 | 621 | 563 | 12 | A | A | A | A |
| 117A | C1A | 27 | 590 | 542 | 19 | 624 | 565 | 12 | A | A | A | A |

TABLE 18

| | | | Structure observation | | | | Stress relaxation characteristics | | | Stress corrosion cracking | |
|---|---|---|---|---|---|---|---|---|---|---|---|
| Test No. | Production process | Alloy No. | Ratio of α phase (%) | Average grain size (μm) | Precipitate average particle size (nm) | Conductivity (% IACS) | 150° C. × 1,000 hours (%) | 120° C. × 1,000 hours (%) | Effective stress ($N/mm^2$) | W Bending (Evaluation) | Stress relaxation (Evaluation) |
| 118 | C1 | 28 | 100 | 3 | 20 | 19 | 19 | A | 369 | A | B |
| 119 | C1 | 29 | 100 | 2.5 | 10 | 18 | 21 | A | 366 | A | B |
| 120 | C1 | 30 | 100 | 3 | 15 | 18 | 19 | A | 369 | A | A |
| 121 | C1 | 31 | 100 | 3 | — | 17 | 25 | A | 340 | A | B |
| 122 | C1 | 32 | 100 | 4 | — | 16 | 24 | A | 341 | A | B |
| 123 | C1 | 33 | 100 | 3 | — | 16 | 17 | A | 388 | B | B |
| 124 | C1 | 34 | 100 | 4 | — | 18 | 19 | A | 363 | A | B |
| 125 | C1 | 35 | 100 | 3 | — | 17 | 25 | A | 341 | A | B |
| 126 | C1 | 36 | 100 | 3 | — | 19 | 19 | A | 369 | A | B |
| 127 | C1 | 37 | 100 | 4 | — | 16 | 24 | A | 340 | A | B |
| 128 | C1 | 38 | 100 | 4 | — | 16 | 17 | A | 384 | A | A |
| 129 | C1 | 39 | 100 | 4 | — | 17 | 25 | B | 338 | A | A |
| 130 | C1 | 40 | 100 | 4 | — | 18 | 19 | A | 360 | B | B |
| 131 | C1 | 41 | 100 | 4 | — | 15 | 21 | A | 362 | A | A |
| 132 | C1 | 42 | 100 | 4 | — | 16 | 24 | A | 342 | A | A |
| 133 | C1 | 43 | 100 | 5 | — | 21 | 26 | B | 307 | A | B |
| 134 | C1 | 44 | 100 | 3 | — | 18 | 27 | B | 334 | A | B |
| 135 | C1 | 45 | 100 | 4 | — | 17 | 20 | A | 364 | A | A |

TABLE 19

| | | | Direction parallel with rolling direction | | | Direction orthogonal to rolling direction | | | | | Color fastness | |
|---|---|---|---|---|---|---|---|---|---|---|---|---|
| | | | | | | | | | Bending workability | | High temperature high | High |
| Test No. | Production process | Alloy No. | Tensile strength $TS_p$ ($N/mm^2$) | Proof stress $YS_p$ ($N/mm^2$) | Elongation (%) | Tensile strength $TS_o$ ($N/mm^2$) | Proof stress $YS_o$ ($N/mm^2$) | Elongation (%) | Good Way (Evaluation) | Bad Way (Evaluation) | humidity test (Evaluation) | temperature test (Evaluation) |
| 118 | C1 | 28 | 604 | 567 | 17 | 626 | 573 | 10 | A | A | A | B |
| 119 | C1 | 29 | 619 | 568 | 16 | 640 | 591 | 10 | A | B | A | A |
| 120 | C1 | 30 | 609 | 568 | 16 | 631 | 572 | 10 | A | A | A | A |

TABLE 19-continued

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 121 | C1 | 31 | 603 | 558 | 16 | 632 | 575 | 10 | A | A | A | A |
| 122 | C1 | 32 | 595 | 556 | 17 | 620 | 565 | 11 | A | A | A | A |
| 123 | C1 | 33 | 623 | 583 | 15 | 645 | 587 | 10 | A | B | A | A |
| 124 | C1 | 34 | 598 | 553 | 18 | 617 | 566 | 12 | A | A | A | A |
| 125 | C1 | 35 | 608 | 563 | 16 | 632 | 574 | 11 | A | A | A | A |
| 126 | C1 | 36 | 606 | 568 | 16 | 630 | 570 | 11 | A | A | A | B |
| 127 | C1 | 37 | 593 | 553 | 18 | 621 | 565 | 12 | A | A | A | A |
| 128 | C1 | 38 | 614 | 574 | 16 | 634 | 582 | 11 | A | B | A | A |
| 129 | C1 | 39 | 602 | 558 | 17 | 624 | 570 | 11 | A | A | A | A |
| 130 | C1 | 40 | 597 | 551 | 19 | 618 | 561 | 11 | A | A | A | A |
| 131 | C1 | 41 | 608 | 569 | 17 | 632 | 575 | 11 | A | A | A | A |
| 132 | C1 | 42 | 600 | 558 | 17 | 626 | 567 | 12 | A | A | A | A |
| 133 | C1 | 43 | 553 | 513 | 17 | 571 | 524 | 13 | A | A | B | B |
| 134 | C1 | 44 | 613 | 561 | 15 | 642 | 582 | 11 | A | B | A | B |
| 135 | C1 | 45 | 610 | 565 | 16 | 630 | 572 | 11 | A | A | A | A |

TABLE 20

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Stress relaxation characteristics: Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 201 | A2-1 | 101 | 99.6 | 4 | — | 17 | 42 | C | 267 | C | C |
| 202 | A2-2 | | 99.5 | 4 | — | 17 | 43 | C | 261 | C | C |
| 203 | A2-3 | | 99.5 | 4 | — | 17 | 48 | C | 242 | C | C |
| 204 | A2-4 | | 99.5 | 4 | — | 16 | — | — | — | C | C |
| 205 | A2-5 | | 99.1 | 4 | — | 17 | 42 | C | 286 | C | C |
| 207 | B1-1 | | 99.6 | 4 | — | 17 | 42 | C | 268 | C | C |
| 208 | B1-2 | | 99.5 | 4 | — | 17 | 45 | C | 259 | C | C |
| 209 | B1-3 | | 99.5 | 4 | — | 17 | 44 | C | 257 | C | C |
| 210 | B2-1 | | 99.5 | 3 | — | 17 | 43 | C | 269 | C | C |
| 211 | B3-1 | | 99.8 | 5 | — | 17 | 39 | C | 274 | B | C |
| 212 | A2-1 | 102 | 99.7 | 3 | 50 | 19 | 41 | C | 273 | C | B |
| 212A | A2-2 | | 99.3 | 4 | — | — | 44 | C | 259 | C | C |
| 214 | B1-1 | | 99.8 | 4 | 50 | 19 | 37 | C | 287 | B | C |

TABLE 21

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 201 | A2-1 | 101 | 610 | 568 | 15 | 650 | 582 | 8 | A | C | A | B |
| 202 | A2-2 | | 616 | 569 | 15 | 645 | 577 | 8 | A | C | — | — |
| 203 | A2-3 | | 623 | 577 | 12 | 655 | 585 | 6 | B | C | — | — |
| 204 | A2-4 | | 610 | 566 | 14 | 638 | 550 | 7 | B | C | B | B |
| 205 | A2-5 | | 650 | 581 | 8 | 705 | 653 | 3 | B | C | — | — |
| 207 | B1-1 | | 621 | 567 | 14 | 659 | 589 | 8 | A | C | B | B |
| 208 | B1-2 | | 618 | 578 | 14 | 665 | 597 | 7 | B | C | — | — |
| 209 | B1-3 | | 608 | 566 | 15 | 643 | 582 | 8 | A | C | — | — |
| 210 | B2-1 | | 624 | 579 | 13 | 665 | 600 | 6 | A | C | B | B |
| 211 | B3-1 | | 601 | 554 | 16 | 632 | 569 | 10 | A | B | B | B |

TABLE 21-continued

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 212 | A2-1 | 102 | 620 | 568 | 14 | 663 | 590 | 7 | A | C | B | B |
| 212A | A2-2 | | 624 | 570 | 12 | 675 | 588 | 7 | B | C | — | — |
| 214 | B1-1 | | 603 | 557 | 17 | 648 | 580 | 8 | A | B | B | B |

TABLE 22

| Test No. | Production process | Alloy No. | Structure observation: Ratio of α phase (%) | Structure observation: Average grain size (μm) | Structure observation: Precipitate average particle size (nm) | Conductivity (% IACS) | Stress relaxation characteristics: 150° C. × 1,000 hours (%) | Stress relaxation characteristics: 120° C. × 1,000 hours (%) | Effective stress (N/mm$^2$) | Stress corrosion cracking: W Bending (Evaluation) | Stress corrosion cracking: Stress relaxation (Evaluation) |
|---|---|---|---|---|---|---|---|---|---|---|---|
| 301 | C1 | 103 | 100 | 5 | — | 21 | 43 | C | 246 | C | C |
| 301A | C1A | 103 | 99.9 | 5 | — | 20 | 45 | C | 238 | C | C |
| 302 | C1 | 104 | 100 | 5 | — | 23 | 49 | C | 214 | C | C |
| 303 | C1 | 105 | 100 | 3 | — | 14 | 36 | C | 302 | C | C |
| 303A | C1A | 105 | 99.7 | 3 | — | 14 | 42 | C | 276 | C | C |
| 304 | C1 | 106 | 100 | 4 | — | 13 | 39 | C | 291 | B | C |
| 305 | C1 | 107 | 99.7 | 4 | — | 14 | 43 | C | 269 | B | B |
| 306 | C1 | 108 | 100 | 2 | — | 20 | 35 | C | 296 | B | C |
| 307 | C1 | 109 | 99.7 | 4 | — | 18 | 40 | C | 275 | B | C |
| 307A | C1A | 109 | 99 | 4 | — | 18 | 48 | C | 240 | C | C |
| 308 | C1 | 110 | 99.7 | 4 | — | 17 | 45 | C | 247 | C | C |
| 309 | C1 | 111 | 100 | 6 | — | 23 | 48 | C | 215 | B | C |
| 310 | C1 | 112 | 100 | 4 | — | 20 | 35 | C | 286 | C | C |
| 311 | C1 | 113 | 99.5 | 4 | — | 14 | 42 | C | 273 | B | C |
| 312 | C1 | 114 | 100 | 4 | — | 18 | 41 | C | 268 | B | B |
| 313 | C1 | 115 | 100 | 5 | — | 19 | 47 | C | 235 | C | C |
| 314 | C1 | 116 | 99.5 | 3 | — | 16 | 41 | C | 275 | C | C |
| 315 | C1 | 117 | 99.2 | 4 | — | 17 | 54 | C | 209 | C | C |
| 316 | C1 | 118 | 99.4 | 3 | — | 18 | 50 | C | 231 | C | C |
| 317 | C1 | 119 | 100 | 6 | — | 24 | 33 | B | 256 | A | A |
| 318 | C1 | 120 | 100 | 1.5 | 2 | 18 | 28 | B | 357 | B | B |
| 319 | C1 | 121 | 100 | 1.5 | 2 | 17 | 27 | B | 359 | B | B |
| 320 | C1 | 122 | 100 | 6 | — | 21 | 49 | C | 214 | B | C |
| 321 | C1 | 123 | 100 | 8 | — | 23 | 39 | C | 239 | A | A |
| 322 | C1 | 124 | 100 | 6 | — | 23 | 32 | B | 269 | A | A |
| 323 | C1 | 125 | 100 | 6 | — | 20 | 34 | C | 264 | A | A |
| 324 | C1 | 126 | 100 | 2.5 | — | 19 | 29 | B | 339 | A | B |

TABLE 23

| Test No. | Production process | Alloy No. | Direction parallel with rolling direction: Tensile strength $TS_p$ (N/mm$^2$) | Direction parallel with rolling direction: Proof stress $YS_p$ (N/mm$^2$) | Direction parallel with rolling direction: Elongation (%) | Direction orthogonal to rolling direction: Tensile strength $TS_o$ (N/mm$^2$) | Direction orthogonal to rolling direction: Proof stress $YS_o$ (N/mm$^2$) | Direction orthogonal to rolling direction: Elongation (%) | Bending workability: Good Way (Evaluation) | Bending workability: Bad Way (Evaluation) | Color fastness: High temperature high humidity test (Evaluation) | Color fastness: High temperature test (Evaluation) |
|---|---|---|---|---|---|---|---|---|---|---|---|---|
| 301 | C1 | 103 | 577 | 536 | 17 | 596 | 545 | 11 | A | A | C | B |
| 301A | C1A | 103 | 582 | 538 | 16 | 608 | 544 | 8 | A | B | C | B |
| 302 | C1 | 104 | 560 | 515 | 18 | 588 | 532 | 11 | A | A | C | C |
| 303 | C1 | 105 | 628 | 578 | 13 | 672 | 603 | 7 | A | C | B | B |
| 303A | C1A | 105 | 635 | 582 | 13 | 680 | 607 | 6 | B | C | B | B |
| 304 | C1 | 106 | 635 | 583 | 12 | 680 | 610 | 6 | B | C | B | A |
| 305 | C1 | 107 | 631 | 580 | 12 | 677 | 601 | 6 | B | C | B | B |

TABLE 23-continued

| | | | Direction parallel with rolling direction | | | Direction orthogonal to rolling direction | | | | | Color fastness | |
|---|---|---|---|---|---|---|---|---|---|---|---|---|
| | | | Tensile strength | Proof stress | Elon- | Tensile strength | Proof stress | Elon- | Bending workability | | High temperature high humidity | High temperature |
| Test No. | Production process | Alloy No. | $TS_p$ (N/mm$^2$) | $YS_p$ (N/mm$^2$) | gation (%) | $TS_o$ (N/mm$^2$) | $YS_o$ (N/mm$^2$) | gation (%) | Good Way (Evaluation) | Bad Way (Evaluation) | test (Evaluation) | test (Evaluation) |
| 306 | C1 | 108 | 604 | 556 | 14 | 644 | 581 | 8 | A | C | B | B |
| 307 | C1 | 109 | 608 | 560 | 13 | 656 | 584 | 7 | A | C | C | C |
| 307A | C1A | 109 | 616 | 561 | 10 | 667 | 592 | 6 | B | C | C | C |
| 308 | C1 | 110 | 600 | 551 | 14 | 642 | 572 | 8 | A | C | C | B |
| 309 | C1 | 111 | 554 | 510 | 18 | 577 | 525 | 13 | A | A | C | C |
| 310 | C1 | 112 | 589 | 540 | 17 | 628 | 559 | 9 | A | C | B | B |
| 311 | C1 | 113 | 632 | 580 | 12 | 670 | 598 | 7 | B | C | C | B |
| 312 | C1 | 114 | 603 | 560 | 13 | 647 | 577 | 7 | A | C | A | B |
| 313 | C1 | 115 | 591 | 544 | 15 | 630 | 566 | 7 | A | C | B | B |
| 314 | C1 | 116 | 620 | 573 | 13 | 662 | 592 | 6 | A | C | C | B |
| 315 | C1 | 117 | 608 | 559 | 14 | 651 | 578 | 7 | A | C | C | B |
| 316 | C1 | 118 | 614 | 568 | 13 | 660 | 585 | 6 | A | C | C | C |
| 317 | C1 | 119 | 515 | 473 | 19 | 540 | 483 | 14 | A | A | C | C |
| 318 | C1 | 120 | 651 | 601 | 13 | 718 | 640 | 5 | B | C | A | A |
| 319 | C1 | 121 | 643 | 597 | 14 | 706 | 632 | 6 | A | C | A | A |
| 320 | C1 | 122 | 550 | 516 | 18 | 584 | 532 | 12 | A | A | C | B |
| 321 | C2 | 123 | 525 | 483 | 18 | 547 | 496 | 13 | A | A | B | C |
| 322 | C3 | 124 | 534 | 488 | 16 | 555 | 501 | 12 | A | A | B | C |
| 323 | C4 | 125 | 537 | 495 | 17 | 560 | 504 | 13 | A | A | B | B |
| 324 | C5 | 126 | 638 | 582 | 12 | 679 | 610 | 8 | A | C | A | B |

TABLE 24

| | | | Structure observation | | | | Stress relaxation characteristics | | | Stress corrosion cracking | |
|---|---|---|---|---|---|---|---|---|---|---|---|
| | | | Ratio of α phase | Average grain size | Precipitate average particle size | | 150° C. × 1,000 hours | 120° C. × 1,000 hours | | | |
| Test No. | Production process | Alloy No. | (%) | (μm) | (nm) | Conductivity (% IACS) | (%) | (%) | Effective stress (N/mm$^2$) | W Bending (Evaluation) | Stress relaxation (Evaluation) |
| 401 | C2 | 201 | 100 | 7 | — | 28 | 85 | C | 58 | C | C |
| 402 | C2 | 202 | 100 | 6 | — | 29 | 80 | C | 77 | B | C |
| 403 | C2 | 203 | 100 | 7 | — | 31 | 76 | C | 91 | A | B |
| 404 | C2 | 204 | 100 | 9 | — | 34 | 72 | C | 100 | A | A |
| 405 | — | 205 | 100 | 12 | — | 12 | 59 | C | 189 | A | A |

TABLE 25

| | | | Direction parallel with rolling direction | | | Direction orthogonal to rolling direction | | | | | Color fastness | |
|---|---|---|---|---|---|---|---|---|---|---|---|---|
| | | | Tensile strength | Proof stress | Elon- | Tensile strength | Proof stress | Elon- | Bending workability | | High temperature high humidity | High temperature |
| Test No. | Production process | Alloy No. | $TS_p$ (N/mm$^2$) | $YS_p$ (N/mm$^2$) | gation (%) | $TS_o$ (N/mm$^2$) | $YS_o$ (N/mm$^2$) | gation (%) | Good Way (Evaluation) | Bad Way (Evaluation) | test (Evaluation) | test (Evaluation) |
| 401 | C2 | 201 | 520 | 478 | 15 | 555 | 490 | 10 | A | B | C | C |
| 402 | C2 | 202 | 518 | 480 | 15 | 547 | 487 | 11 | A | B | C | C |
| 403 | C2 | 203 | 500 | 472 | 15 | 517 | 473 | 11 | A | A | C | C |
| 404 | C2 | 204 | 472 | 445 | 13 | 490 | 450 | 10 | A | A | C | C |
| 405 | — | 205 | 635 | 564 | 24 | 665 | 591 | 16 | A | B | C | C |

TABLE 26

| Test No. | Production process | Alloy No. | Structure observation (board) Ratio of α phase (%) | Structure observation (board) Average grain size (μm) | Structure observation (seam welded pipe) α phase (%) | Structure observation (seam welded pipe) β phase (%) | Structure observation (seam welded pipe) γ phase (%) | Conductivity (% IACS) | Mechanical strength of the seam welded pipe, workability: Tensile strength TS (N/mm$^2$) | Proof stress YS (N/mm$^2$) | Elongation (%) | Flattening test (Evaluation) | Pipe expansion (Evaluation) | Stress corrosion cracking (Evaluation) |
|---|---|---|---|---|---|---|---|---|---|---|---|---|---|---|
| 10 | A3-1 | 1 | 100 | 15 | 100 | 0 | 0 | 17 | 488 | 392 | 42 | A | A | A |
| 25 | A3-1 | 2 | 100 | 12 | 100 | 0 | 0 | 15 | 531 | 445 | 36 | A | A | A |
| 40 | A3-1 | 3 | 100 | 10 | 100 | 0 | 0 | 16 | 540 | 458 | 37 | A | A | A |
| 55 | A3-1 | 4 | 100 | 18 | 100 | 0 | 0 | 19 | 470 | 372 | 41 | A | A | A |
| 66 | A3-1 | 5 | 100 | 15 | 100 | 0 | 0 | 21 | 475 | 366 | 41 | A | A | A |
| 73 | A3-1 | 6 | 100 | 12 | 100 | 0 | 0 | 18 | 512 | 423 | 40 | A | A | — |
| 76 | A3-1 | 7 | 100 | 10 | 100 | 0 | 0 | 16 | 526 | 440 | 38 | A | A | A |
| 79 | A3-1 | 8 | 100 | 12 | 99.8 | 0.1 | 0.1 | 18 | 520 | 433 | 29 | A | A | B |
| 206 | A3-1 | 101 | 99.6 | 10 | 98.9 | 0.7 | 0.4 | 17 | 540 | 455 | 30 | C | C | C |
| 213 | A3-1 | 102 | 99.6 | — | 99.3 | 0.6 | 0.1 | 19 | 525 | 441 | 32 | C | C | C |

TABLE 27

| Test No. | Production process | Alloy No. | Antimicrobial test: After finish rolling (Evaluation) | After high temperature high humidity test (Evaluation) | After high temperature test (Evaluation) |
|---|---|---|---|---|---|
| 5 | A2-1 | 1 | A | A | A |
| 20 | A2-1 | 2 | A | A | A |
| 35 | A2-1 | 3 | A | A | A |
| 50 | A2-1 | 4 | A | A | A |
| 61 | A2-1 | 5 | A | A | A |
| 72 | A2-1 | 6 | A | A | A |
| 75 | A2-1 | 7 | A | A | A |
| 78 | A2-1 | 8 | A | A | A |
| 201 | A2-1 | 101 | B | B | — |
| 212 | A2-1 | 102 | B | — | A |
| 401 | C2 | 201 | A | B | B |

TABLE 28

| Test No. | Production process | Alloy No. | Antimicrobial test: After finish rolling (Evaluation) | After high temperature high humidity test (Evaluation) | After high temperature test (Evaluation) |
|---|---|---|---|---|---|
| 10 | A3-1 | 1 | A | A | A |
| 25 | A3-1 | 2 | A | A | A |
| 40 | A3-1 | 3 | A | A | A |
| 55 | A3-1 | 4 | A | A | A |
| 73 | A3-1 | 6 | A | A | A |
| 76 | A3-1 | 7 | A | A | A |
| 206 | A3-1 | 101 | B | — | B |
| 402 | C2 | 202 | A | B | B |

From the above evaluation results, regarding the compositions, the composition relational expression and the characteristics, the following was confirmed.

Due to the fact that all conditions of containing 17 mass % to 34 mass % of Zn, 0.02 mass % to 2.0 mass % of Sn, 1.5 mass % to 5 mass % of Ni, and a balance consisting of Cu and unavoidable impurities, satisfying relationships of $12 \leq f1 \leq 30$, $10 \leq f2 \leq 28$, $10 \leq f3 \leq 33$, $1.2 \leq f4 \leq 4$ and $1.4 \leq f5 \leq 90$, and having a metallographic structure in which a ratio of an α phase in the constituent phase of the metallographic structure is 99.5% or more by area ratio, and the like were satisfied, a Cu—Zn alloy containing a high concentration of Zn and having excellent color fastness, high strength, good bending workability, satisfactory color fastness, stress relaxation characteristics and stress corrosion cracking resistance at a high temperature and high humidity or at a high temperature was obtained (refer to test Nos. 5, 20, 109, 113 and the like).

Additionally, when the alloy contains Sb, As, P and Al, color fastness and stress corrosion cracking resistance were further improved (refer to test Nos. 50, 72, 75, 122, 128 to 131 and the like).

Due to the fact that conditions of containing 18 mass % to 33 mass % of Zn, 0.2 mass % to 1.5 mass % of Sn, 1.5 mass % to 4 mass % of Ni, and a balance consisting of Cu and unavoidable impurities, satisfying relationships of $15 \leq f1 \leq 30$, $12 \leq f2 \leq 28$, $10 \leq f3 \leq 30$, $1.4 \leq f4 \leq 3.6$ and $1.6 \leq f5 \leq 12$, and having a metallographic structure composed of an α single phase were satisfied, excellent color fastness, high strength, good bending workability, and excellent stress relaxation characteristics were obtained. Therefore, a Cu—Zn alloy containing a high concentration of Zn and having high effective stress in a use environment at a high temperature, and satisfactory stress corrosion cracking resistance in a state in which stress close to the elastic limit of the material was loaded and in a state in which high residual stress was present was obtained (refer to test Nos. 5, 20, 107 and the like).

Additionally, due to the fact that conditions of containing 0.003 mass % to 0.08 mass % of P and satisfying a relationship of $25 \leq [Ni]/[P] \leq 750$ were satisfied, stress relaxation characteristics were further improved, stress corrosion cracking resistance and color fastness were also improved (refer to test Nos. 35, 50, 72 and the like).

When the amount of Zn was more than 34 mass %, bending workability was deteriorated and stress relaxation characteristics, stress corrosion cracking resistance and color fastness were deteriorated. When the amount of Zn was less than 17 mass %, strength was lowered and color fastness was also deteriorated (refer to test Nos. 303, 303A, 304, 317 and the like).

When the amount of Ni was less than 1.5 mass %, stress relaxation characteristics, stress corrosion cracking resistance and color fastness were deteriorated. When the amount of Ni was more than 1.5 mass %, stress relaxation characteristics, stress corrosion cracking resistance and color fastness were improved (refer to test Nos. 301, 301A, 302, 320, 102, 110 and the like).

When the amount of Sn was less than 0.02 mass %, strength was lowered and stress relaxation characteristics were deteriorated. When the amount of Sn was 0.2 mass % or more, strength was increased and color fastness and stress relaxation characteristics were improved. When the amount of Sn was more than 0.2 mass %, hot workability and bending workability were deteriorated, and stress relaxation characteristics and stress corrosion cracking resistance were deteriorated. When the amount of Sn was 1.5 mass % or less, hot workability and bending workability were impaired, and stress relaxation characteristics and stress corrosion cracking resistance were improved. In Test No. 305, since edge cracking occurred at the time of hot rolling, the cracked portion was removed and then the subsequent process was carried out (refer to test Nos. 110, 101, 104, 130, 305, 309, 321, 322 and the like).

In the composition relational expression $f1=[Zn]+5\times[Sn]-2\times[Ni]$, when the value was greater than 30, β and γ phases other than an α phase appeared and bending workability, stress relaxation characteristics, stress corrosion cracking resistance, color fastness and antimicrobial properties (bactericidal properties) were deteriorated. In addition, it was found that the value of the composition relational expression $f1=[Zn]+5\times[Sn]-2\times[Ni]$ was a boundary value for determining whether bending workability, stress relaxation characteristics, stress corrosion cracking resistance and color fastness are good or not (refer to test Nos. 50, 56, 80, 101 to 105, 307, 307A, 308, 314 to 316 and the like).

In the sheet material, when the ratio of the α phase was less than 99.5% or less than 99.8%, bending workability, stress relaxation characteristics, stress corrosion cracking resistance, color fastness and antimicrobial properties were deteriorated. However, when the ratio of the α phase was 100%, these characteristics were improved and balance among tensile strength, proof stress and elongation was good. Further, when the ratio of the α phase was 100%, in samples collected from directions parallel with and perpendicular to the rolling direction, the ratio of tensile strength in the collection directions, the ratio of proof stress, and the ratio between tensile strength and proof stress in the same collection direction were close to 1 (refer to test Nos. 50, 56, 80, 101 to 105, 307, 307A, 308, 311, 314 to 316, and the like).

In the seam welded pipe, when the ratio of the α phase in the constituent phase of the metallographic structure of the original sheet material was less than 99.8%, the ratio of the α phase in the metallographic structure of the seam welded pipe was less than 99.5%, and in a flattening test and a pipe expansion test for the seam welded pipe, cracking occurred. In addition, stress corrosion cracking resistance was also deteriorated. When the ratio of the α phase was 100%, workability and stress corrosion cracking resistance were improved and tensile strength, proof stress and elongation each had high values (refer to test Nos. 10, 25, 40, 55, 66, 73, 76, 206, 213 and the like).

In the seam welded pipe, even when the ratio of the α phase in the constituent phase of the metallographic structure of the original sheet material was 100%, the ratio of the α phase in the metallographic structure of the seam welded pipe was not 100% in some cases. When the ratio of the α phase in the metallographic structure of the seam welded pipe was 99.5% or more, and $0 \leq 2\times(\gamma)+(\beta) \leq 0.7$, and a metallographic structure in which a γ phase having an area ratio of 0% to 0.3% and a β phase having an area ratio of 0% to 0.5% are dispersed in the α phase matrix is provided, in a flattening test and a pipe expansion test for the seam welded pipe, cracking did not occur. Also, in the seam welded pipe, the composition relational expression $f1=[Zn]+5\times[Sn]-2\times[Ni]$ was important and the composition relational expression $f1=30$ had one threshold (refer to test Nos. 73, 79, 206, 213 or the like).

When the value of the composition relational expression $f2=[Zn]-0.5\times[Sn]-3\times[Ni]$ was greater than 28, stress corrosion cracking resistance were deteriorated. The composition relational expression $f2=28$ was a boundary value for determining whether the material could endure stress corrosion cracking in a severe environment, and as the numerical value decreased, stress corrosion cracking resistance was improved (refer to test Nos. 56, 80, 101, 102, 104, 105, 310, 313 and the like). In the Cu—Zn alloys shown in Comparative Examples (Test No. 401 to 404), stress corrosion cracking was dependant on the amount of Zn. The amount of Zn of about 25 mass % was a boundary content for determining whether the material could endure stress corrosion cracking in a severe environment. As a result, the amount of Zn was almost equal to the value of the composition relational expression f2 of 28.

When the value of the composition relational expression f3 was less than 10, stress relaxation characteristics were deteriorated. The composition relational expression $f3=10$ was a boundary value for determining whether stress relaxation characteristics were good or not. The value of the composition relational expression f3 was in a range from 10 to 20, as the value increased. Stress relaxation characteristics were further improved and effective stress at a high temperature was more than 300 $N/mm^2$ (refer to test Nos. 56, 80, 101 to 104, 106, 106A, 108, 307, 307A, 315 and the like).

While color fastness was improved due to the effect of incorporation of Ni and Sn, the value of the composition relational expression $f4=0.7\times[Ni]+[Sn]$ was less than 1.2, and color fastness and stress relaxation characteristics were deteriorated. When the value of the composition relational expression f4 was 1.2 or greater or 1.4 or greater, color fastness and stress relaxation characteristics were further improved (refer to test Nos. 56, 110, 302, 309, 310 and the like).

When the value of the composition relational expression f5=[Ni]/[Sn] was less than 1.4, stress relaxation characteristics were deteriorated and bending workability was also deteriorated. When the value of the composition relational expression f5 was 1.6 or greater, stress relaxation characteristics were improved and when the value was 1.8 or greater, stress relaxation characteristics were further improved. It was thought that the composition relational expression f5=1.6 had one threshold for determining whether stress relaxation characteristics were good or not (refer to test Nos. 312, 103, 67 and the like). In addition, when the value of the f5=[Ni]/[Sn] was greater than 90, stress relaxation characteristics and color fastness were deteriorated and also strength was lowered. When the value of the f5=[Ni]/[Sn] was less than 12, stress relaxation characteristics and color fastness were improved and strength was increased (refer to test Nos. 110, 133, 321, 322 and the like).

In the case of incorporation of P, when the value of the composition relational expression f6=[Ni]/[P] satisfied 25≤f6≤750, or 30≤f6≤500, stress relaxation characteristics were further improved, bending workability was not impaired, and stress corrosion cracking resistance was improved (refer to test Nos. 56, 112, 108, 109, 128, 123, 134, 135, 306 and the like).

In addition, precipitates mainly composed of Ni and P, that is, compounds were formed and the average particle size of the precipitates was 10 nm to 70 nm. Slightly fine grains were formed (refer to test Nos. 46 to 60, 118 and the like).

When 0.0005 mass % or more and 0.2 mass % or less in total of at least one or more selected from Fe, Co, Mg, Mn, Ti, Zr, Cr, Si, Pb and rare earth elements, each contained in an amount of 0.0005 mass % or more and 0.05 mass % or less were incorporated, fine grains were obtained and strength was slightly increased (refer to test Nos. 118 to 127, 132 and the like). Particularly, even when the contents of Fe and Co were 0.001 mass %, fine precipitates were obtained, the average grain size was reduced, and tensile strength and proof stress were improved.

When the amount of Fe or Co of more than 0.05 mass % was incorporated, the particle size of the precipitates was smaller than 3 nm and the average grain size was smaller than 2 μm. Thus, strength was increased, bending workability was deteriorated, and stress relaxation characteristics were slightly deteriorated (refer to test Nos. 318, 319 and the like).

As shown in Tables 27 and 28, regarding the antimicrobial properties of the alloys of the invention, when each additive element was within the composition range of the specification and each relational expressions were satisfied, excellent antimicrobial performance was exhibited. Further, the test pieces after the high temperature high humidity test at 60° C. and a humidity of 95% and the test pieces after the high temperature test at 120° maintained excellent antimicrobial performance. When the alloys were used for portions of a door knob or the like, touched by hands, and containers or the like, excellent antimicrobial properties (bactericidal properties) were achieved.

In addition, from the above evaluation results, regarding production processes and characteristics, the following was confirmed.

In actual production facilities, even when the number of annealing times including final annealing was 2 or 3 (processes A1-2, A2-2 and the like) or the method of annealing was a continuous annealing method or a batch type method (processes A2-1, A2-2 and the like), and the recovery heat treatment was a batch type method carried out in the laboratory or a continuous annealing method (processes A1-1, A1-2 and the like), strength, bending workability, color fastness, stress relaxation characteristics and stress corrosion cracking resistance, which are desired in the specification, were obtained.

The characteristics obtained from the actual production facilities were the almost the same as the characteristics of the process B of forming small pieces prepared in a laboratory (processes A2-1, B1-1 and the like).

In the laboratory test of small pieces, when final annealing or a recovery heat treatment was a continuous annealing method or a batch type method (processes B1-1 and B1-3), strength, bending workability, color fastness, stress relaxation characteristics and stress corrosion cracking resistance, which are desired in the specification, were obtained.

In the small sample pieces of the process B, the characteristics of the alloys of the invention prepared by carrying out annealing one time, carrying out only final annealing without annealing, or repeatedly carrying out annealing and cold rolling without a hot rolling process were almost the same (processes B1-1, B2-1 and B3-1).

In addition, when the recovery heat treatment was carried out, stress relaxation characteristics were improved and the ratio of proof stress/tensile strength was increased and the value was close to 1.0 (processes A2-2, A2-4 and the like).

The processes C1 and C1A were carried out by carrying out melting and casting in a laboratory using facilities of the laboratory, and the final heat treatment was a batch type method and a continuous heat treatment method. In the alloys of the invention prepared in both processes, for stress relaxation characteristics, a continuous annealing method was more effective but for the other characteristics were almost the same.

Under the conditions of a heat treatment (300° C.-0.07 minutes) and (250° C.-0.15 minutes) on the assumption of molten Sn plating or the like, compared to conditions for other recovery heat treatments including a recovery heat treatment in an actual apparatus, strength was lightly high, and the value of elongation was low, and the values of stress relaxation characteristics and effective stress at 150° C. were deteriorated. The target characteristics could be achieved. This heat treatment can be replaced by the recovery heat treatment by carrying out molten Sn plating or the like, or the recovery heat treatment can be omitted.

The value of the heat treatment conditional expression It1 was high, the final working rate was 25% in the processes A2-5 and 2-6, and strength was slightly high. However, bending workability and stress corrosion cracking resistance were maintained and were satisfactory.

Regarding stress relaxation characteristics, the case in which final annealing was carried out by a continuous high temperature short time annealing method was better compared to the case in which a batch type annealing method was carried out. Particularly, in the case of incorporation of P, when annealing was carried out by a high temperature short time annealing method, good stress relaxation characteristics were obtained. In addition, when the index It1 was slightly high, satisfactory stress relaxation characteristics were obtained (processes A1-4, A2-2, A2-5 and A2-7). It was thought that the stress relaxation characteristics were affected by balance between Ni and P in the solid solution state and precipitates of Ni and P.

In the process A2-7 in which the value of It1 was close to the upper limit, irrespective of a high rolling reduction, compared to the process A2-2, strength was the same or lowered, and stress relaxation characteristics were saturated. Bending workability was slightly deteriorated. In the process A2-8 in which the value of It1 was greater than the upper limit, the average grain size was large and irrespective of a high rolling reduction, strength was low and the orientation of material strength was generated. Thus, bending workability, stress relaxation characteristics and stress corrosion cracking resistance were deteriorated. In the process A2-9, when the temperature was excessively raised by batch type annealing, the grains were enlarged and remarkable mixed grains were formed. Therefore, bending workability was deteriorated, the orientation of material strength, that is, the values of $YS_P/TS_P$ and $YS_P/YS_O$ were smaller than 0.9, and stress relaxation characteristics and stress corrosion cracking resistance were deteriorated. In the process A2-10, since the value of It1 was smaller than a predetermined value, a metallographic structure including uncrystallized portions was formed. Thus, although strength was high, bending workability, stress relaxation characteristics and stress corrosion cracking resistance were deteriorated.

There was almost no difference in the recovery heat treatment under batch type conditions (300° C., holding time: 30 minutes) and continuous high temperature short time conditions (450° C.-0.05 minutes) (processes A2-1, A2-2, A1-1, A1-2 and the like).

As described above, when an element such as Ni or Sn are suitably or most suitably contained in the copper alloy containing a high concentration of Zn, the alloy can be formed into a sheet material and a seam welded pipe having excellent color fastness, high strength, good bending workability, satisfactory color fastness, stress relaxation characteristics, stress corrosion cracking resistance at a high temperature and high humidity or at a high temperature, and high antimicrobial performance. Accordingly, excellent cost performance, a reduction in thickness and a compact body, which are required in these days, can be obtained, and a severe environment including a final product that endures a high temperature and a high humidity, further, a multifunctional final product with high performance and high functionality can be obtained. Particularly, when plating is carried out to solve color change or stress corrosion problems, the plating can be omitted and high conductivity or antimicrobial and bactericidal performance of a copper alloy can be continuously exhibited. Specifically, since strength is high, stress relaxation characteristics are excellent, and the alloy can endure a severe use environment, the alloy is suitable for connectors, terminals, relays, switches, springs, sockets and the like used in electronic and electric apparatus components and automobile components. In addition, since strength is high, the alloy can endure a severe use environment, antimicrobial performance is high, and the high antimicrobial properties can be maintained, the alloy is a suitable material for construction metal fittings and members such as handrails, door handles, inner wall materials or the like, medical appliances and containers, water supply and drain facilities, apparatuses and containers, decoration members, and the like.

Further, when conductivity is 14% IACS or more and 25% IACS or less and the metallographic structure is composed of an α phase, further excellent strength and balance between strength and bending workability are obtained and stress relaxation characteristics, particularly, effective stress at 150° C. is increased. Thus, the alloy is a more suitable material for connectors, terminals, relays, switches, springs, sockets and the like used in electronic and electric apparatus components and automobile components used in a severe environment.

INDUSTRIAL APPLICABILITY

According to the copper alloys of the present invention, excellent cost performance, a small density, and a conductivity higher than the conductivity of phosphorus bronze or nickel silver can be provided and high strength, balance between strength and elongation and bending workability, stress relaxation characteristics, stress corrosion cracking resistance, color fastness, and antimicrobial properties can be improved.

The invention claimed is:

1. A method of producing a copper alloy sheet that is composed of a copper alloy, the method comprising the steps of:

(a) providing the copper alloy, consisting of
- (i) 17 mass % to 34 mass % of Zn;
- (ii) 0.02 mass % to 2.0 mass % of Sn;
- (iii) 1.6 mass % to 5 mass % of Ni; and
- (iv) a balance consisting of Cu and unavoidable impurities, wherein a Zn content [Zn] (mass %), a Sn content [Sn] (mass %), and a Ni content [Ni] (mass %) of the copper alloy satisfy relationships of $$12 \le f1 = [Zn] + 5 \times [Sn] - 2 \times [Ni] \le 30,$$

$$10 \le f2 = [Zn] - 0.3 \times [Sn] - 2 \times [Ni] \le 28,$$

$$10 \le f3 = \{f1 \times (32 - f1) \times [Ni]\}^{1/2} \le 33,$$

$$1.2 \le 0.7 \times [Ni] + [Sn] \le 4, \text{ and}$$

$$1.4 \le [Ni]/[Sn] \le 90,$$

wherein conductivity is 13% IACS or more and 25% IACS or less, and wherein, in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \le 2 \times (\gamma) + (\beta) \le 0.7$, and the γ phase having an area ratio of 0% to 0.3% and the β phase having an area ratio of 0% to 0.5% are dispersed in the α phase matrix; and (b) producing the copper alloy sheet according to a sequential production process, wherein the sequential production process comprises (b1) a hot rolling process;

(b2) a cold rolling process;

(b3) a recrystallization heat treatment process; and (b4) a finish cold rolling process, wherein a cold working rate in the cold rolling process is 40% or more, wherein (b3) the recrystallization heat treatment process includes the sequential steps of
- (b3-a) heating the cold-rolled copper alloy material to a predetermined temperature using a continuous heat treatment furnace;
- (b3-b) holding the copper alloy material at a predetermined temperature for a predetermined period of time; and (b3-c) cooling the copper alloy material to a predetermined temperature; and wherein, in (b3) the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq Tmax \leq 790,$$

$$0.04 \leq tm \leq 1.0, \text{ and}$$

$$500 \leq It1 = (Tmax - 30 \times tm^{-1/2}) \leq 680.$$

2. The method of producing a copper alloy sheet according to claim 1, wherein (b) the production process includes (b5) a recovery heat treatment process, wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature; and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120 \leq It2 = (Tmax2 - 25 \times tm2^{-1/2}) \leq 390.$$

3. A method of producing a copper alloy sheet that is composed of a copper alloy, the method comprising the steps of:

(a) providing the copper alloy consisting of (i) 18 mass % to 33 mass % of Zn;

(ii) 0.2 mass % to 1.5 mass % of Sn;

(iii) 1.6 mass % to 4 mass % of Ni; and (iv) a balance consisting of Cu and unavoidable impurities, wherein a Zn content [Zn] (mass %), a Sn content [Sn] (mass %), and a Ni content [Ni] (mass %) of the copper alloy satisfy relationships of:

$$15 \leq f1 = [Zn] + 5 \times [Sn] - 2 \times [Ni] \leq 30,$$

$$12 \leq f2 = [Zn] - 0.3 \times [Sn] - 2 \times [Ni] \leq 28,$$

$$10 \leq f3 = \{f1 \times (32 - f1) \times [Ni]\}^{1/2} \leq 30,$$

$$1.4 \leq 0.7 \times [Ni] + [Sn] \leq 3.6, \text{ and}$$

$$1.6 \leq [Ni]/[Sn] \leq 12,$$

wherein conductivity is 14% IACS or more and 25% IACS or less, and wherein a metallographic structure is composed of an α single phase; and (b) producing the copper alloy sheet by a sequential production process including the sequential steps of (b1) a hot rolling process;

(b2) a cold rolling process;

(b3) a recrystallization heat treatment process; and (b4) a finish cold rolling process, wherein a cold working rate in the cold rolling process is 40% or more, wherein the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature, and wherein, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq Tmax \leq 790,$$

$$0.04 \leq tm \leq 1.0, \text{ and}$$

$$500 \leq It1 = (Tmax - 30 \times tm^{-1/2}) \leq 680.$$

4. A method of producing a copper alloy sheet that is composed of a copper alloy, the method comprising the steps of:

(a) providing the copper alloy consisting of (i) 17 mass % to 34 mass % of Zn;

(ii) 0.02 mass % to 2.0 mass % of Sn;

(iii) 1.6 mass % to 5 mass % of Ni;

(iv) at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb; and (v) a balance consisting of Cu and unavoidable impurities, wherein a Zn content [Zn] (mass %), a Sn content [Sn] (mass %), and a Ni content [Ni] (mass %) of the copper alloy satisfy relationships of:

$$12 \leq f1 = [Zn] + 5 \times [Sn] - 2 \times [Ni] \leq 30,$$

$$10 \leq f2 = [Zn] - 0.3 \times [Sn] - 2 \times [Ni] \leq 28,$$

$$10 \leq f3 = \{f1 \times (32 - f1) \times [Ni]\}^{1/2} \leq 33,$$

$$1.2 \leq 0.7 \times [Ni] + [Sn] \leq 4, \text{ and}$$

$$1.4 \leq [Ni]/[Sn] \leq 90,$$

wherein conductivity is 13% IACS or more and 25% IACS or less, and wherein, in a metallographic structure, a ratio of an α phase in a constituent phase of the metallographic structure is 99.5% or more by area ratio or an area ratio of a γ phase (γ) % and an area ratio of β phase (β) % of an α phase matrix satisfy a relationship of $0 \leq 2 \times (\gamma) + (\beta) \leq 0.7$, and the γ phase having an area ratio of 0% to 0.3% and the γ phase having an area ratio of 0% to 0.5% are dispersed in the α phase matrix; and (b) producing the copper alloy sheet by a sequential production process including (b1) a hot rolling process;

(b2) a cold rolling process;

(b3) a recrystallization heat treatment process; and (b4) a finish cold rolling process, wherein a cold working rate in the cold rolling process is 40% or more, wherein the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature; and wherein, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq \mathrm{Tmax} \leq 790,$$

$$0.04 \leq \mathrm{tm} \leq 1.0, \text{ and}$$

$$500 \leq It1 = (T\mathrm{max} - 30 \times tm^{-1/2}) \leq 680.$$

5. A method of producing a copper alloy sheet that is composed of a copper alloy, the method comprising the steps of:

(a) providing the copper alloy consisting of (i) 18 mass % to 33 mass % of Zn;

(ii) 0.2 mass % to 1.5 mass % of Sn;

(iii) 1.6 mass % to 4 mass % of Ni;

(iv) 0.003 mass % to 0.08 mass % of P; and (v) a balance consisting of Cu and unavoidable impurities, wherein a Zn content [Zn] (mass %), a Sn content [Sn] (mass %), a Ni content [Ni] (mass %), and P content [P] (mass %) of the copper alloy satisfy relationships of:

$$15 \leq f1 = [\mathrm{Zn}] + 5 \times [\mathrm{Sn}] - 2 \times [\mathrm{Ni}] \leq 30,$$

$$12 \leq f2 = [\mathrm{Zn}] - 0.3 \times [\mathrm{Sn}] - 2 \times [\mathrm{Ni}] \leq 28,$$

$$10 \leq f3 = \{f1 \times (32 - f1) \times [\mathrm{Ni}]\}^{1/2} \leq 30,$$

$$1.4 \leq 0.7 \times [\mathrm{Ni}] + [\mathrm{Sn}] \leq 3.6,$$

$$1.6 \leq [\mathrm{Ni}]/[\mathrm{Sn}] \leq 12, \text{ and}$$

$$25 \leq [\mathrm{Ni}]/[\mathrm{P}] \leq 750,$$

wherein conductivity is 14% IACS or more and 25% IACS or less, and wherein a metallographic structure is composed of an a single phase, and (b) producingthe copper alloy sheet by a sequential production process including (b1) a hot rolling process;

(b2) a cold rolling process;

(b3) a recrystallization heat treatment process; and (b4) a finish cold rolling process, wherein a cold working rate in the cold rolling process is 40% or more, wherein, the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature, and wherein, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq \mathrm{Tmax} \leq 790,$$

$$0.04 \leq \mathrm{tm} \leq 1.0, \text{ and}$$

$$500 \leq It1 = (T\mathrm{max} - 30 \times tm^{-1/2}) \leq 680.$$

6. A method of producing a copper alloy sheet that is composed of a copper alloy, the method comprising the steps of:

(a) providing the copper alloy comprising (i) 17 mass % to 34 mass % of Zn;

(ii) 0.02 mass % to 2.0 mass % of Sn;

(iii) 1.6 mass % to 5 mass % of Ni;

(iv) 0.0005 mass % or more and 0.2 mass % or less in total of at least one or more selected from Fe, Co, Mg, Mn, Ti, Zr, Cr, Si and rare earth metal elements, each contained in an amount of 0.0005 mass % or more and 0.05 mass % or less; and (v) a balance consisting of Cu and unavoidable impurities, wherein a Zn content [Zn] (mass %), a Sn content [Sn] (mass %), and a Ni content [Ni] (mass %) of the copper alloy satisfy relationships of:

$$12 \leq f1 = [\mathrm{Zn}] + 5 \times [\mathrm{Sn}] - 2 \times [\mathrm{Ni}] \leq 30,$$

$$10 \leq f2 = [\mathrm{Zn}] - 0.3 \times [\mathrm{Sn}] - 2 \times [\mathrm{Ni}] \leq 28,$$

$$10 \leq f3 = \{f1 \times (32 - f1) \times [\mathrm{Ni}]\}^{1/2} \leq 33,$$

$$1.2 \leq 0.7 \times [\mathrm{Ni}] + [\mathrm{Sn}] \leq 4, \text{ and}$$

$$1.4 \leq [\mathrm{Ni}]/[\mathrm{Sn}] \leq 90,$$

wherein conductivity is 13% IACS or more and 25% IACS or less, and wherein, in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2 \times (\gamma) + (\beta) \leq 0.7$, and the γ phase having an area ratio of 0% to 0.3% and the β phase having an area ratio of 0% to 0.5% are dispersed in the α phase matrix; and (b) producingthe copper alloy sheet by a sequential production process including (b1) a hot rolling process;

(b2) a cold rolling process;

(b3) a recrystallization heat treatment process; and (b4) a finish cold rolling process, wherein a cold working rate in the cold rolling process is 40% or more, wherein the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature; and wherein, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq \mathrm{Tmax} \leq 790,$$

$$0.04 \leq \mathrm{tm} \leq 1.0, \text{ and}$$

$$500 \leq It1 = (T\mathrm{max} - 30 \times tm^{-1/2}) \leq 680.$$

7. A method of producing a copper alloy sheet that is composed of a copper alloy, the method comprising the steps of:

(a) providing the copper alloy comprising (i) 17 mass % to 34 mass % of Zn;

(ii) 0.02 mass % to 2.0 mass % of Sn;

(iii) 1.6 mass % to 5 mass % of Ni;

(iv) at least one or more selected from 0.003 mass % to 0.09 mass % of P, 0.005 mass % to 0.5 mass % of Al, 0.01 mass % to 0.09 mass % of Sb, 0.01 mass % to 0.09 mass % of As, and 0.0005 mass % to 0.03 mass % of Pb;

(v) 0.0005 mass % or more and 0.2 mass % or less in total of at least one or more selected from Fe, Co, Mg, Mn, Ti, Zr, Cr, Si and rare earth metal elements, each contained in an amount of 0.0005 mass % or more and 0.05 mass % or less; and (vi) a balance consisting of Cu and unavoidable impurities, wherein a Zn content [Zn] (mass %), a Sn content [Sn] (mass %), and a Ni content [Ni] (mass %) of the copper alloy satisfy relationships of:

$$12 \leq f1 = [\mathrm{Zn}] + 5 \times [\mathrm{Sn}] - 2 \times [\mathrm{Ni}] \leq 30,$$

$$10 \leq f2 = [\mathrm{Zn}] - 0.3 \times [\mathrm{Sn}] - 2 \times [\mathrm{Ni}] \leq 28,$$

$$10 \leq f3 = \{f1 \times (32 - f1) \times [\mathrm{Ni}]\}^{1/2} \leq 33,$$

$$1.2 \leq 0.7 \times [\mathrm{Ni}] + [\mathrm{Sn}] \leq 4, \text{ and}$$

$$1.4 \leq [\mathrm{Ni}]/[\mathrm{Sn}] \leq 90,$$

wherein conductivity is 13% IACS or more and 25% IACS or less, and wherein, in a metallographic structure, a ratio of an α phase in a constituent phase of the metallographic structure is 99.5% or more by area ratio or an area ratio of a γ phase (γ) % and an area ratio of a β phase (β) % of an α phase matrix satisfy a relationship of $0 \leq 2 \times (\gamma) + (\beta) \leq 0.7$, and the γ phase having an area ratio of 0% to 0.3% and the β phase having an area ratio of 0% to 0.5% are dispersed in the α phase matrix; and:

(b) producingthe copper alloy sheet by a sequential production process including (b1) a hot rolling process;

(b2) a cold rolling process;

(b3) a recrystallization heat treatment process; and (b4) a finish cold rolling process, wherein a cold working rate in the cold rolling process is 40% or more, wherein the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature; and wherein, in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq \mathrm{Tmax} \leq 790,$$

$$0.04 \leq \mathrm{tm} \leq 1.0, \text{ and}$$

$$500 \leq It1 = (T\mathrm{max} - 30 \times tm^{-1/2}) \leq 680.$$

8. A method of producing a copper alloy sheet that is composed of a copper alloy, the method comprising the steps of:

(a) providing the copper alloy comprising (i) 18 mass % to 33 mass % of Zn;

(ii) 0.2 mass % to 1.5 mass % of Sn;

(iii) 1.6 mass % to 4 mass % of Ni;

(iv) 0.003 mass % to 0.08 mass % of P;

(v) 0.0005 mass % or more and 0.2 mass % or less in total of at least one or more selected from Fe, Co, Mg, Mn, Ti, Zr, Cr, Si and rare earth elements, each contained in an amount of 0.0005 mass % or more and 0.05 mass % or less; and (vi) a balance consisting of Cu and unavoidable impurities, wherein a Zn content [Zn] (mass %), a Sn content [Sn] (mass %), a Ni content [Ni] (mass %), and a P content [P] (mass %) of the copper alloy satisfy relationships of:

$$15 \leq f1 = [\mathrm{Zn}] + 5 \times [\mathrm{Sn}] - 2 \times [\mathrm{Ni}] \leq 30,$$

$$12 \leq f2 = [\mathrm{Zn}] - 0.3 \times [\mathrm{Sn}] - 2 \times [\mathrm{Ni}] \leq 28,$$

$$10 \leq f3 = \{f1 \times (32 - f1) \times [\mathrm{Ni}]\}^{1/2} \leq 30,$$

$$1.4 \leq 0.7 \times [\mathrm{Ni}] + [\mathrm{Sn}] \leq 3.6,$$

$$1.6 \leq [\mathrm{Ni}]/[\mathrm{Sn}] \leq 12, \text{ and}$$

$$25 \leq [\mathrm{Ni}]/[\mathrm{P}] \leq 750,$$

wherein conductivity is 14% IACS or more and 25% IACS or less, and wherein a metallographic structure is composed of an α single phase, and (b) producing the copper alloy sheet by a sequential production process including (b1) a hot rolling process;

(b2) a cold rolling process;

(b3) a recrystallization heat treatment process; and (b4) a finish cold rolling process, wherein a cold working rate in the cold rolling process is 40% or more, wherein the recrystallization heat treatment process includes the sequential steps of (b3-a) heating the cold-rolled copper alloy material to a predetermined temperature using a continuous heat treatment furnace;

(b3-b) holding the copper alloy material at a predetermined temperature for a predetermined period of time; and (b3-c) cooling the copper alloy material to a predetermined temperature, and wherein in the recrystallization heat treatment process, when a maximum reaching temperature of the copper alloy material is denoted by Tmax (° C.), and a heating and holding time in a temperature range of a temperature 50° C. lower than the maximum reaching temperature of the copper alloy material to the maximum reaching temperature is denoted by tm (min), $$540 \leq Tmax \leq 790,$$

$$0.04 \leq tm \leq 1.0, \text{ and}$$

$$500 \leq It1 = (Tmax - 30 \times tm^{-1/2}) \leq 680.$$

9. The method of producing a copper alloy sheet according to claim 3, wherein (b) the production process includes (b5) a recovery heat treatment process, wherein (b5) the recover heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120It2 = (Tmax2 - 25 \times tm2^{-1/2}) \leq 390.$$

10. The method of producing a copper alloy sheet according to claim 4, wherein (b) the production process includes (b5) a recovery heat treatment process, wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120It2 = (Tmax2 - 25 \times tm2^{-1/2}) \leq 390.$$

11. The method of producing a copper alloy sheet according to claim 5, wherein (b) the production process includes (b5) a recovery heat treatment process wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120It2 = (Tmax2 - 25 \times tm2^{-1/2}) \leq 390.$$

12. The method of producing a copper alloy sheet according to claim 6, wherein (b) the production process includes (b5) a recovery heat treatment process, wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120It2 = (Tmax2 - 25 \times tm2^{-1/2}) \leq 390.$$

13. The method of producing a copper alloy sheet according to claim 7, wherein (b) the production process includes (b5) a recovery heat treatment process,wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time; and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120 It2 = (Tmax2 - 25 \times tm2^{-1/2}) \leq 390.$$

14. The method of producing a copper alloy sheet according to claim 8, wherein (b) the production process includes (b5) a recovery heat treatment process,wherein (b5) the recovery heat treatment process is carried out after (b4) the finish cold rolling process, wherein (b5) the recovery heat treatment process includes the sequential steps of (b5-a) heating the finish cold-rolled copper alloy material to a predetermined temperature;

(b5-b) holding the copper alloy material at a predetermined temperature for a predetermined period of time, and (b5-c) cooling the copper alloy material to a predetermined temperature, and wherein, when a maximum reaching temperature of the copper alloy material is denoted by Tmax2 (° C.), and a heating and holding time in a temperature range of a temperature 50° C. lower than the maximum reaching temperature of the copper alloy material to the maximum reaching temperature is denoted by tm2 (min), $$150 \leq Tmax2 \leq 580,$$

$$0.02 \leq tm2 \leq 100, \text{ and}$$

$$120 It2 = (Tmax2 - 25 \times tm2^{-1/2}) \leq 390.$$

* * * * *